US011774164B2

(12) United States Patent
Moon et al.

(10) Patent No.: US 11,774,164 B2
(45) Date of Patent: Oct. 3, 2023

(54) REFRIGERATOR

(71) Applicant: LG Electronics Inc., Seoul (KR)

(72) Inventors: Jiwook Moon, Seoul (KR); Sangho Jung, Seoul (KR); Daekil Kang, Seoul (KR); Gyunghyun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 139 days.

(21) Appl. No.: 17/350,440

(22) Filed: Jun. 17, 2021

(65) Prior Publication Data

US 2021/0396458 A1 Dec. 23, 2021

(30) Foreign Application Priority Data

Jun. 17, 2020 (KR) ..... 10-2020-0073939
Sep. 2, 2020 (KR) ..... 10-2020-0111954

(51) Int. Cl.

| | |
|---|---|
| ***F25D 23/02*** | (2006.01) |
| ***F25D 23/06*** | (2006.01) |
| ***F25D 23/10*** | (2006.01) |
| ***A47B 96/20*** | (2006.01) |

(52) U.S. Cl.

CPC ..... *F25D 23/02* (2013.01); *A47B 96/20* (2013.01); *F25D 23/028* (2013.01); *F25D 23/063* (2013.01); *F25D 23/10* (2013.01); *A47B 2096/208* (2013.01)

(58) Field of Classification Search

CPC ... A47B 2096/208; A47B 96/20; F25D 23/02; F25D 23/028; F25D 2323/02; F25D 2400/18

See application file for complete search history.

(56) References Cited

U.S. PATENT DOCUMENTS 7,954,345 B2 * 6/2011 Park ..... D06F 39/14 68/139
8,789,900 B2 7/2014 Laible et al.
2007/0188059 A1 8/2007 Davis et al.
(Continued)

FOREIGN PATENT DOCUMENTS

CN 101676635 3/2010
CN 110199165 9/2019
(Continued)

OTHER PUBLICATIONS

Application KR1020200043017, 54 pages, foreign priority application for US20210318056A1 (Year: 2020).*
(Continued)

*Primary Examiner* — Andrew M Roersma
(74) *Attorney, Agent, or Firm* — Fish & Richardson P.C.

(57) ABSTRACT

A refrigerator includes a cabinet and a door. The door includes a door liner, a front plate, a first cap decor coupled to the door liner and the front plate, a second cap decor coupled to the door liner and the front plate at a position facing the first cap decor, an insulator filled into a space defined by coupling of the door liner, the front plate, and the cap decors, and a panel assembly disposed detachably in front of the front plate. The panel assembly includes a panel defining an outer appearance of a front surface of the door, a first bracket protruding from a rear surface of the panel and inserted into the first cap decor, and a second bracket provided on the rear surface of the panel and supported by the second cap decor.

20 Claims, 49 Drawing Sheets

(56) References Cited

U.S. PATENT DOCUMENTS

| | | | | |
|---|---|---|---|---|
| 2008/0042537 | A1* | 2/2008 | Kim | F25D 23/02 312/405 |
| 2010/0026155 | A1 | 2/2010 | Yun | |
| 2018/0172337 | A1 | 6/2018 | Choi et al. | |
| 2020/0326119 | A1* | 10/2020 | Lee | F25D 23/02 |
| 2021/0055038 | A1* | 2/2021 | Lee | F25C 5/22 |
| 2021/0247133 | A1 | 8/2021 | Kang et al. | |
| 2021/0318056 | A1* | 10/2021 | Park | F25D 23/028 |
| 2022/0214097 | A1 | 7/2022 | Choi et al. | |

FOREIGN PATENT DOCUMENTS

| | | | | |
|---|---|---|---|---|
| CN | 110382981 | | 10/2019 | |
| CN | 110542267 | | 12/2019 | |
| EP | 0647821 | | 4/1995 | |
| EP | 3809072 | | 4/2021 | |
| EP | 3809076 | | 4/2021 | |
| GB | 2050814 | | 1/1981 | |
| JP | H0791816 | | 4/1995 | |
| JP | H0835761 | | 2/1996 | |
| JP | 2016156556 | A | 9/2016 | |
| KR | 20000019775 | | 11/2000 | |
| KR | 2010057246 | A * | 5/2010 | |
| KR | 20180106734 | | 10/2018 | |
| WO | WO-2014024429 | A1 * | 2/2014 | F25D 23/02 |
| WO | WO2020213 861 | | 10/2020 | |
| WO | WO2021112658 | | 6/2021 | |
| WO | WO-2021112658 | A1 * | 6/2021 | A47B 96/201 |

OTHER PUBLICATIONS

Extended European Search Report in European Appln. No. 21180109.7, dated Nov. 18, 2021, 8 pages.

Office Action in Chinese Appln. No. 202110672134.8, dated Aug. 25, 2022, 11 pages (with English translation).

Office Action in Chinese Appln. No. 202180016561.9, dated Apr. 29, 2023, 20 pages (with English translation).

* cited by examiner

REFRIGERATOR

CROSS-REFERENCE TO RELATED APPLICATIONS

The present application claims priority under 35 U.S.C. 119 and 35 U.S.C. 365 to Korean Patent Application Nos. 10-2020-0073939, filed on Jun. 17, 2020, and 10-2020-0111954, filed on Sep. 2, 2020, the disclosures of which are hereby incorporated by reference in their entirety.

BACKGROUND

The present disclosure relates to a refrigerator.

In general, refrigerators are home appliances for storing foods at low temperature in an inner storage space covered by a refrigerator door. Here, the inside of the storage space is cooled using cool air that is generated by being heat-exchanged with a refrigerant circulated in a refrigeration cycle to store the foods in an optimal state.

Such refrigerators tend to increase more and more in size and provide multi-functions due to the trends of change of dietary life and high quality, and accordingly, refrigerators provided with various structures and convenience devices in consideration of user convenience are brought to the market.

In addition, structures that vary in outer appearance of a front surface of a door of the refrigerator are opened to harmonize with an environment, in which the refrigerator is disposed, or surrounding furniture or home appliances.

A structure in which a decor panel defining the outer appearance of the front surface of the door of the refrigerator is mounted is disclosed in U.S. Pat. No. 8,789,900. Also, a structure, in which a plurality of bridges for restriction are disposed at both sides of the decor panel, and brackets inserted into both ends of the door are coupled to the bridge so that the decor panel is mounted, is disclosed.

However, in the above-described technology according to the related art, since the plurality of brackets have to be mounted on the outside so as to mount the panel, productivity may be deteriorated, and an accurate mounting position may not be maintained according to workability of a worker. Particularly, there is a limitation of deteriorating the outer appearance of the structure in which the brackets for the coupling are exposed to both the sides of the door.

A structure in which a glass panel defining the outer appearance of the front surface of the door of the refrigerator is mounted is disclosed in Japanese Patent No. 6460832. In addition, a structure in which a plurality of recessed grooves are defined in a front surface portion of a door body, and an installation portion bent in multiple stages is disposed on a rear surface of the glass panel, and the installation portion is inserted into each of the recessed grooves to mount the glass panel, is disclosed.

However, in such a technology according to the related art, it is not easy to accurately couple a plurality of installation portions, which are disposed on the rear surface of the glass panel, to the grooves of the door body, and thus, there is a limitation in that workability and productivity are deteriorated.

In addition, when the door is foamed, the groove may be deformed, and when the groove is deformed, there is a limitation that the glass panel is accurately mounted.

In addition, when a weight of the panel is heavy, large groove and installation portion or many grooves and installation portions are required for supporting the panel, and thus, there is a limitation of increasing in volume of the door or increasing in manufacturing cost.

SUMMARY

Embodiments provide a refrigerator having an improved outer appearance by preventing a structure that is configured to mount a panel assembly from being exposed to the outside.

Embodiments also provide a refrigerator, in which a panel assembly is capable of being maintained in a firmly mounted state.

Embodiments also provide a refrigerator in which a panel assembly is easily mounted and detached.

In one embodiment, a refrigerator includes: a cabinet configured to define a storage space; and a door configured to open and close the cabinet, wherein the door includes: a door liner configured to define a rear surface of the door; a front plate spaced forward from the door liner; a first cap decor coupled to the door liner and one end of the front plate; a second cap decor coupled to the door liner and the other end of the front plate at a position facing the first cap decor; an insulator filled into a space defined by coupling of the door liner, the front plate, and the cap decors; and a panel assembly disposed detachably in front of the front plate, wherein the panel assembly includes: a panel configured to define an outer appearance of a front surface of the door; a first bracket protruding from a rear surface of the panel and inserted into the first cap decor so as to be restricted; and a second bracket provided on the rear surface of the panel and supported by the second cap decor.

The first bracket may include: an adhesion portion extending along an end of the panel; and an insertion protrusion provided in plurality at a regular interval along the adhesion portion, the insertion protrusion protruding a front surface of the first cap decor.

The first cap decor may include a decor recess that is recessed from an outer surface of the door to communicate with an insertion hole opened in the front surface of the first cap decor, and the insertion protrusion may be inserted into the decor recess by passing through the insertion hole.

A decor cover configured to shield the decor recess may be provided on the first cap decor, and a restriction protrusion extending to the inside of the decor recess to restrict the insertion protrusion may be disposed on the decor cover.

A through-hole that is penetrated vertically may be defined in the insertion protrusion, and the restriction protrusion may extend to pass through the through-hole when the decor cover is mounted on the first cap decor.

A protrusion inclination surface having a width that gradually decreases in an extension direction thereof may be disposed on the restriction protrusion, and when the restriction protrusion is inserted, the panel assembly may be in close contact toward the front plate by contact between the protrusion inclination surface and the through-hole.

The refrigerator may further include a decor coupling portion which is configured to support the decor cover at a lower side and to which a screw passing through the decor cover is coupled is further disposed inside the decor recess.

The inside of the decor recess may be provided as a space that is partitioned so that the insulator is not permeated therein.

The first cap decor may be provided with a first support end disposed along an end of the first cap decor and protruding forward to support an end of the panel.

A plate coupling portion coupled to an upper end of the front plate may be disposed on the front surface of the first cap decor, and the insertion hole may be defined above the plate coupling portion.

The second cap decor is provided with a second support end disposed along an end of the second cap decor and protruding forward to support an end of the panel, and a plurality of restriction portions coupled to the second bracket may protrude along the second support end.

A bracket insertion portion that is opened downward so that the restriction portion is inserted may be defined in a lower end of the second bracket, and when a lower end of the panel is mounted to be in contact with the second support end, the restriction portion may be disposed inside the bracket insertion portion.

The front plate may be made of a steel material, and the front plate may be attached to each of both left and right ends of the rear surface of the panel.

The panel may be made of a metal material, and a bent portion that is bent backward may be disposed along a circumference of the panel.

A panel seating portion on which the first bracket and the second bracket are mounted may be disposed on a circumference of the panel.

The panel may be made of a glass or FENIX material.

The first cap decor may be configured to define a top surface of the door, and the second cap decor may be configured to define a bottom surface of the second cap decor, in a lower end of the panel assembly, a lower protrusion protruding upward from the second cap decor may be inserted to be restricted by the second bracket, and in an upper end of the panel assembly, an upper coupling member coupled by passing through the first cap decor may be coupled to the first bracket.

The first bracket may include: an upper adhesion portion that is in contact with the rear surface of the panel; and an upper coupling protrusion which protrudes backward from the upper adhesion portion and to which an upper coupling member coupled by passing through the first cap decor is coupled.

An upper coupling portion through which the upper coupling member passes may be provided on a front surface of the first cap decor facing the upper coupling protrusion, a recessed space having an opened top surface may be defined in the first cap decor, and the upper coupling member may be exposed to the inside of the recessed space so that the upper coupling member is coupled through the recessed space.

The upper coupling portion may be recessed backward to accommodate the upper coupling protrusion and protrudes to the inside of the recessed space.

In another embodiment, a refrigerator includes: a cabinet configured to define a storage space; and a door configured to open and close the storage space, wherein the door includes: a door body in which an insulator is filled and of which outer appearances of top and bottom surfaces are defined by an upper cap decor and a lower cap decor; and a panel assembly provided on a front surface of the door body to define an outer appearance of a front surface of the door, wherein, in a lower end of the panel assembly, a lower protrusion protruding upward from the lower cap decor is inserted to be restricted, and in an upper end of the panel assembly, an upper coupling member coupled by passing through the upper cap decor is coupled to be mounted on the body.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments will be described in detail with reference to the accompanying drawings. However, the scope of the present disclosure is not limited to proposed embodiments of the present invention, and other regressive inventions or other embodiments included in the scope of the spirits of the present disclosure may be easily proposed through addition, change, deletion, and the like of other elements.

In the present technique, references to 'vertical', 'up', 'down', 'up and down', 'upper', 'lower', 'upward', 'downward', 'under' and like phrases, unless otherwise expressly stated, are to be understood with respect to an upright position of the refrigerator, i.e. a direction extending from a base or bottom of the refrigerator to a top of the refrigerator, for example when the refrigerator is installed for use. Similarly, references to 'front', 'back', 'rear', 'forward', 'rearward', 'to-and-fro', 'front and back', 'back and forth' direction and like phrases, unless otherwise expressly stated, are to be understood with respect to a direction when viewed from a front side of the refrigerator towards the storage space of the refrigerator, i.e. a direction extending from a door of the refrigerator inwards towards the storage space of the refrigerator. Similarly, references to 'horizontal', 'lateral', 'side', 'left', 'right', 'left side', 'right side', 'side to side' and like phrases, unless otherwise expressly stated, are to be understood with respect to a direction perpendicular to the vertical direction and to the front and back direction of the refrigerator, for example when viewed from a front side of the refrigerator in a direction towards the storage space of the refrigerator.

A direction will be defined prior to the explanation. In an embodiment of the present disclosure, a direction facing a front surface of the door illustrated in FIG. 2 may be defined as a front direction, a direction facing a cabinet with respect to the front surface of the door will be defined as a rear direction, a direction facing a bottom surface on which the refrigerator is installed will be defined as a downward direction, and a direction that is away from the bottom surface will be defined as an upward direction.

Figure 1:
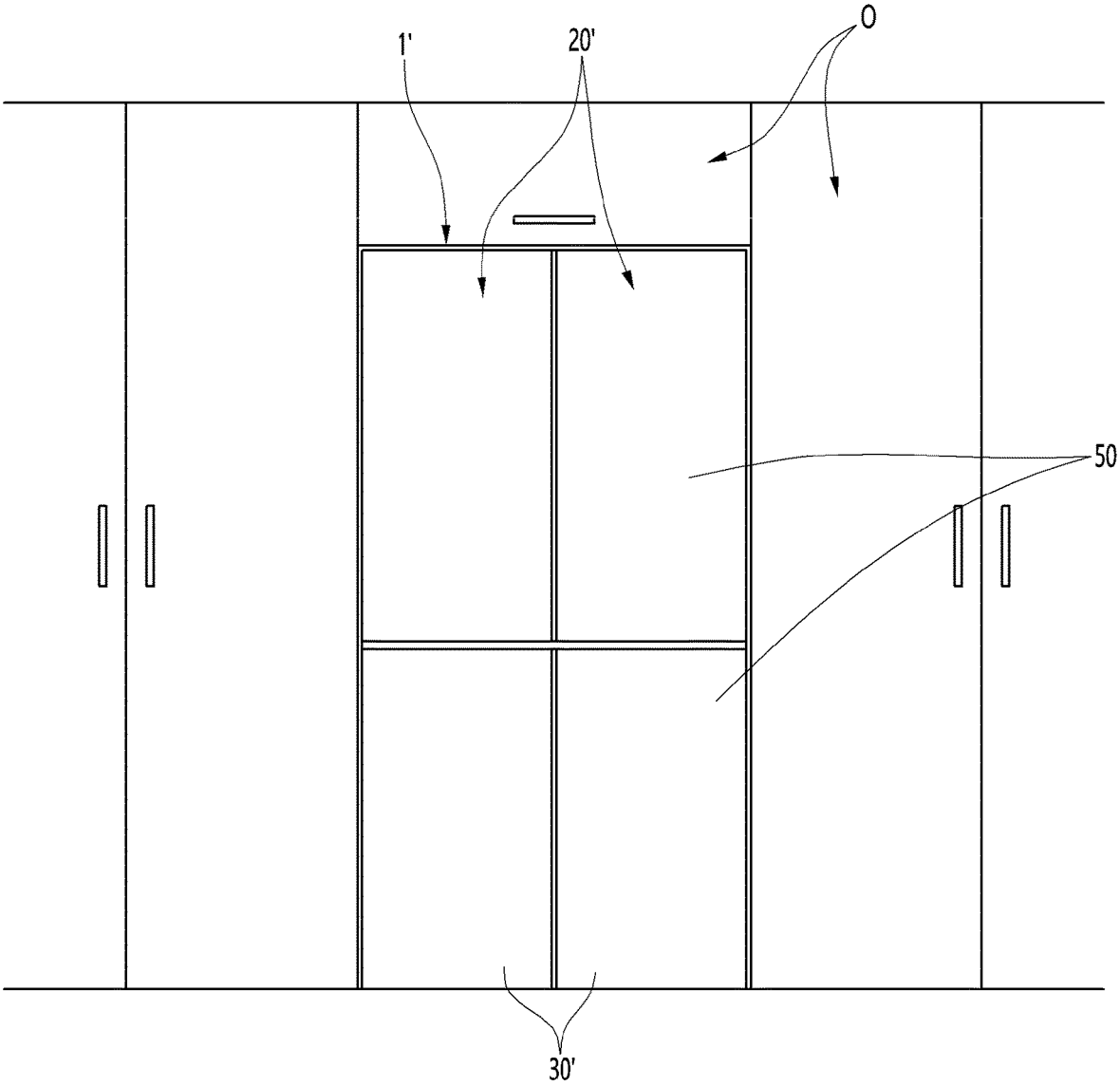
FIG. 1 is a perspective view illustrating a state in which a refrigerator is installed according to an embodiment.

FIG. 1 is a perspective view illustrating a state in which a refrigerator is installed according to an embodiment. Also, FIG. 2 is a perspective view illustrating a state in which refrigerators are continuously disposed.

Referring to the drawings, a refrigerator 1 according to an embodiment includes a cabinet 10 defining a storage space having an opened front surface and a door opening or closing the storage space. Here, an outer appearance of the refrigerator 1 may be defined by a cabinet 10 and doors 20 and 30.

Also, the refrigerator 1 may be mounted so as to harmonize with furniture or wall O of an indoor space. As illustrated in FIG. 1, each of the refrigerators 1 and 1' may be installed in the indoor space such as a kitchen and may be disposed adjacent to the furniture or the wall O to harmonize with each other. That is, a space corresponding to a size of each of the refrigerators 1 and 1' may be provided in the furniture or the wall O, and the refrigerator 1 may be accommodated or disposed in a built-in type. The one or more refrigerators 1 and 1' may provide a flushing or plane surface with the adjacent furniture or wall, so that there is no protruding element from a front surface formed by the one or more refrigerators 1 and 1' and/or furniture and/or wall.

Figure 2:
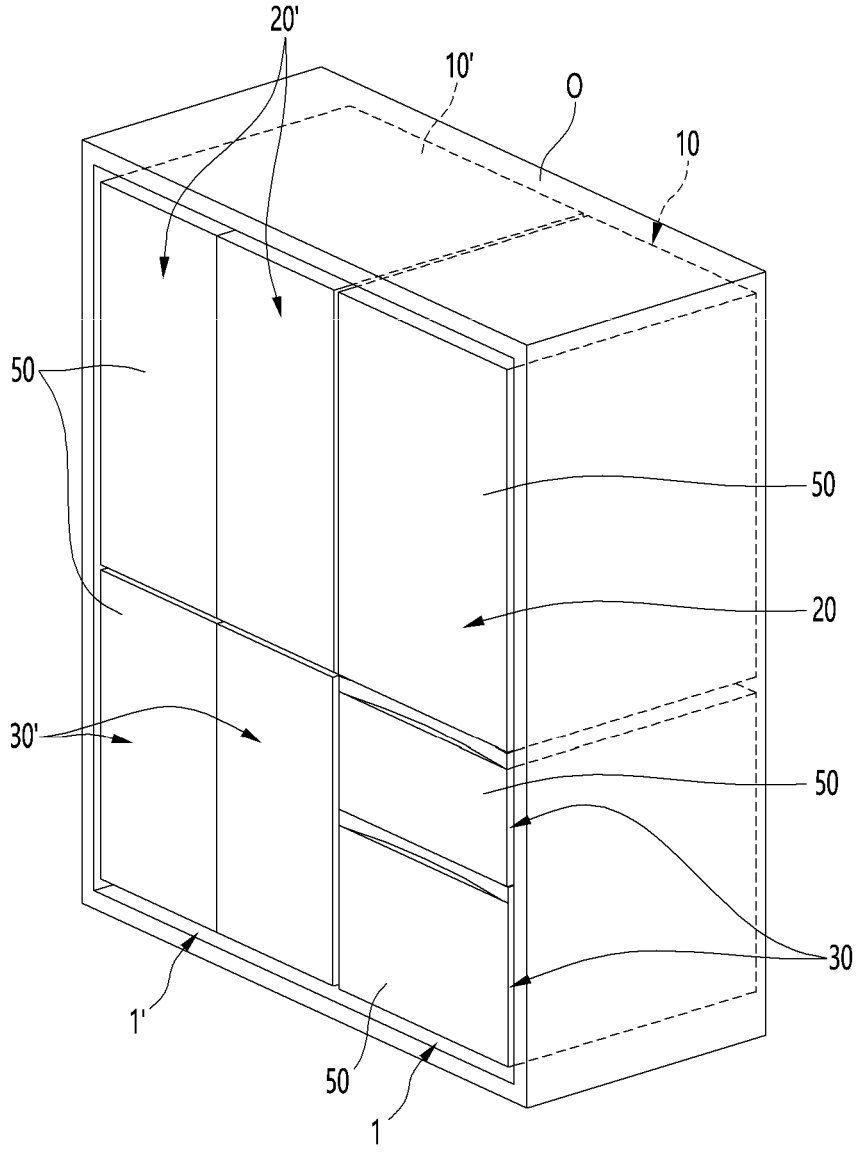
FIG. 2 is a perspective view illustrating a state in which refrigerators are continuously disposed.

Also, as illustrated in FIG. 2, the other refrigerator 1' may be continuously disposed in parallel at a side of the refrigerator 1. That is, a space in which the one or more refrigerators 1 and 1' may be disposed may be provided by the furniture and/or the wall O.

The plurality of refrigerators 1 and 1" may have the same structure, and as necessary, the refrigerators 1 and 1' having various structures may be disposed in combination. For example, as illustrated in FIG. 2, in the refrigerator 1 disposed on a right side, doors 20 may be disposed vertically. That is, the right refrigerator 1 may be configured so that the door 20 that is opened and closed in a rotating manner is provided at an upper side, and the door 30 that is opened and closed in a sliding manner is provided at a lower side. Also, the refrigerator 1' disposed side by side at a left side may be configured so that an upper storage space is opened and closed by a pair of doors 20, and a lower storage space is opened and closed by a pair of doors 30. Also, the doors 20 and 30 may be configured to be opened and closed in the rotating manner, and the doors 20 and 30 may be referred to as French-type doors.

A panel assembly 50 may be mounted on all of the doors 20, 30, 20', and 30' of the refrigerators 1 and 1'. The panel assembly 50 may define front surfaces of the one or more doors 20, 30, 20', and 30' and thus may define an outer appearance of each of the one or more refrigerators 1 and 1' when viewed from a front side.

The doors 20, 30, 20', and 30' of the refrigerators 1 and 1' may have only different sizes, and panel assemblies 50 having the same structure may be mounted. Thus, even if the plurality of refrigerators 1 are disposed, the same outer appearance, an outer appearance such as a color and texture may be provided. Of course, the panel assemblies 50 may have different colors or different textures, as necessary. The outer appearance may be same or correspond to the adjacent furniture.

Also, since each of the panel assemblies 50 is detachable or has a detachable structure, the panel assembly 50 having an appropriate outer appearance may be selected according to an environment in which the refrigerators 1 and 1' are mounted.

When the refrigerator 1 is mounted on the furniture or wall O, the outer appearance of the refrigerator 1 may be provided to have the same material or materials having the same texture as the furniture and/or wall O, and thus, the outer appearance of the refrigerator and the adjacent furniture or wall O may have a sense of unity. Of course, even if the outer appearance of the refrigerator 1 and the furniture or wall O do not have a sense of unity, the refrigerator 1 may be made of a material that is adapted to or capable of being harmonized with the furniture and/or wall O.

Also, the refrigerator 1 may be disposed adjacent to the adjacent refrigerator 1' and the furniture or wall O may be disposed close to the adjacent refrigerator 1 and the furniture or wall O in a range that does not interfere when the doors 20 and 30 may be opened and closed.

A structure and mounting structure of the panel assembly 50 according to an embodiment may be the same in both the left refrigerator 1' and the right refrigerator 1. Therefore, hereinafter, a structure of the right refrigerator 1 of the refrigerators 1 and 1' of FIG. 2 will be described in more detail.

Also, for convenience of explanation and understanding, the panel assembly 50 and a mounting structure of the panel assembly 50 will be described with reference to the upper door 20. Also, hereinafter, the upper door 20 may be referred to as a door 20. It may be applied also to the other doors.

Figure 3:
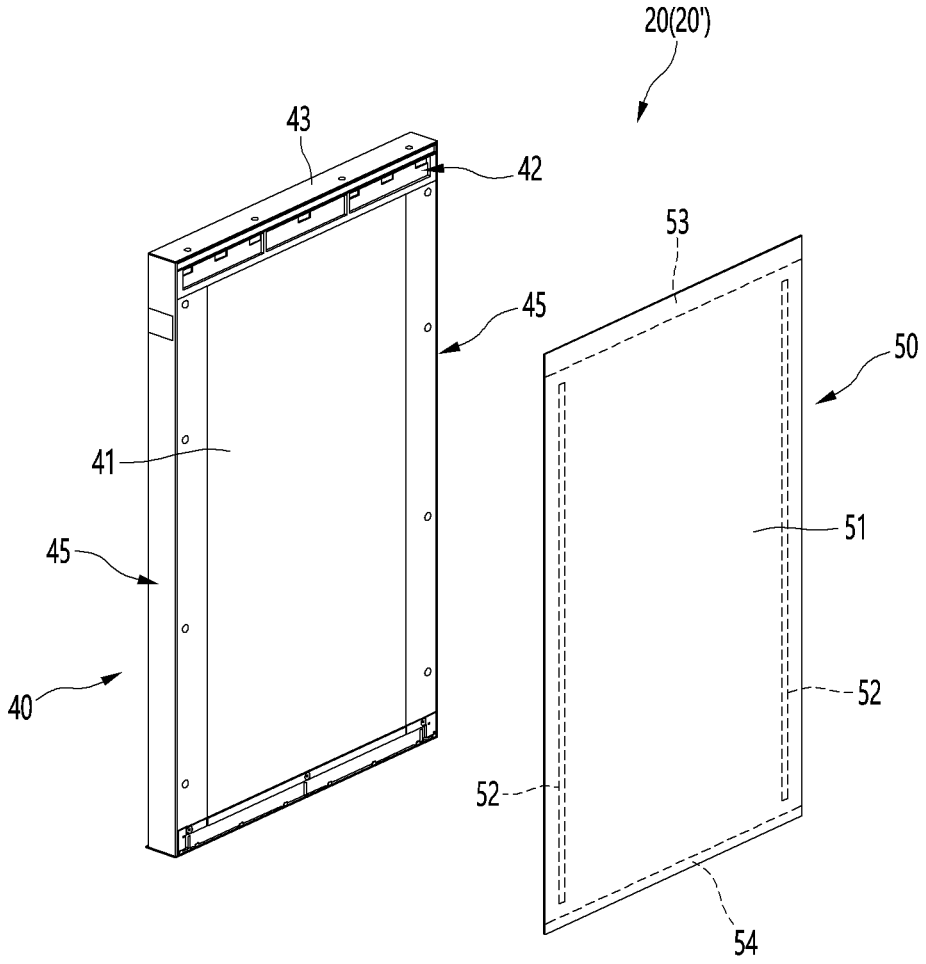
FIG. 3 is an exploded front perspective view of a door according to an embodiment.
Figure 4:
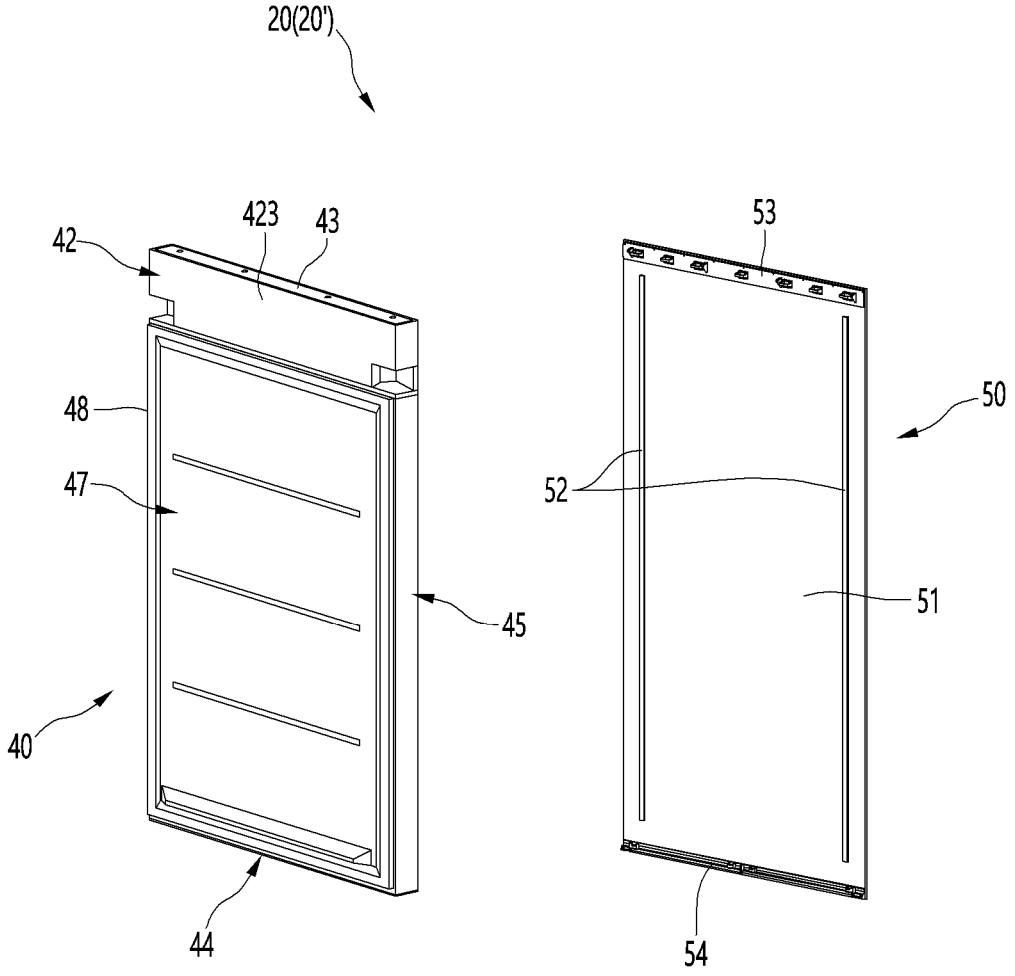
FIG. 4 is an exploded rear perspective view of the door.
Figure 5:
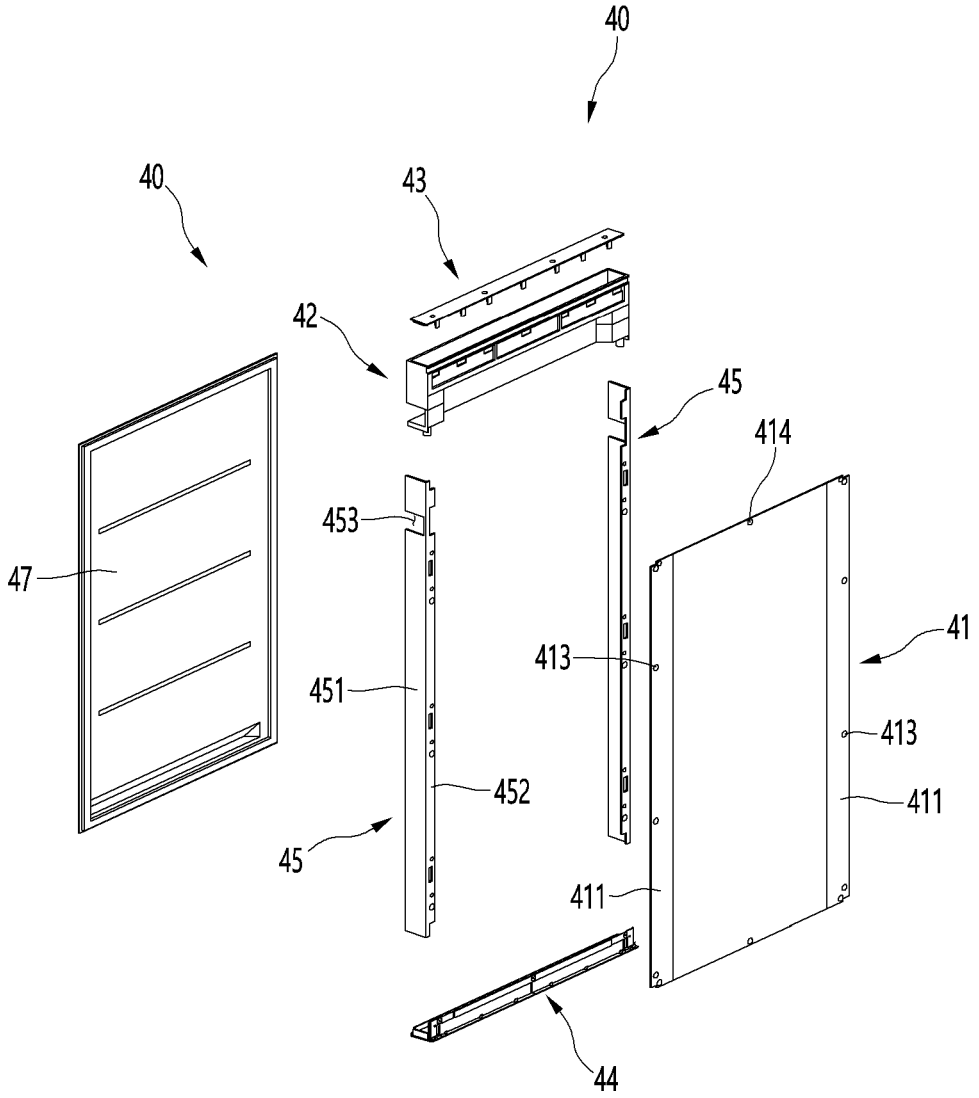
FIG. 5 is an exploded front perspective view illustrating a state in which a door body that is one component of the door is disassembled.

FIG. 3 is an exploded front perspective view of the door according to an embodiment. Also, FIG. 4 is an exploded rear perspective view of the door. Also, FIG. 5 is an exploded front perspective view illustrating a state in which a door body that is one component of the door is disassembled.

As illustrated in the drawings, the door 20 may be filled with an insulator 49 (see FIG. 13) and may include a door body 40 that substantially opens and closes the storage space and a panel assembly 50 mounted on the door body 40.

The door body 40 may have a predetermined thickness, and the insulator 49 may be filled therein to insulate the storage space. Also, the panel assembly 50 may be mounted on a front surface of the door body 40 to define outer appearances of the front surfaces of the door 20 and the refrigerator 1. The panel assembly 50 may be mounted to be easily detachable from the door body 40, and the panel assembly 50 may be easily detachable even when the door 20 is mounted on the cabinet 10.

Thus, the panel assembly 50 may be mounted in consideration of the outer appearance of the furniture or wall O, and the panel assembly 50 may be designed to be desired by the user and be mounted or replaced, as necessary.

Referring to the structure of the door body 40, the door body 40 may include a front plate 41, a side frame 45, a first cap decor 42, a second cap decor 44, and a door liner 47 as a whole. Also, the insulator 49 may be filled inside the door body 40.

In detail, the front plate 41 may define a front surface of the door body 40 and be provided in a plate shape. The front plate 41 may be made of a steel material the front plate 41 may define a surface facing a rear surface of the panel assembly 50.

Also, a plurality of screw holes 413 may be defined along a circumference of the front plate 41. Screws coupled to the first cap decor 42, the second cap decor 44, and/or one or both the side frames 45 may be coupled to the one or more screw holes 413.

Also, a plate-stepped portion 411 that is stepped rearward may be disposed on each of both side ends of the front plate 41. The plate-stepped portion 411 may define a space, in which the magnet 52 is capable of being disposed when the panel assembly 50 is mounted to the front plate 41. The one or more plate-stepped portion 411, may extend in a vertical and/or horizontal direction. The plate-stepped portion 411 may be provided in a groove shape corresponding to a shape of the magnet 52.

The first cap decor 42 and the second cap decor 44 may be respectively disposed at upper and lower ends of the front plate 41 to define top and bottom surfaces of the door body 40. Also, the side frames 45 may be coupled to both left and right side ends of the front plate 41, respectively, and upper and lower ends of each of the side frames 45 may be connected to the first cap decor 42 and the second cap decor 44, respectively.

The door liner 47 may be coupled to rear surfaces of the first cap decor 42, the second cap decor 44, and the side frame 45. The door liner 47 may be provided in a plate shape to define the rear surface of the door body 40. The door liner 47 may be made of a plastic material. It may be vacuum-molded to define a shape of the rear surface of the door body 40.

A gasket 48 may be disposed along the circumference of the rear surface of the door liner 47. The gasket 48 may be in contact with a circumference of the cabinet 10 while the door 20 is closed to seal the storage space.

The side frame 45 may connect the first cap decor 42 to the second cap decor 44 and simultaneously may connect the front plate 41 to the door liner 47. Also, the side frame 45 may define both side surfaces of the door body 40.

The side frame 45 may extend lengthily in the vertical direction and may be formed through extrusion of a metal material. For example, the side frame 45 may be made of an aluminum material. Thus, the side frame 45 may allow an outer appearance of a side surface of the door 20 to be more luxurious.

The side frames 45 at both left and right sides may have the same shape and may be disposed in a direction facing each other. The side frame 45 may include a frame side surface 451 and a frame front surface 452.

In detail, the frame side surface 451 may define a surface exposed to a side of the door body 40 and be provided in a flat shape. An upper end of the frame side surface 451 may be coupled to the first cap decor 42, and a lower end of the frame side surface 451 may be coupled to the second cap decor 44.

A frame opening 453 corresponding to a hinge mounting portion 427 disposed on the first cap decor 42 may be defined in an upper portion of the frame side surface 451. The frame opening 453 may be defined in a shape corresponding to an opened side surface of the hinge mounting portion 427, and thus, when the door 20 rotates, an inference with a hinge (not shown) connecting the cabinet 10 to the door 20 may be prevented.

The frame front surface 452 may extend inward from a front end of the frame side surface 451. The frame front surface 452 may support both left and right side ends of the front plate 41.

The first cap decor 42 may define a top surface of the door body 40 and may be coupled to the front plate 41, an upper end of the door liner 47, and an upper end of each of the pair of side frames 45. Also, a decor cover 43 may be mounted on an opened top surface of the first cap decor 42.

The second cap decor 44 may define a bottom surface of the door body 40 and may be coupled to the front plate 41, a lower end of the door liner 47, and a lower end of each of the pair of side frames 45.

The front plate 41, the door liner 47, the side frame 45, the first cap decor 42, and the second cap decor 44 may be coupled to each other so that the door body 40 defines a closed space therein to define a space in which the insulator 49 is filled.

Hereinafter, structures of the first cap decor 42 and the second cap decor 44 constituting the door body 40 will be described in more detail with reference to the drawings.

Figure 6:
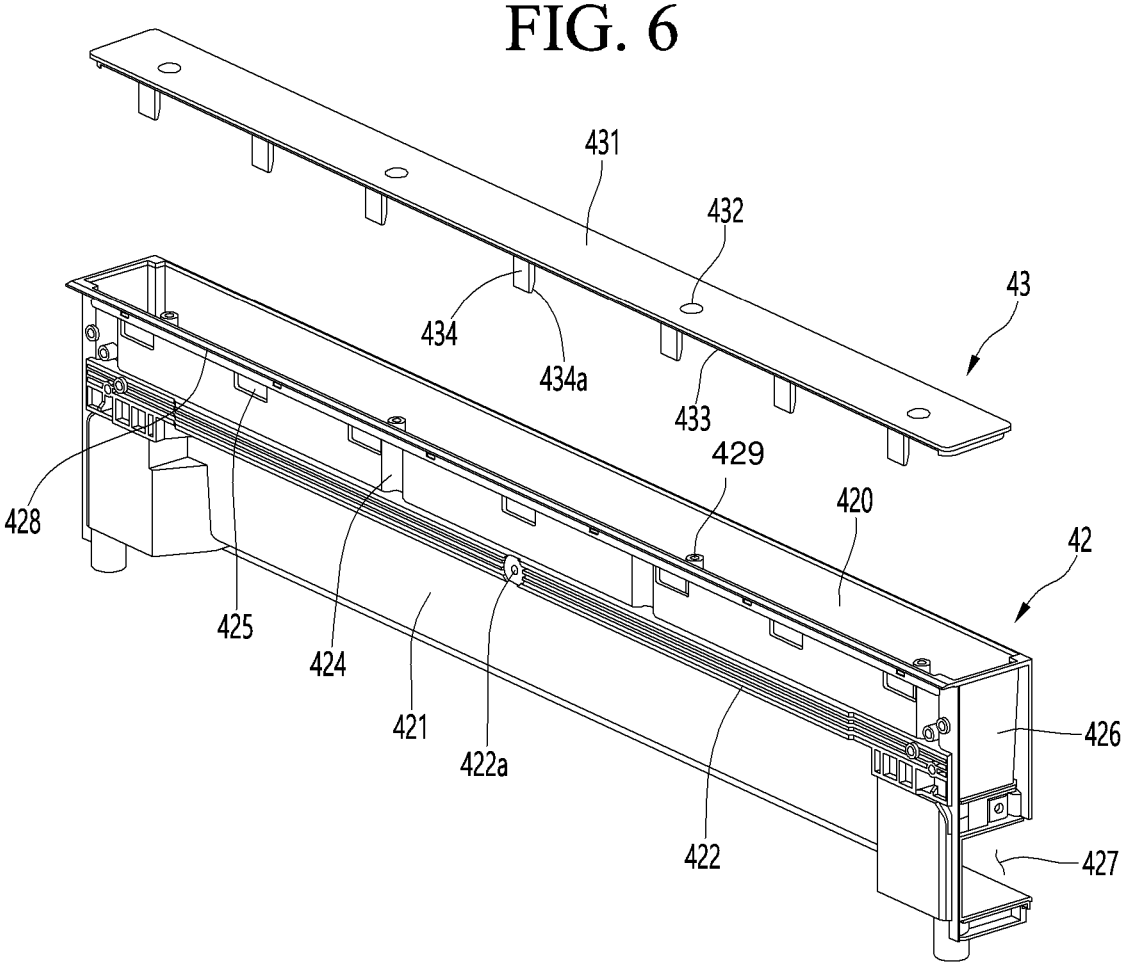
FIG. 6 is an exploded perspective view illustrating a state in which a first cap decor and a decor cover, each of which is one component of the door.
Figure 7:
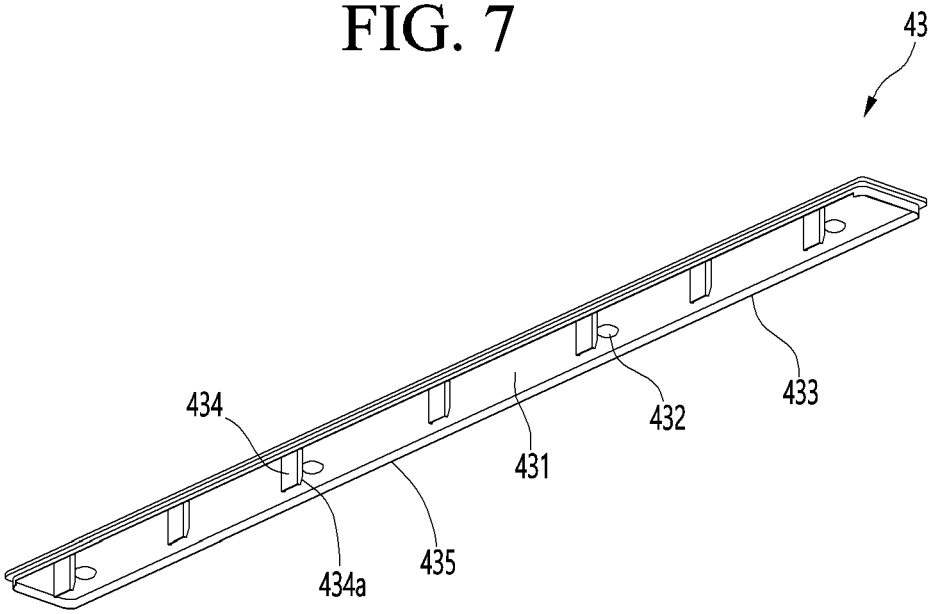
FIG. 7 is a perspective view of the decor cover.
Figure 8:
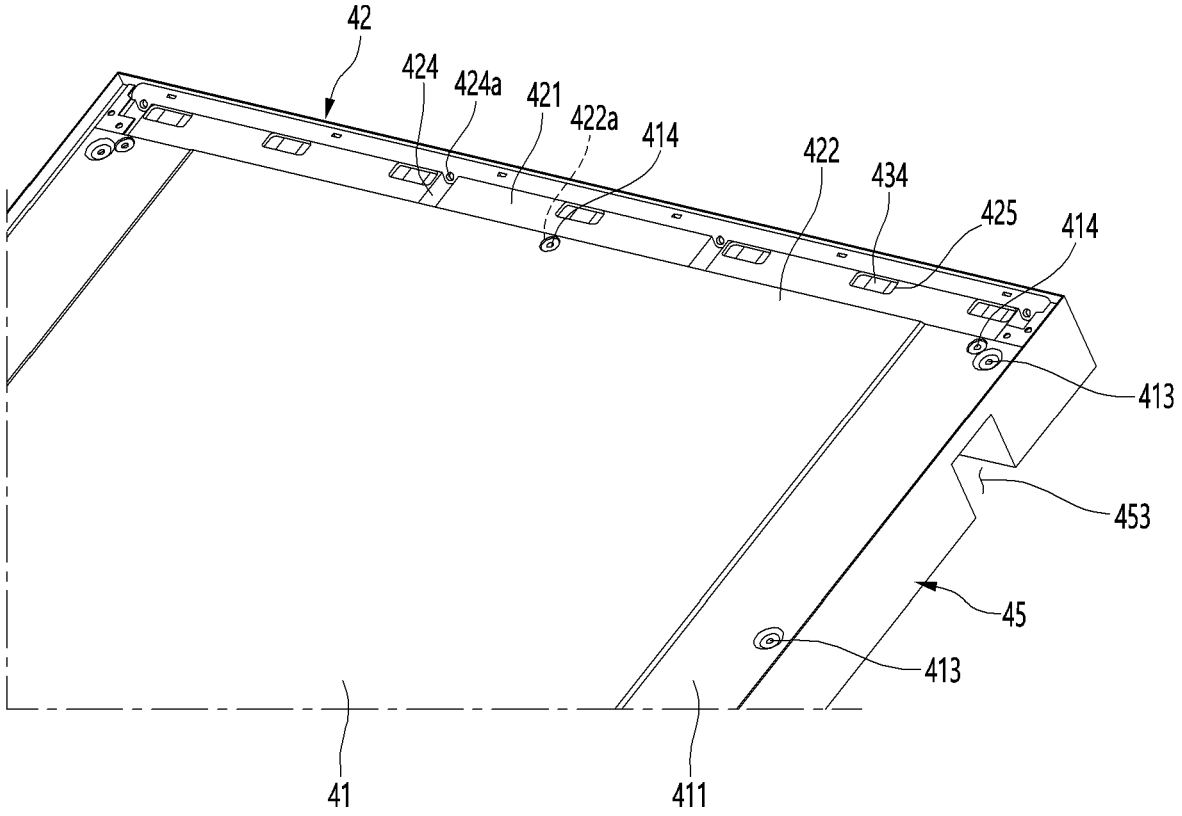
FIG. 8 is a partial perspective view illustrating a structure of an upper end of the door body.

FIG. 6 is an exploded perspective view illustrating a state in which the first cap decor and the decor cover, each of which is one component of the door. Also, FIG. 7 is a perspective view of the decor cover. Also, FIG. 8 is a partial perspective view illustrating a structure of an upper end of the door body.

As illustrated in the drawings, the first cap decor 42 may define an upper portion of the door 20 and also may define a top surface of the door 20, which is exposed to the outside in an assembled state. Also, the first cap decor 42 may be configured to support the front plate 41, the door liner 47, and the upper end of the side frame 45. Since the first cap decor 42 defines a top surface of the door 20, the first cap decor 42 may be referred to as an upper cap decor 42.

In detail, the first cap decor 42 may be made of a plastic material and may include a front surface 421, a rear surface 423, and both side surfaces 426. The front plate 41 may be coupled to the front surface 421, the door liner 47 may be coupled to the rear surface 423, and the side frame 45 may be coupled to each of both left and right side surfaces 426.

A decor recess 420 having an opened top surface may be defined in the first cap decor 42. An upper end of the panel assembly 50 may be restricted through the decor recess 420.

The decor recess 420 may be recessed from the upper end of the door 20 to a predetermined depth. A PCB for controlling components provided in the door 20 or other components of the refrigerator may be accommodated in the decor recess 420.

The decor recess 420 may extend up to a lower end of the first cap decor 42, and when being injection-molded, the rear surface 423 may be provided in a flat shape. The opened top surface of the decor recess 420 may be shielded by the decor cover 43. The decor recess 420 may be opened in most of an area of the top surface of the first cap decor 42. Thus, the decor cover 43 may define most of an outer appearance of the top surface of the door 20 in a state of being mounted to shield the decor recess 420.

A decor coupling portion 429 extending upward may be disposed inside the decor recess 420. The decor coupling portion 429 may support the decor cover 43 that shields the decor recess 420 at a lower side. Also, the decor coupling portion 429 may be configured so that a screw S passing through the screw hole 432 of the decor cover 43 is coupled.

The front surface 421 of the first cap decor 42 may be provided in a stepped shape by having a lower portion that is more recessed backward than an upper portion thereof. Also, an upper plate coupling portion 422 supporting the front plate 41 at a rear side may be disposed on the front surface 421 of the first cap decor 42. The upper plate coupling portion 422 may extend from a left end to a right end of the first cap decor 42, and also, a plurality of ribs and grooves may be continuously vertically disposed at regular intervals. Thus, even if the insulator 49 is permeated, a space between the front plate 41 and the upper plate coupling portion 422 may be filled so that the front plate 41 and the upper plate coupling portion 422 are more firmly fixed.

Also, an upper end of the front plate 41 may be coupled to the upper plate coupling portion 422 by a screw. For this, a screw coupling portion may be disposed on the upper plate coupling portion 422, and a screw hole 414 through which the screw passes may be defined along an upper end of the corresponding front plate 41. The upper end of the front plate 41 may be firmly fixed to the front surface of the first cap decor 42 by coupling the screw.

Also, a first support end 428 protruding forward may be disposed on an upper end of a front surface of the first cap decor 42. The first support end 428 may protrude forward and may support an upper end of the panel assembly 50. A protruding length of the first support end 428 may be less than a thickness of the panel assembly 50. Thus, in a state in which the panel assembly 50 is mounted, the first support end 428 may not protrude forward from the panel assembly 50. Thus, when viewed from a front side, the upper panel assembly 50 may be completely exposed, and the first support end 428 may be prevented from being excessively exposed.

An insertion hole 425 may be defined between the first support end 428 and the upper plate coupling portion 422. The insertion hole may be opened so that an insertion protrusion 534 of a first bracket 53 to be described in detail below is inserted, and a plurality of insertion holes may be defined along a front surface of the first cap decor 42.

The insertion hole 425 may be defined in a position facing the insertion protrusion 534 and may be opened so that the insertion protrusion 534 is inserted to protrude to the inside of the recess. In addition, the insertion hole 425 may be provided in number corresponding to the insertion protrusion 534 and may be spaced apart from one end to the other end of the first cap decor 42 at regular intervals in the horizontal direction.

The insertion hole 425 may communicate with the decor recess 420. Therefore, the insertion protrusion 534 inserted into the insertion hole 425 may protrude to the inside of the decor recess 420 and be restricted by the restriction protrusion 434 of the decor cover 43.

An upper coupling portion 424 may be further disposed on the front surface of the first cap decor 42. The upper coupling portion 424 may be configured to be coupled to the first bracket 53 and may be disposed between the first support end 428 and the upper plate coupling portion 422.

The upper coupling portion 424 may be recessed at a position corresponding to the upper coupling protrusion 533 protruding from the first bracket 53. For example, four upper coupling portions 424 may be disposed at a pair of positions spaced apart from each other at left and right sides with respect to a center of the first cap decor 42. That is, the upper coupling portion 424 may be disposed at each of both the side ends of the first cap decor 42 and may be further disposed at each of inner sides spaced apart from both the side ends.

The upper coupling portion 424 may be recessed from a front surface corresponding to the decor recess 420. Thus, the upper coupling protrusion 533 may be inserted into the upper coupling portion 424. Also, the upper coupling portion 424 may protrude to the inside of the decor recess 420, and a screw hole 424*a* through which a screw coupled through the decor recess 420 passes may be defined. Thus, the screw passing through the screw hole 424*a* may be coupled to the upper coupling portion 424, and the upper end of the panel assembly 50 may be firmly fixed to the first cap decor 42.

A hinge mounting portion 427 may be opened at a side surface of the first cap decor 42. The hinge mounting portion 427 may be opened to side and rear surfaces of the first cap decor 42, and a hinge may be mounted to allow the door 20 to rotate about a rotation axis of the hinge.

The decor cover 43 may shield the decor recess 420 and simultaneously be coupled to the first bracket 53 to restrict the upper end of the panel assembly 50.

The decor cover 43 as a whole may include a cover portion 431 that shields the decor recess 420 and a restriction protrusion 434 protruding downward from a bottom surface of the cover portion 431. The cover portion 431 may be provided in a plate shape and may have a size and shape corresponding to the opened top surface of the decor recess 420. Also, an edge portion 435 extending downward along a circumference of the cover portion 431 may be disposed to seal the decor recess 420 when the decor cover 43 is mounted.

Also, the restriction protrusion 434 may be disposed at a position corresponding to the insertion hole 425 and the insertion protrusion 534, and a plurality of the restriction protrusions 434 may be disposed at regular intervals and be coupled to the insertion protrusion 534 inserted by passing through the insertion hole 425.

The restriction protrusion 434 may be provided to further extend downward by passing a through-hole 534*a* of the insertion protrusion 534 when the decor cover 43 is mounted. Also, the restriction protrusion 434 may have a width and thickness, which correspond to pass through the through-hole 534*a*.

Also, an inclined surface 434*a* may be disposed on a lower end of a front surface of the restriction protrusion 434. Thus, when the restriction protrusion 434 is inserted into the through-hole 534*a*, the inclined surface 434*a* may be in contact with the inside of the through-hole 534*a* so that the restriction protrusion is more smoothly inserted into the through-hole 534*a* by the inclined surface 434*a* and is more firmly hooked to be restricted by the insertion protrusion 534 to allow the panel assembly 50 to be firmly mounted.

Also, a plurality of screw holes 432 may be defined along the decor cover 43. Also, a decor coupling portion 429 extending upward may be disposed inside the decor recess 420 corresponding to the screw hole 432. The decor coupling portion 429 may be disposed at a position corresponding to the screw hole 432 and may extend to support the decor cover 43 at the lower side when the decor cover 43 is mounted. Also, the screw passing through the screw hole 432 may be coupled to a top surface of the decor coupling portion 429 so that the decor cover 43 is fixed.

The decor cover 43 may be maintained in a state of being firmly fixed to the top surface of the first cap decor 42 by the coupling of the screw. Here, the restriction protrusion 434 of the decor cover 43 may also be maintained in the state of being restricted by the insertion protrusion 534 so that the panel assembly 50 is maintained in the state of being firmly mounted and is prevented from being arbitrarily separated.

Figure 9:
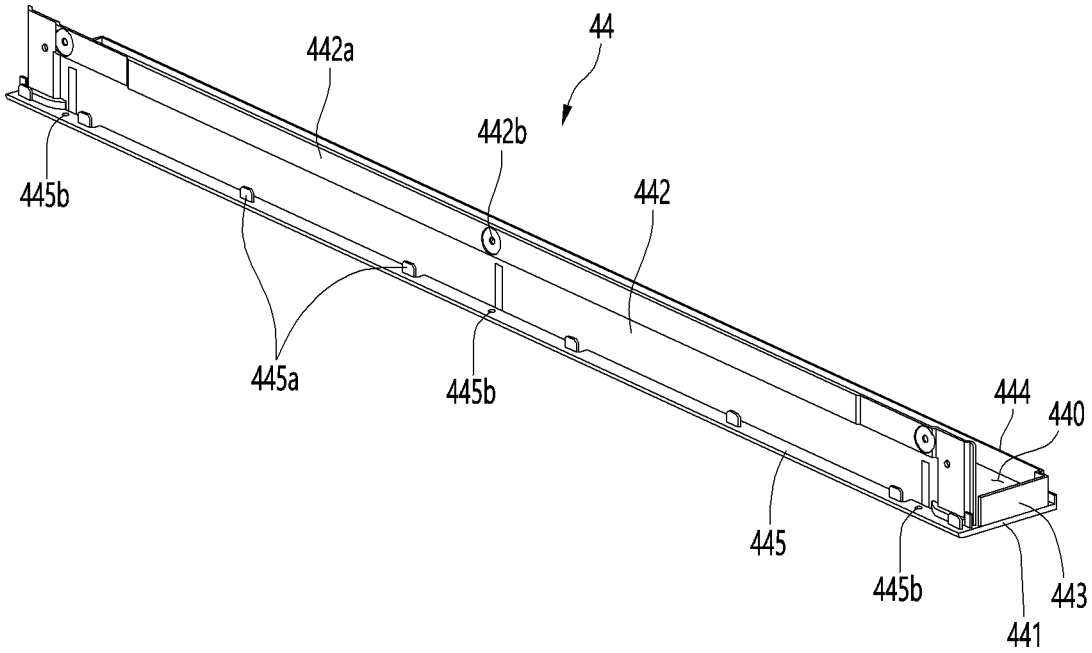
FIG. 9 is a perspective view of a second cap decor that is one component of the door.

FIG. 9 is a perspective view of the second cap decor that is one component of the door.

As illustrated in the drawings, the second cap decor 44 may be made of a plastic material may define a lower portion of the door body 40 and also define a bottom surface of the door body 40. Also, since the second cap decor 44 defines an outer appearance of a bottom surface of the door 20, the second cap decor 42 may be referred to as a lower cap decor 42.

The second cap decor 44 may generally include a bottom surface 441, a front surface 442, a rear surface 444, and both side surfaces 443. Also, the second cap decor 44 may define a space 440 with an opened top surface, and the insulator 49 may be filled inside the space.

The front surface 442 may support the lower end of the front plate 41 at the rear side. Also, both the side surfaces 443 may support the lower end of the side frame 45 at the inside. Also, the rear surface 444 may support the lower end of the door liner 47 at a front side.

As described above, a closed space 440 may be defined by the front plate 41, the side frame 45, and the door liner 47, which are coupled to the front surface 442, both the side surfaces 443, and the rear surface 444 of the second cap decor 44, and the insulator 49 may be filled in the space 440.

A lower plate coupling portion 442*a* supporting the front plate 41 at the rear side may be disposed on the front surface of the lower cap decor 44. The lower plate coupling portion 442*a* may extend from a left end to a right end of the front surface and may protrude slightly forward to support the front plate 41 at the rear side. Also, a screw hole 442*b* into which a plurality of screws passing through the front plate 41 are coupled may be defined.

A second support end 445 extending forward may be disposed on a lower end of the front surface 442 of the second cap decor 44. The second support end 445 may extend so that the bottom surface 441 of the second cap decor 44 passes through a lower end of the front surface 442 of the second cap decor 44.

The second support end 445 may protrude to support the lower end of the panel assembly 50, and a protruding length of the second support end 445 may be less than the thickness of the panel assembly 50. Thus, exposure of the second support end 445 when viewed from the front side may be minimized so that the entire front surface of the door 20 is defined by the panel assembly 50.

A restriction portion 445*a* protruding upward may be disposed at a lower end of the second support end 445. The restriction portion 445*a* may be inserted into a second bracket 54 to be described below to restrict the lower end of the panel assembly 50.

A plurality of restriction portions 445*a* may be disposed at regular intervals along the second support end 445. Also, each of the restriction portion 445*a* may be spaced apart from the front surface of the second cap decor 44.

Also, a plurality of lower coupling holes 445*b* may be defined in the second support end 445. The lower coupling hole 445*b* may pass through the second support end 445 from the lower side so that the screw is coupled to the second bracket 54. Thus, the lower end of the panel assembly 50 seated on the second support end 445 may be fixed more firmly.

A handle (see reference numeral 446 in FIG. 14) may be further disposed on the bottom surface of the second cap decor 44 to allow the user to pull the door 20 and open the door 20 by inserting a hand.

Hereinafter, the panel assembly 50 will be described in more detail with reference to the drawings.

Figure 10:
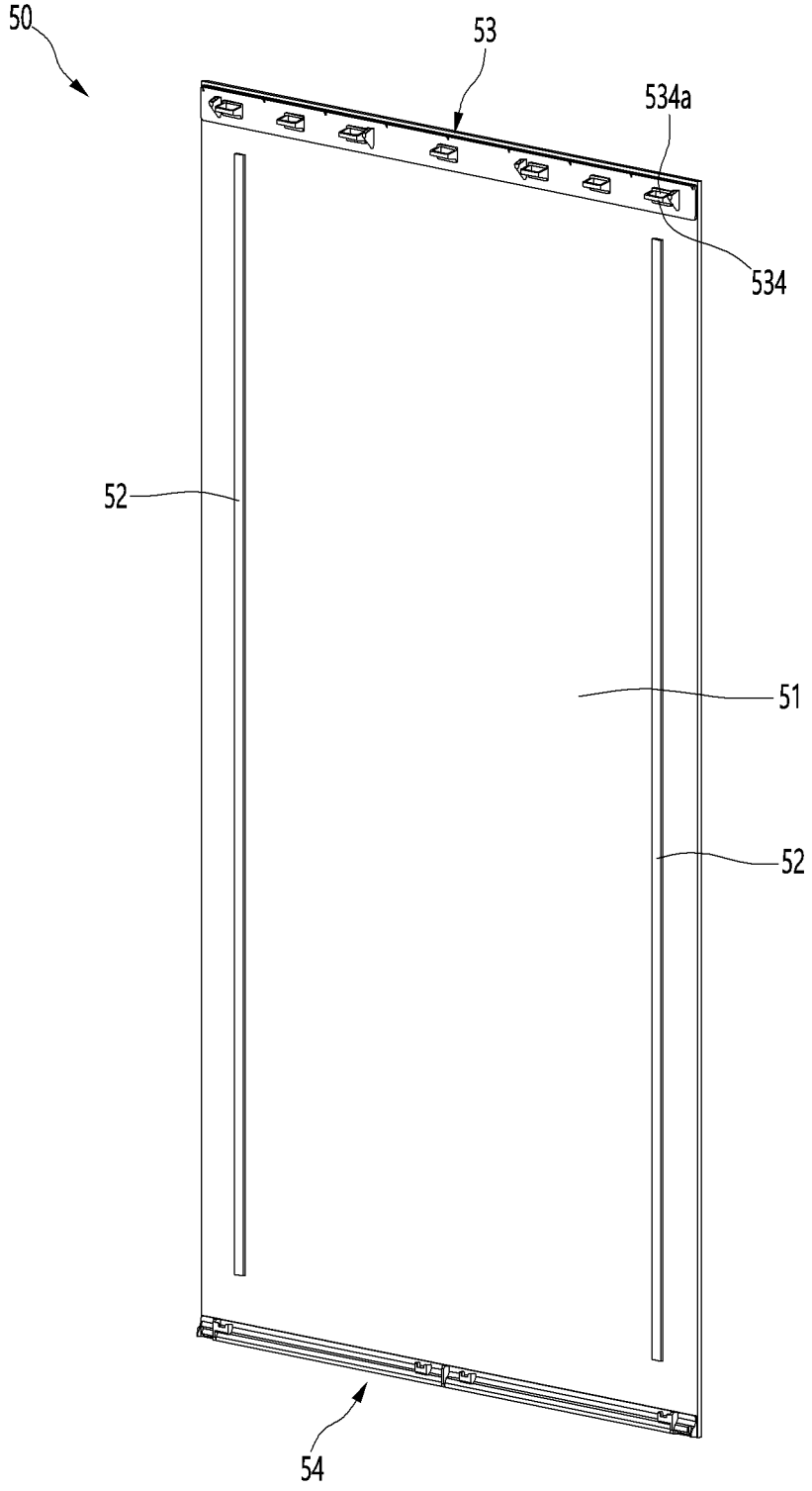
FIG. 10 is a perspective view of a panel assembly that is one component of the door.

FIG. 10 is a perspective view of the panel assembly that is one component of the door.

As illustrated in the drawing, the panel assembly 50 may have a size corresponding to that of a front surface of the door body 40 and be configured to define an outer appearance of an entire front surface of the door 20 in a state of being mounted on the door body 40.

The panel assembly 50 may include a plate-shaped panel 51 defining an outer appearance and first and second brackets 53 and 54 for fixing upper and lower ends of the panel 51. Also, the panel assembly 50 may further include a magnet 52 to be attached to a rear surface of the panel 51 and a front plate 41 of the door body 40.

In detail, the panel 51 may be made of a rectangular plate-shaped material having a predetermined thickness and may be made of a material that is capable of being harmonized with the furniture or wall O or the home appliance disposed therearound. For example, the panel 51 may be made of a glass material. For example, the panel 51 may be made of a tempered glass material, and the outer appearance of the door 20 may be defined by printing or attaching a film so as to have a color or pattern.

The panel 51 may have a size so that, in the state in which the panel 51 is mounted on the door body 40, upper end lower ends of the panel 51 are supported by a first support end 428 and a second support end 445, respectively, and both side ends of the panel 51 may be supported by the side frame 45.

Also, a first bracket 53 and a second bracket 54 may be provided at upper and lower ends of the rear surface of the panel 51, respectively. The first bracket 53 and the second bracket 54 may be configured so that the upper and lower ends of the panel assembly 50 are fixedly mounted to the door body 40.

The first bracket 53 and the second bracket 54 may extend along the upper and lower ends of the panel 51 and may have a length corresponding to a left and right width of the panel 51. Also, when the panel assembly 50 is mounted, the first bracket 53 and the second bracket 54 may be coupled to the first cap decor 42 and the second cap decor 44, respectively.

Also, a magnet 52 may be provided at each of both left and right ends of the panel 51. The magnet 52 may be attached to the rear surface of the panel 51 by an adhesive or magnetic force. The magnet 52 may extend from an upper end to a lower end of the panel 51. Also, when the panel assembly 50 is mounted on the door body 40 in a state in which the magnet is attached to the panel 51, the magnet 52 may be attached to the front plate 41 by the magnetic force. That is, the mounting of the panel assembly 50 may be assisted by the magnet 52.

Hereinafter, a structure of the first bracket 53 will be described in detail with reference to the accompanying drawings.

Figure 11:
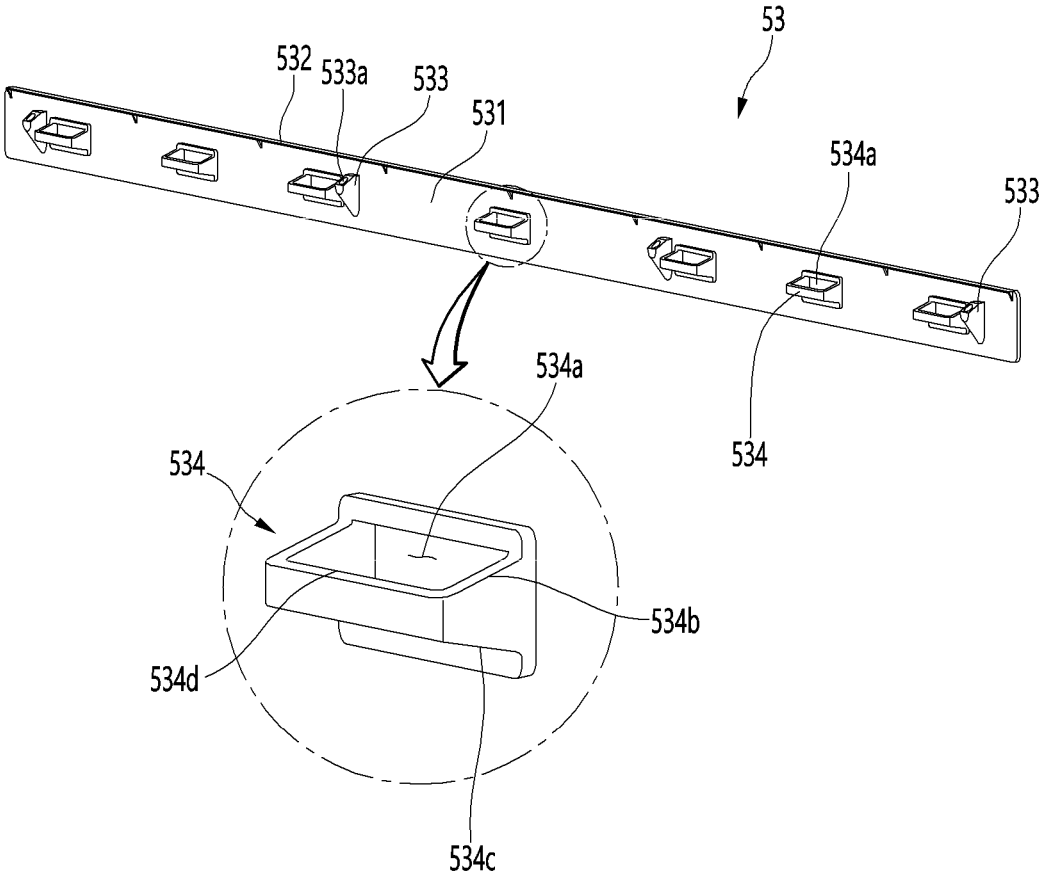
FIG. 11 is a perspective view of a first bracket that is one component of the panel assembly.
Figure 12:
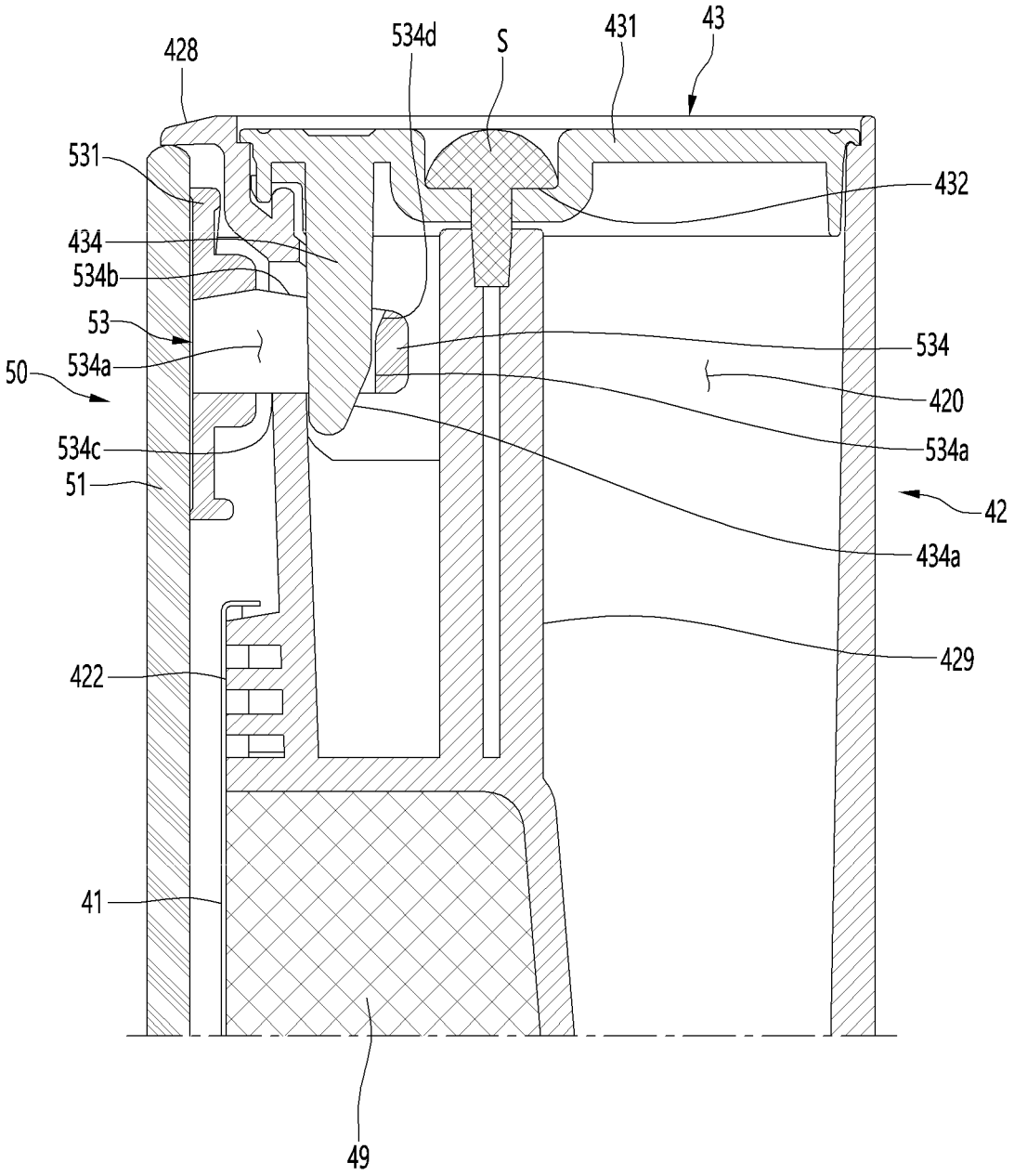
FIG. 12 is a cross-sectional view illustrating a coupling structure of an upper end of the door.

FIG. 11 is a perspective view of the first bracket that is one component of the panel assembly. Also, FIG. 12 is a cross-sectional view illustrating a coupling structure of the upper end of the door.

As illustrated in the drawings, the first bracket 53 may be mounted on the upper end of the panel 51 and may have a length corresponding to a horizontal width of the panel 51. Since the first bracket 53 is disposed on the upper end of the panel 51, the first bracket may be referred to as an upper bracket. In addition, the first bracket 53 may be injection-molded by using a plastic material and may include an upper adhesion portion 531 having a planar shape, an upper rib 532 at an upper end of the upper adhesion portion 531, and an insertion protrusion 534 inserted into the insertion hole. Also, the first bracket 53 may include an upper coupling protrusion 533 provided on the upper adhesion portion 531.

In detail, a front surface of the upper adhesion portion 531 may be provided in a planar shape and may adhere to the upper end of the rear surface of the panel 51. Here, an adhesive may be applied to the front surface of the upper adhesion portion 531, and the first bracket 53 may be firmly fixed to the panel 51 by the adhesive.

The first bracket 53 may have a predetermined vertical width, the upper rib 532 may be disposed on the upper end of the upper adhesion portion 531, and the first bracket 53 may have a width so that the insertion protrusion 534 and the upper coupling protrusion 533 are disposed below the upper rib 532. Also, the upper end of the first bracket 53 may be disposed at a position adjacent to the upper end of the panel 51 and may be disposed at a slightly spaced position so as not to interfere with the first support end 428.

The upper rib 532 may be disposed along an upper end of the first bracket 53. Also, the upper rib 532 may protrude backward and be in contact with the front surface of the first cap decor 42. Thus, the upper end of the panel assembly 50 may be supported by the first cap decor 42. Also, when the upper rib 532 is in contact with the front surface of the first cap decor 42, the insertion protrusion may be in a state in which the insertion protrusion is maximally inserted into the insertion hole.

Also, in a state in which the upper rib 532 is in contact with the front surface of the first cap decor 42, the upper coupling protrusion 533 may be inserted into the upper coupling portion 424 and thus aligned to facilitate the coupling of the screw. For this, a screw hole 533*a* into which the screw is coupled may be defined in a top surface of the upper coupling protrusion 533.

A plurality of insertion protrusions 534 may be disposed on the upper adhesion portion 531. The plurality of insertion protrusions 534 may be disposed along the upper adhesion portion 531 at regular intervals. Also, the plurality of insertion protrusions 534 may be disposed at positions corresponding to the insertion hole 425 and the restriction protrusion 434.

The insertion protrusion 534 may protrude vertically backward from a rear surface of the upper adhesion portion 531, and in a state in which the panel assembly 50 is mounted, a rear end of the insertion protrusion 534 may extend to be disposed behind the restriction protrusion 434.

Also, the insertion protrusion 534 may be provided in a protrusion shape having a predetermined width and thickness, and a through-hole 534*a* into which the restriction protrusion 434 is inserted may be defined in a center of the insertion protrusion 534. The through-hole 534*a* may be defined in a rectangular shape and may have a size corresponding to a cross-section of the restriction protrusion 434. Thus, in a state in which the restriction protrusion 434 is inserted into the through-hole 534*a*, the panel assembly 50 may be firmly fixed without moving.

An inclined portion 534*d* may be defined at an upper end of a rear surface of an inner side of the through-hole 534*a*. The inclined portion 534*d* may be inclined backward as it goes upward. Thus, when the restriction protrusion 434 is initially inserted, the restriction protrusion 434 may be easily guided into the through-hole 534*a*. Particularly, the inclined surface 434*a* and the inclined portion 534*d*, which are disposed at the lower end of the restriction protrusion 434, may have inclinations corresponding to each other, respectively. Thus, when the restriction protrusion 434 is inserted, the restriction protrusion 434 may be in contact with each other so that the restriction protrusion 434 is more easily inserted into the through-hole 534*a*, and while the restriction protrusion 434 is inserted, the panel assembly 50 may be pulled backward so that the panel assembly 50 is in close contact with the front surface of the door body.

A bottom surface 534*c* of the insertion protrusion 534 may extend perpendicular to the upper adhesion portion 531 and the panel 51, and a top surface 534*b* of the insertion protrusion 534 may be inclined. That is, the insertion protrusion 534 may have a vertical width that gradually decreases backward and also gradually decreases as the top surface 534*b* of the insertion protrusion 534 extends backward.

Thus, when the panel assembly 50 rotates by using the second bracket 54 as an axis so as to be mounted on or separated from the door body 40, the insertion protrusion 534 having a relatively large rotation radius may be easily inserted into the insertion hole 425. That is, when the insertion protrusion 534 is initially inserted into the insertion hole 425, the insertion protrusion 534 may be prevented from colliding with an outer end of the insertion hole 425. Also, the bottom surface 534*c* of the insertion protrusion 534 may be supported in contact with a lower end of the insertion hole 425.

The first bracket 53 may be disposed at an upper end of the panel 51, and a height from the upper end of the panel 51 to the first bracket 53 may be greater than a height from the upper end of the panel 51 to the gasket 48.

Thus, the first bracket 53 may be disposed substantially outside the gasket 48, and thus, the thermal insulation performance of the storage space may not be affected. That is, even if the corresponding front surface of the first cap decor 42 is inclined and recessed to provide a structure having a relatively thin thickness due to the mounting of the first bracket 53, the corresponding position may not be affected by cold air within the refrigerator, and thus, dew condensation may not be generated, and also, the thermal insulation performance of the door 20 may not be deteriorated. That is, the first bracket 53 may be disposed outside the gasket 48 and also be disposed outside a thermal insulation region.

Hereinafter, the structure of the second bracket 54 will now be described in more detail with reference to the accompanying drawings.

Figure 13:
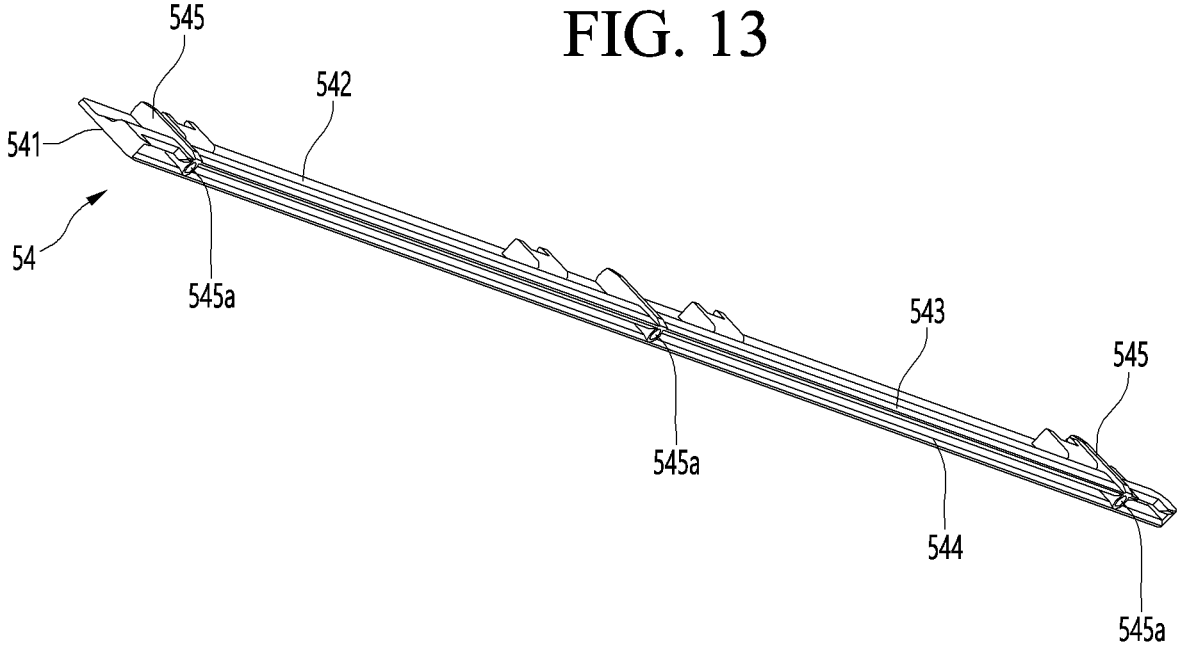
FIG. 13 is a perspective view of a second bracket that is one component of the panel assembly.
Figure 14:
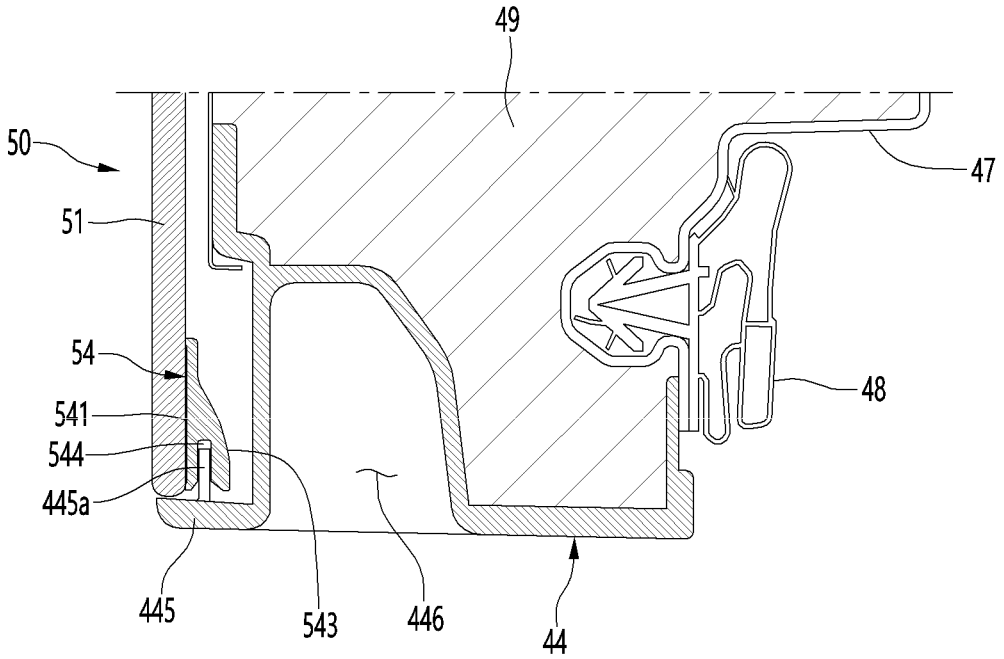
FIG. 14 is a cross-sectional view illustrating a coupling structure of a lower end of the door.

FIG. 13 is a perspective view of the second bracket that is one component of the panel assembly. Also, FIG. 14 is a cross-sectional view illustrating a coupling structure of the lower end of the door.

As illustrated in the drawings, the second bracket 54 may be injection-molded by using a plastic material and may be provided on the lower end of the panel 51. Since the second bracket 54 is provided at the lower end of the panel 51, the second bracket may be referred to as a lower bracket.

Also, the second bracket 54 may extend to a length corresponding to the horizontal width of the panel 51. Also, the second bracket 54 may to have a vertical width at which at least a lower coupling boss 545 is disposed.

The second bracket 54 may be hooked to be restricted by the second cap decor 44. Also, the second bracket 54 may allow the screw passing through the second cap decor 44 to be coupled to the screw hole 545*a* of the lower coupling boss 545, and thus, the lower end of the panel assembly 50 may be more firmly fixed to the door body 40.

In detail, the second bracket 54 may be provided with a lower adhesion portion 541 mounted on the rear surface of the panel 51. The lower adhesion portion 541 may be provided in a flat shape and may be attached to the rear surface of the panel 51 by an adhesive. The second bracket 54 may be disposed at a position corresponding to the lower end of the panel 51 in a state in which the lower adhesion portion 541 is attached to the rear surface of the panel 51.

Also, a lower protrusion 543 protruding backward from the lower adhesion portion 541 may be disposed backward from the lower adhesion portion 541. The lower protrusion 543 may extend from one side of the lower adhesion portion 541 to a position corresponding to the lower end of the lower adhesion portion 541.

A lower insertion portion 544 having an opened bottom surface may be disposed on a bottom surface of the lower protrusion 543. That is, the lower insertion portion 544 may be provided in a shape that is recessed upward from the bottom surface of the second bracket 54 so that the restriction portion 445*a* of the second cap decor 44 is inserted. The lower insertion portion 544 may be disposed over the entire bottom surface of the second bracket 54.

Thus, when the panel assembly 50 is mounted at a fixed position of the door body 40, the restriction portion 445*a* may be inserted into the lower insertion portion 544, and the lower end of the panel assembly 50 may be fixed. The state in which the restriction portion 445*a* is inserted into the lower insertion portion 544 may be referred to as a temporarily fixed state because of a re-detachable state when the panel assembly 50 is lifted before the screw is coupled.

Of course, the lower end of the panel assembly 50 may be maintained in a state of being seated on the second support end 445 by a weight of the panel assembly 50. That is, the restriction portion 445*a* may be maintained in the state of being inserted into the lower insertion hole 425, and when the insertion protrusion 534 is restricted by the restriction protrusion 434, the panel assembly 50 may not move, and thus, the panel assembly 50 may be maintained in the firmly mounted state without coupling the screw.

The second bracket 54 may be disposed at the lower end of the panel 51, and a height from the lower end of the panel 51 to the second bracket 54 may be less than a height of the gasket. Here, the height of the gasket 48 may be a height from the lower end of the panel 51 to a center of the gasket mounting portion 481.

Thus, the second bracket 54 may be disposed substantially outside the gasket 48, and thus, the thermal insulation performance of the storage space may not be affected. That is, even if the corresponding front surface of the second cap decor 44 is recessed to provide a structure having a relatively thin thickness due to the mounting of the second bracket 54, the corresponding position may not be affected by cold air within the refrigerator, and thus, dew condensation may not be generated, and also, the thermal insulation performance of the door 20 may not be deteriorated. That is, the second bracket 54 may also be disposed outside the thermal insulation region outside the gasket 48 to prevent the thermal insulation performance of the door 20 from being deteriorated.

Hereinafter, a process in which the panel assembly 50 is mounted on the door 20 of the refrigerator 1 having the above structure will be described in more detail with reference to the drawings.

Figure 15:
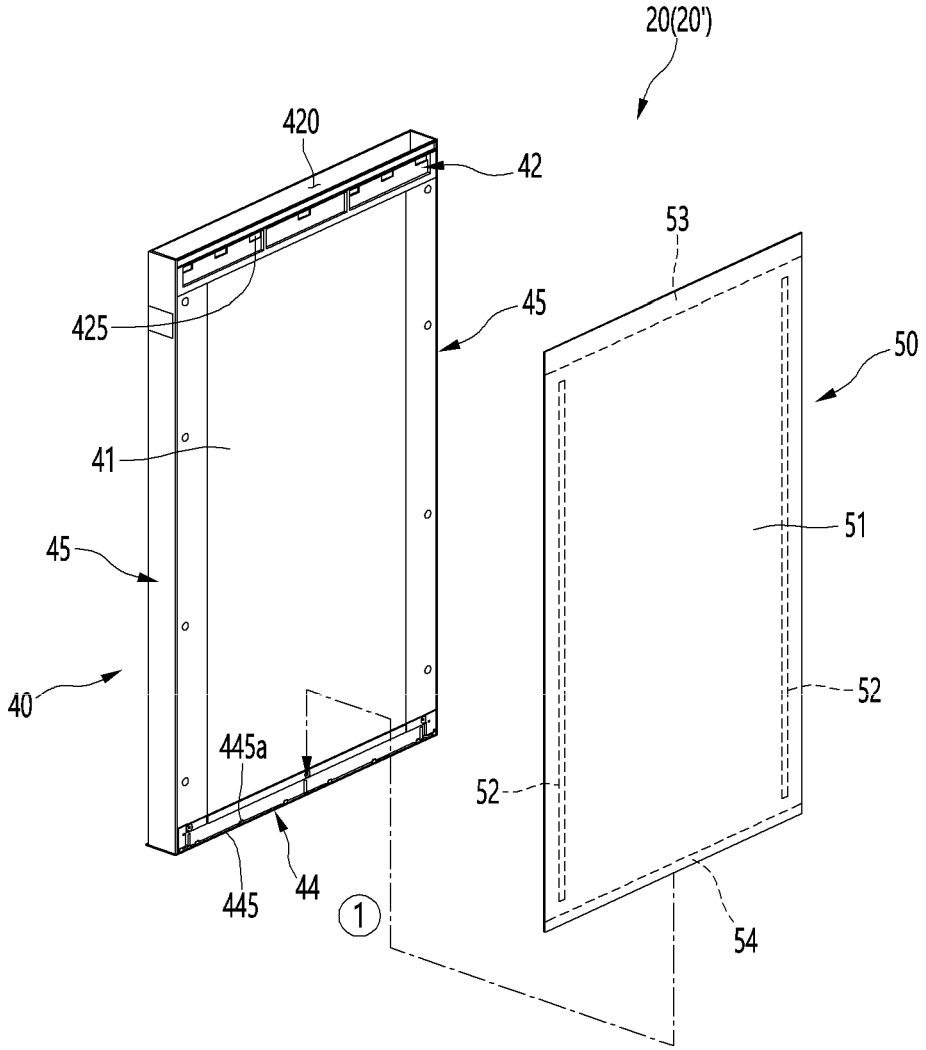
FIG. 15 is a view illustrating a state before the panel assembly is mounted on the door body.
Figure 16:
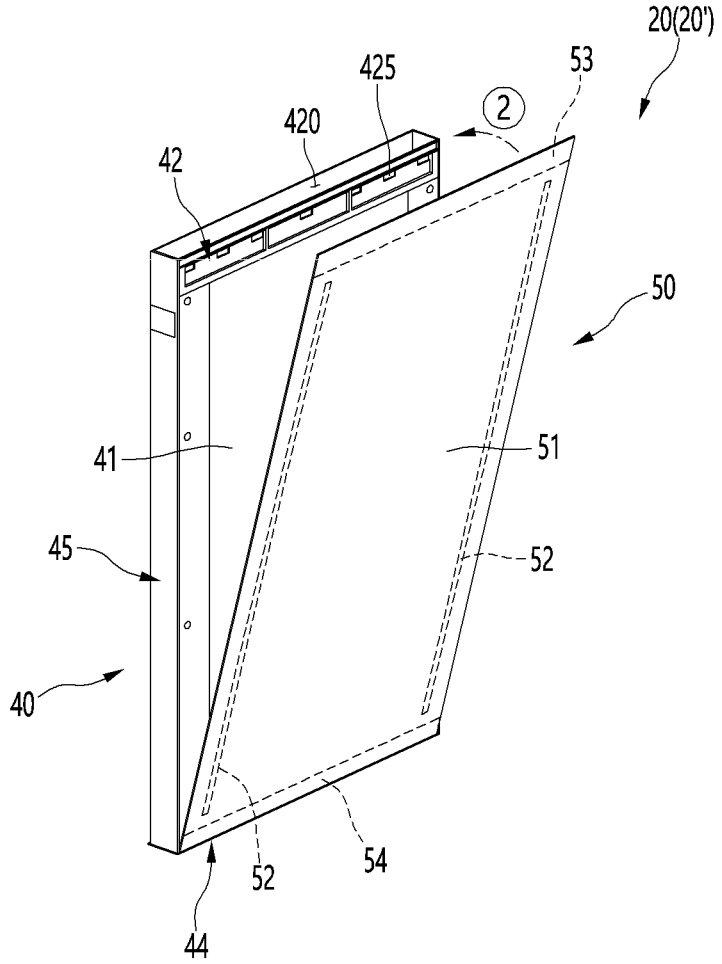
FIG. 16 is a view illustrating a process of restricting a lower end of the panel assembly.
Figure 17:
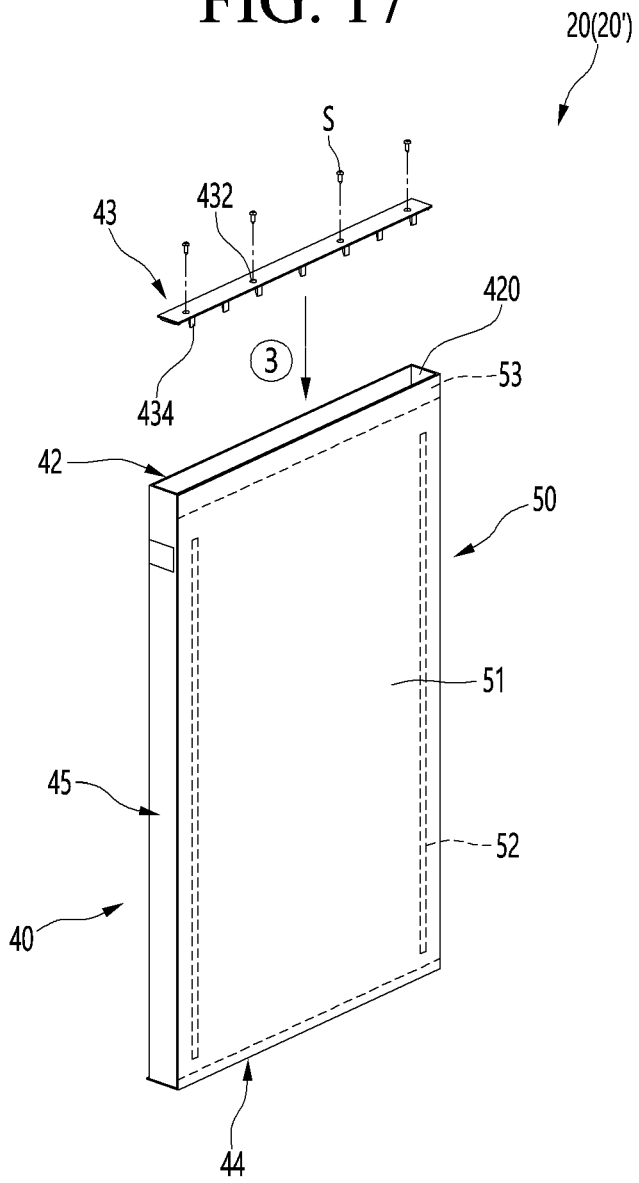
FIG. 17 is a view illustrating a process of restricting an upper end of the panel assembly.
Figure 18:
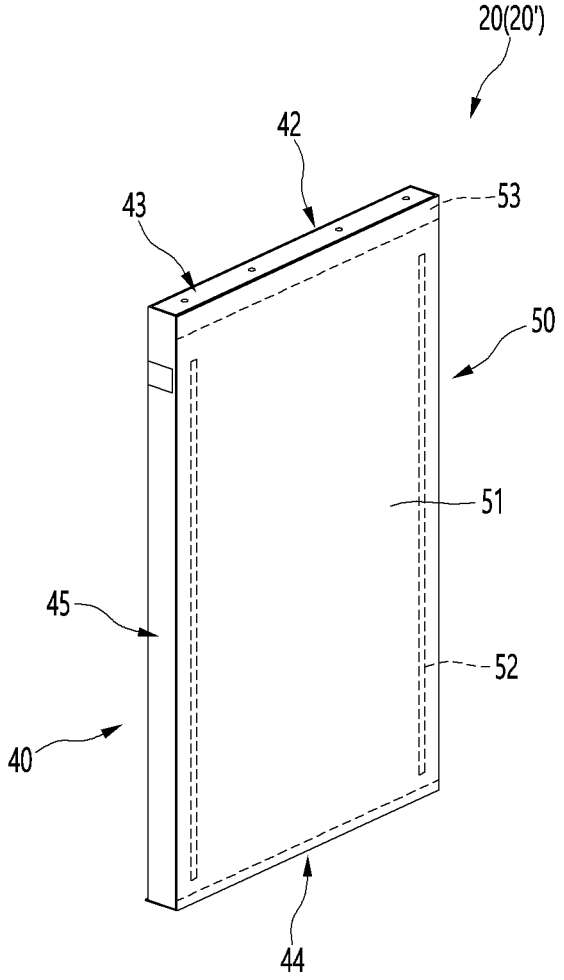
FIG. 18 is a view illustrating a state in which the panel assembly is completely mounted.

FIG. 15 is a view illustrating a state before the panel assembly is mounted on the door body. Also, FIG. 16 is a view illustrating a process of restricting the lower end of the panel assembly. Also, FIG. 17 is a view illustrating a process of restricting the upper end of the panel assembly. Also, FIG. 18 is a view illustrating a state in which the panel assembly is completely mounted.

As illustrated in FIG. 15, the door 20 may be assembled by mounting the panel assembly 50 on the door body 40. For this, the panel assembly 50 may be completed by mounting the first bracket 53, the second bracket 54, and the panel fixing member 55 on the panel 51. Also, after assembling the front panel 51 and the side frame 45, and the first cap decor 42, the second cap decor 44, and the accommodation member 46, an insulator 49 may be molded to complete the door body 40.

Also, the panel assembly 50 may be disposed to be mounted on the front surface of the door body 40 in the assembled state. Here, the rear surface of the panel assembly 50 may be directed to the front surface of the door body 40, and the lower end of the panel assembly 50 may be disposed above the second support end 445 so that the restriction portion 445*a* is disposed in a position of being inserted into the lower insertion portion 544.

In detail, the panel assembly 50 may move backward from a front side to approach the front surface of the door body 40, and simultaneously, the lower end of the panel assembly 50 may move to be seated on the second support end 445 while moving downward from an upper side.

As illustrated in FIG. 16, the restriction portion 445*a* of the second support end 445 may be inserted into the lower insertion portion 544 so that the lower end of the panel assembly 50 is restricted. Thus, the panel assembly 50 may be in a state in which the downward movement is restricted by the restriction portion 445*a*.

As described above, the user may temporarily restrict the lower end of the panel assembly 50 to the door body 40 and then allow the upper end of the panel assembly 50 to rotate so as to be in close contact with the first cap decor 42.

In a state in which the lower end of the panel assembly 50 is supported by the second support end 445 and temporarily fixed, the user may allow the upper end of the panel assembly 50 to rotate to be in contact with the front surface of the first cap decor 42.

Here, the insertion protrusion 534 disposed at the top end of the panel assembly 50 may be inserted into the insertion hole 425. When the upper end of the panel assembly 50 completely rotates, the insertion protrusion 534 may be inserted into the inside of the decor recess 420 through the insertion hole 425.

While the panel assembly 50 rotates, the magnet 52 may be attached to the front plate 41 by magnetic force, and the state in which the panel assembly 50 is attached to the front surface of the door body 40 until the panel assembly 50 is mounted may be maintained.

When the panel assembly 50 completely rotates, the upper end of the panel assembly 50 may be in contact with the first support end 428. Also, the panel assembly 50 may be accommodated in a space in front of the door body 40 defined by the first support end 428, the second support end 445, and front ends of both left and right sides.

Also, when the panel assembly 50 is mounted at the fixed position, the upper coupling protrusion 533 and the upper coupling portion 424 may be aligned with each other, and the screw may be coupled to the upper coupling portion 424 inside the decor recess 420 to more firmly couple the first bracket 53 to the first cap decor 42.

Next, as illustrated in FIG. 17, the decor cover 43 may be mounted to shield the opened top surface of the decor recess 420. The decor cover 43 may be seated on the opened top surface of the decor recess 420 while moving downward from the upper side.

Here, while the decor cover 43 moves downward, the restriction protrusion 434 of the decor cover 43 may pass through the through-hole 534*a* of the insertion protrusion 534 inserted into the decor recess 420.

When the decor cover 43 is completely mounted on the decor recess 420, the restriction protrusion 434 may pass through the insertion protrusion 534 as illustrated in FIG. 12, and the insertion protrusion 534 and the restriction protrusion 434 may be in the restricted with each other.

In the state in which the decor cover 43 is mounted on the decor recess 420, a screw S may be coupled to the decor cover 43 to more firmly fix the decor cover 43 to the first cap decor 42. In this state, the panel assembly 50 may be maintained in close contact with the front of the door body 40, and the panel assembly 50 may be in a state of being firmly mounted on the door body 40 as illustrated in FIG. 18.

Also, the screw may be coupled to the second cap decor 4 so that the second cap decor 44 may be more firmly coupled to the second bracket 54.

To separate the panel assembly 50 mounted on the door body 40, the above-described process may be performed in a reverse order.

Particularly, to separate the panel assembly 50, when the decor cover 43 is separated, the decor recess 420 may be exposed, and in this state, the user may put the hand into the decor recess 420 to press the insertion protrusion 534.

When the insertion protrusion 534 is pressed, the lower end of the panel assembly 50 may be restricted, and thus, the panel assembly 50 may rotate by using the lower end of the panel assembly 50 as an axis, and the insertion protrusion 534 may be separated from the restriction portion 445*a*.

That is, the upper end of the panel assembly 50 may rotate outward via the first support end 428, and in this state, the panel assembly 50 may be lifted to separate the panel assembly 50 from the door body 40.

Of course, in this process, when the screw is coupled to the first bracket 53 or the second bracket 54, the operation of removing the screw may be further performed.

In addition to the foregoing embodiment, a refrigerator according to various embodiments may be exemplified. Another embodiment is characterized in that a panel constituting a panel assembly is made of a metal material. Further another embodiment are all the same as the above-described embodiment except for a structure of the panel, and thus, the same components will be denoted by the same reference numerals, and detailed descriptions thereof will be omitted.

Figure 19:
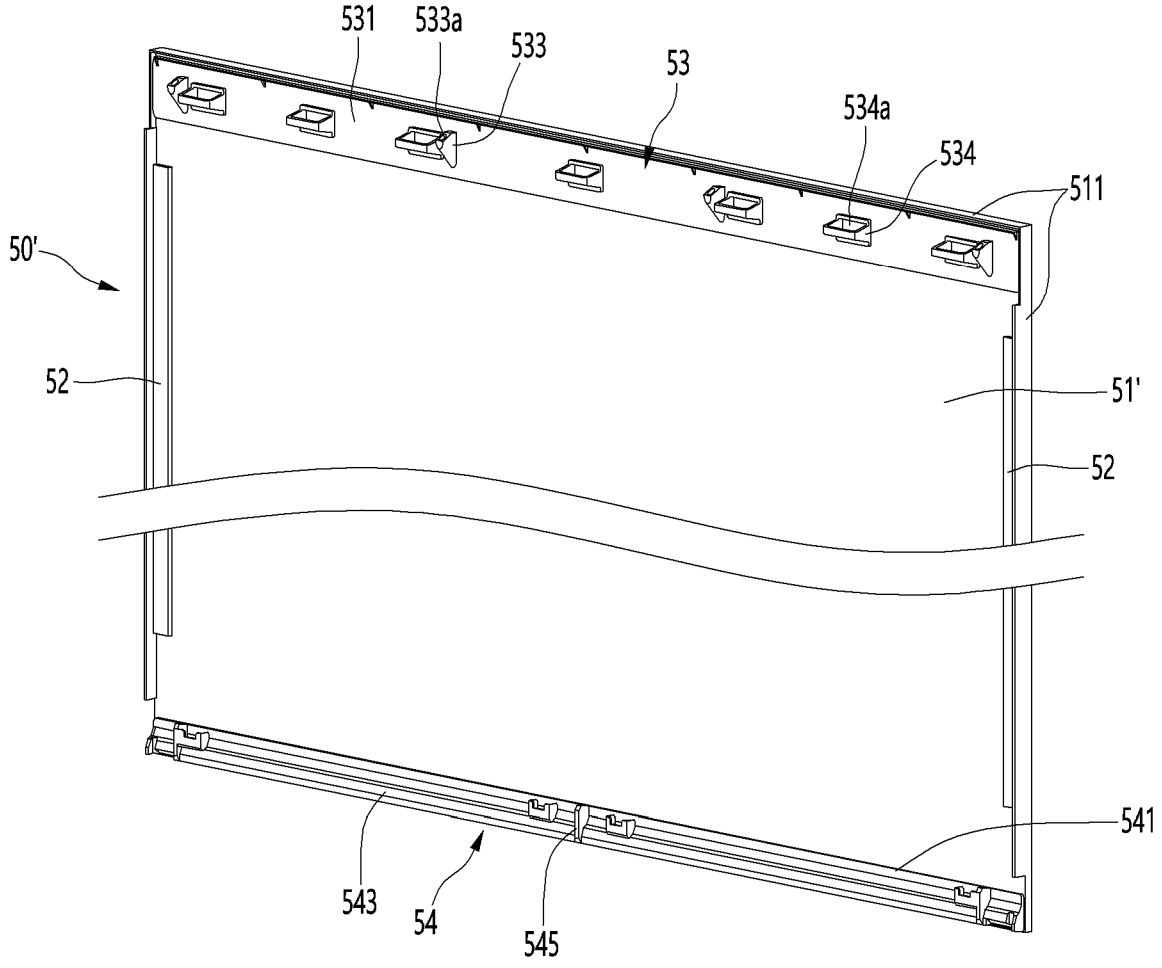
FIG. 19 is a rear perspective view of a panel assembly according to another embodiment.

FIG. 19 is a rear perspective view of a panel assembly according to another embodiment.

As illustrated in the drawing, a refrigerator door 20 according to another embodiment may include a door body 40 and a panel assembly 50' mounted on a front surface of the door body 40.

The panel assembly 50' may have a size corresponding to that of a front surface of the door body 40 and be configured to define an outer appearance of an entire front surface of the door 20 in a state of being mounted on the door body 40.

The panel assembly 50' may include a plate-shaped panel 51 defining an outer appearance and first and second brackets 53 and 54 for fixing upper and lower ends of a panel' 51. Also, the panel assembly 50' may further include a magnet 52 so that a rear surface of the panel 51' and a front surface of the door body 40 are attached to each other.

In detail, the panel 51' may be made of a rectangular plate-shaped material having a predetermined thickness and may be made of a material that is capable of being harmonized with the furniture or wall O or the home appliance disposed therearound.

For example, the panel 51' may be made of a plate-shaped metal material such as stainless steel. Also, printing, coating treatment, or film attachment may be performed on the front surface of the panel 51' to have a color or pattern, thereby defining the outer appearance of the door 20.

The panel 51' may be maintained in a stable support state when mounted on the door body 40, and a bent portion 511 may be disposed along a circumference so that a cross-section of the panel 51' is not exposed to the outside. Thus, the outer appearance of the circumferential surface of the panel 51' may be defined by the bent portion 511. Also, the first bracket 53, the second bracket 54, and the magnet 52, which are mounted on a rear surface of the panel 51', may be shielded by the bent portion 511, and thus, the panel 51' may be prevented from being exposed to the outside.

A magnets 52 may be provided at each of both left and right ends of the panel 51'. The magnet 52 may be attached to the rear surface of the panel 51' by an adhesive or magnetic force. The magnet 52 may extend from an upper end to a lower end of the panel 51'. Also, when the panel assembly 50' is mounted on the door body 40 in a state in which the magnet is attached to the panel 51' the magnet 52 may be attached to the front panel 51' by the magnetic force. That is, the mounting of the panel assembly 50' may be assisted by the magnet 52.

The first bracket 53 may extend along an upper end of the panel 51' and have a length corresponding to a horizontal width of the panel 51'. Also, when the panel assembly 50' is mounted, the panel assembly 50' may be coupled to the first cap decor 42, and then, an upper end of the panel assembly 50' may be restricted.

Also, the second bracket 54 may be provided on a lower end of the panel 51' and may have a horizontal length that is equal to a horizontal length of the panel 51'. Also, a lower insertion portion 544 into which the restriction portion 445*a* of the second cap decor 44 is inserted may be defined in a lower end of the second bracket 54. Thus, the lower end of the panel assembly 50' may be fixed by inserting the restriction portion 445*a* into a bent portion opening 524.

In addition to the foregoing embodiment, a refrigerator according to various embodiments may be exemplified. In further another embodiment, a panel of a panel assembly may be made of a FENIX material. In further another embodiment, other configurations except for the panel are all the same as those of the above-described embodiment, and the same components are denoted by the same reference numerals, and detailed descriptions thereof will be omitted.

Figure 20:
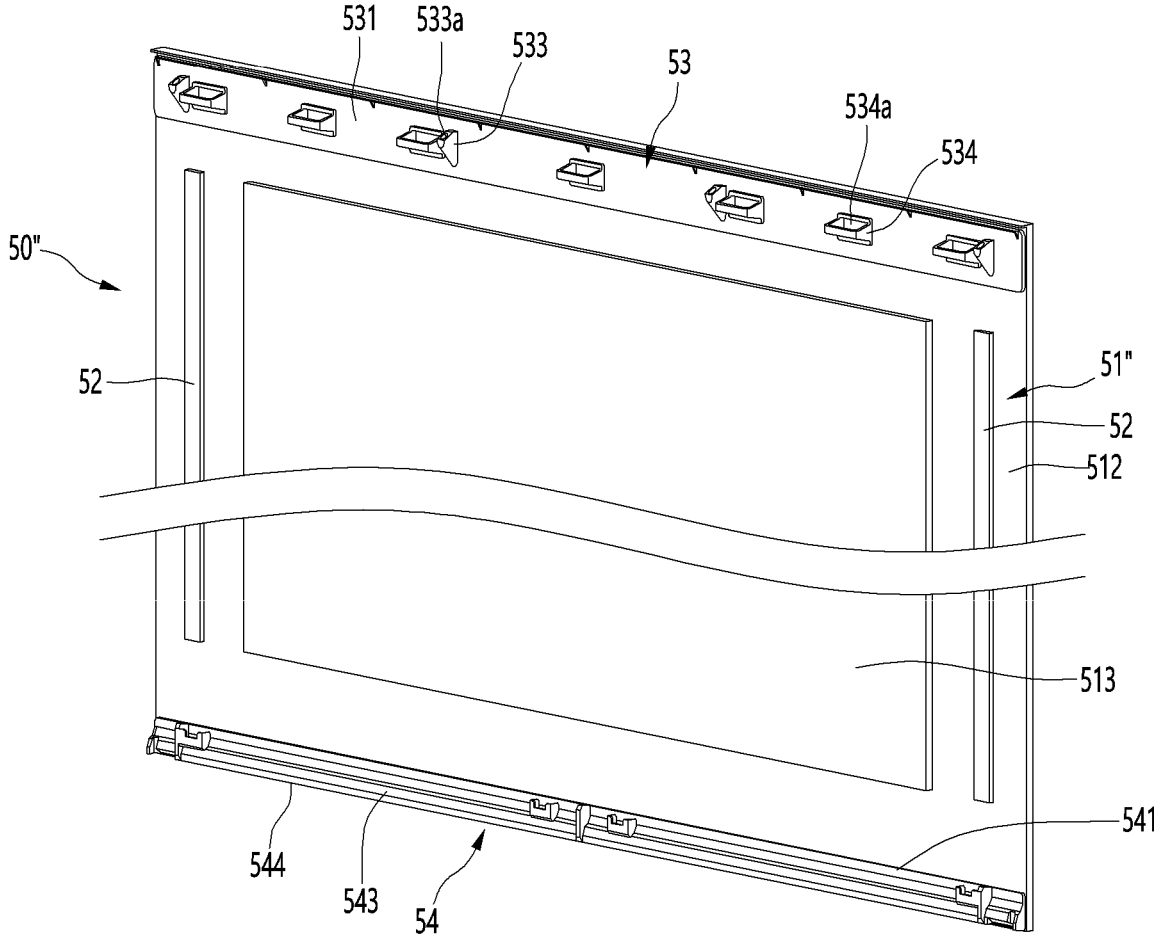
FIG. 20 is a rear perspective view of a panel assembly according to further another embodiment.

FIG. 20 is a rear perspective view of a panel assembly according to further another embodiment.

As illustrated in the drawing, a refrigerator door 20 according to further another embodiment may include a door body 40 and a panel assembly 50" mounted on a front surface of the door body 40.

The panel assembly 50" may be mounted on a front surface of the door body 40 to define an outer appearance of a front surface of the door 20. The panel assembly 50" may include a panel 51", a first bracket 53, and a second bracket 54. Also, the panel assembly 50" may further include a magnet 52 attached to the front plate 41.

In detail, the panel 51 may be made of a rectangular plate-shaped material having a predetermined thickness and may be made of a material that is capable of being harmonized with the furniture or wall O or the home appliance disposed therearound.

For example, the panel 51" may be made of a composite material (for example FENIX material) having a predetermined thickness. Also, a pattern may be disposed on a front surface of the panel 51" to realize surface texture or may be surface-treated such as coating to define the outer appearance of the door 20. Of course, the panel 51" may be made of ceramic, tile, composite material, stone, or the like having a similar thickness, not the FENIX material.

The panel 51" made of the FENIX material may have a thickness greater than or equal to a set thickness in consideration of workability and strength for use in the door 20. Thus, the thickness of the panel 51" may be thicker than that of each of the panels 51 and 51' made of a glass or metal material described above.

In this state, when the first bracket 53, the second bracket 54, and the magnet 52 are disposed on a rear surface of the panel 51", the thickness of the panel assembly 50" may be excessively thick to deteriorate the outer appearance of the door 20 or prevent a normal assembly structure from being applied. As a result, a recessed panel seating portion 512 may be defined in a circumference of a rear surface of the panel 51".

In detail, in the rear surface of the panel 51", a central portion 513 of the rear surface of the panel 151" may protrude backward, and the panel seating portion 512 recessed along the circumference of the central portion 513 may be provided. The panel 51" may be provided in a plate shape having the same thickness as the central portion 513, and a recessed panel seating portion 512 may be provided by processing the panel seating portion 512.

The panel seating portion 512 may have a predetermined width so that the first bracket 53, the second bracket 54, and the magnet 52 are mounted. Also, when the panel assembly 50 is mounted, the first bracket 53 and the second bracket 54 may be coupled to the first cap decor 42 and the second cap decor 44 as in the above-described embodiment, and the magnet may have a thickness to be attached to the front plate 41.

That is, the panel mounting portion 512 may be provided to be stepped from the central portion 513 and have a thickness less than that of the central portion 513 so that the first bracket 53, the second bracket 54, and the magnet 52 are disposed.

If necessary, the panel seating portion 512 may not be stepped, but only an area on which the first bracket 153, the second bracket 154, and the magnet 52 are mounted may be recessed in a corresponding shape.

Also, a magnet 52 may be provided at each of both left and right ends of the panel 51". The magnet 52 may be attached to the rear surface of the panel 51" by an adhesive or magnetic force. The magnet 52 may extend from an upper end to a lower end of the panel 51". Also, when the panel assembly 50" is mounted on the door body 40 in a state in which the magnet is attached to the panel 51" the magnet 52 may be attached to the front panel 51" by the magnetic force. That is, the mounting of the panel assembly 50" may be assisted by the magnet 52.

The first bracket 53 may extend along an upper end of the panel 51" and have a length corresponding to a horizontal width of the panel 51". Also, when the panel assembly 50" is mounted, the panel assembly 50" may be coupled to the first cap decor 42, and then, an upper end of the panel assembly 50" may be restricted.

Also, the second bracket 54 may be provided on a lower end of the panel 51" and may have a horizontal length that is equal to a horizontal length of the panel 51". Also, a lower insertion portion 544 into which the restriction portion 445*a* of the second cap decor 44 is inserted may be defined in a lower end of the second bracket 54. Thus, a lower end of the panel assembly 50" may be fixed by inserting the restriction portion 445*a* into the bent portion opening 524.

A refrigerator according to various other embodiments in addition to the foregoing embodiments of the present invention may be exemplified.

Hereinafter, further another embodiment will be described in more detail with reference to the drawings.

Figure 21:
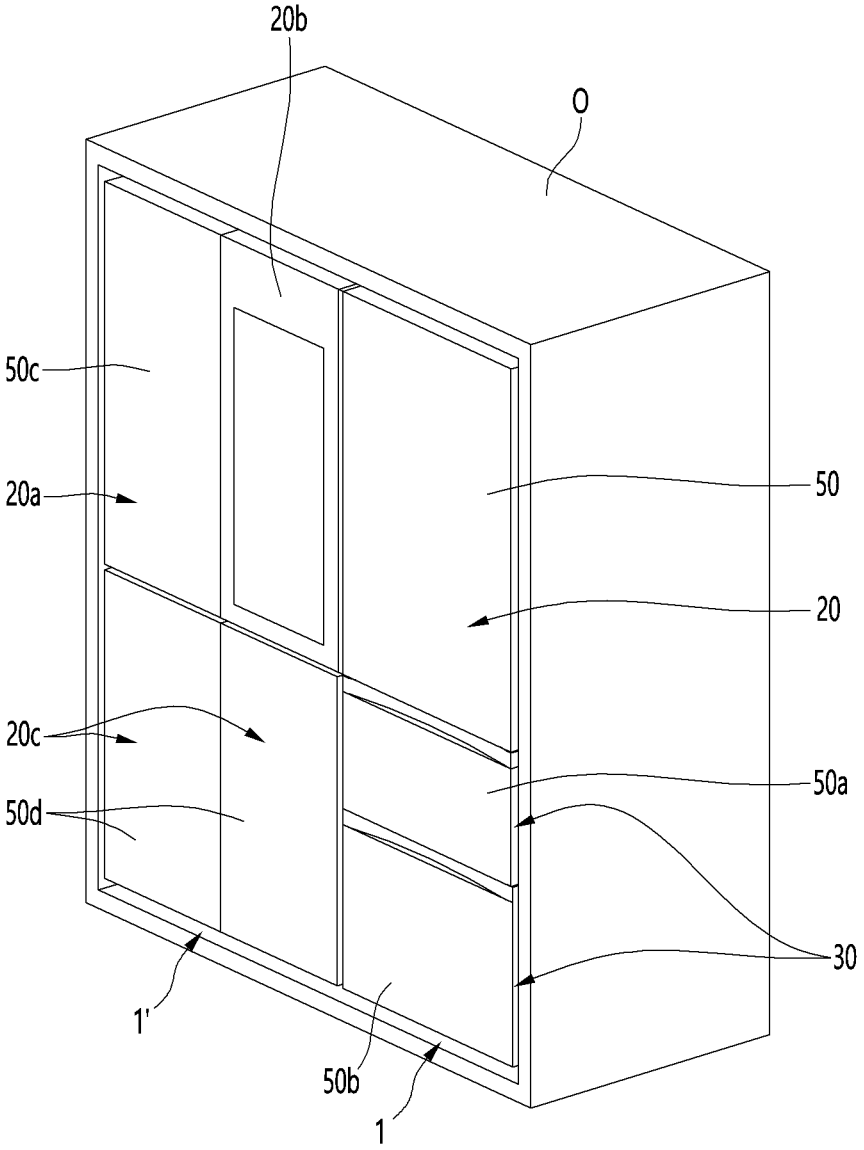
FIG. 21 is a perspective view illustrating a state in which a refrigerator is installed according to another embodiment.
Figure 22:
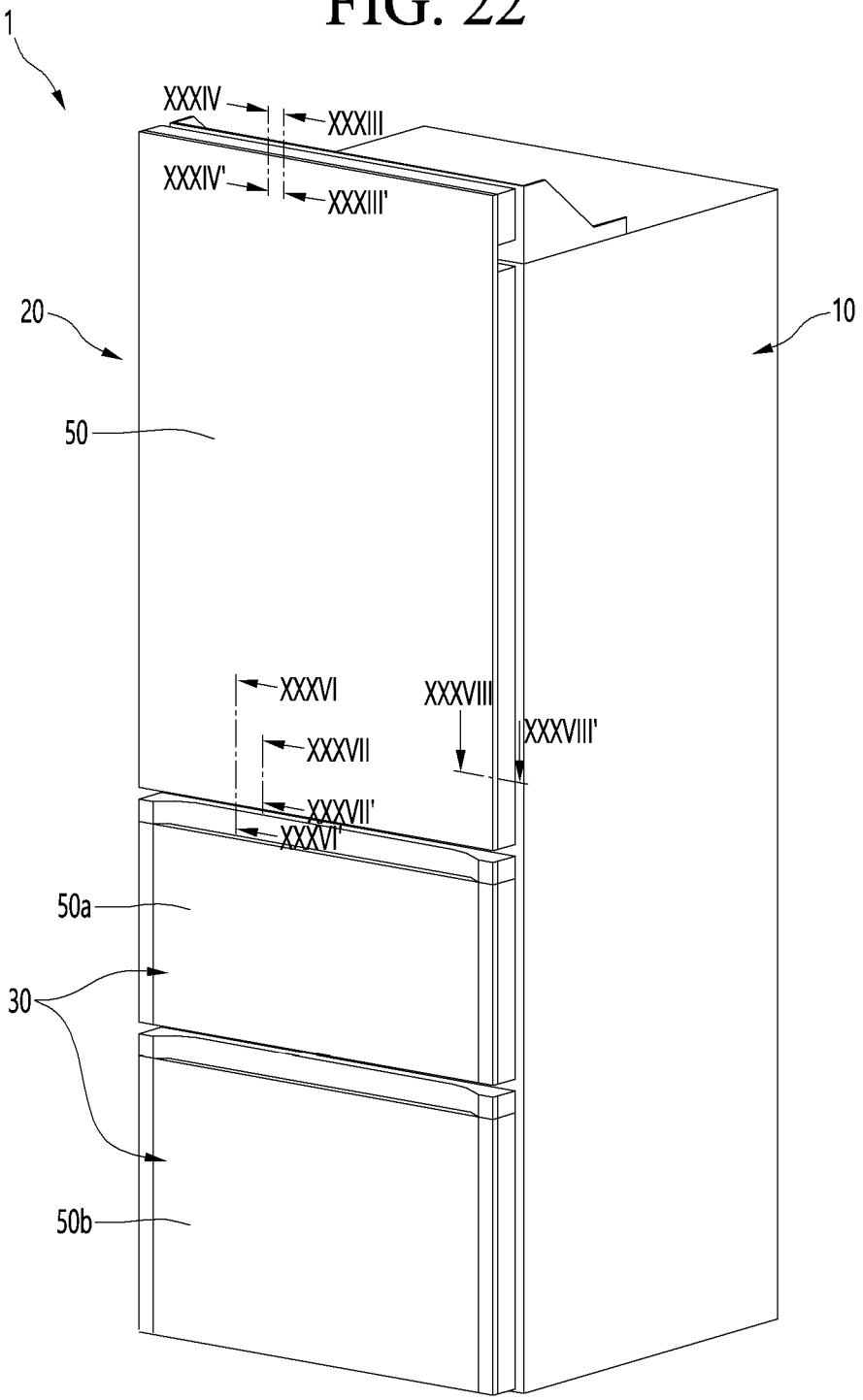
FIG. 22 is a perspective view of the refrigerator.

FIG. 21 is a perspective view illustrating a state in which a refrigerator is installed according to another embodiment. Also, FIG. 22 is a perspective view of the refrigerator.

Referring to the drawings, a refrigerator 1 according to an embodiment includes a cabinet 10 defining a storage space having an opened front surface and a door opening or closing the storage space. Here, an outer appearance of the refrigerator 1 may be defined by a cabinet 10 and doors 20 and 30.

Also, the refrigerator 1 may be mounted so as to harmonize with furniture or wall O of an indoor space. For example, as illustrated in FIG. 21, the refrigerator 1 may be installed in the indoor space such as a kitchen and may be disposed adjacent to the furniture or the wall O to harmonize with each other. That is, a space corresponding to a size of the refrigerator 1 may be provided in the furniture or the wall O, and the refrigerator 1 may be accommodated or disposed in a built-in type.

Also, the other refrigerator 1' may be continuously disposed in parallel at a side of the refrigerator 1. That is, a space in which a plurality of refrigerators 1 and 1' may be disposed may be provided by the furniture or the wall O.

The plurality of refrigerators 1 and 1' may have the same structure, and as necessary, the refrigerators 1 and 1' having various structures may be disposed in combination. For example, as illustrated in FIG. 21, in the refrigerator 1 disposed on a right side, doors 20 may be disposed vertically. That is, the right refrigerator 1 may be configured so that the door 20 that is opened and closed in a rotating manner is provided at an upper side, and the door 30 that is opened and closed in a sliding manner is provided at a lower side. Also, the refrigerator 1 disposed side by side at a left side may be configured so that an upper storage space is opened and closed by a pair of doors 20*a* and 20*b*, and a lower storage space is opened and closed by a pair of doors 20*c*. Also, the doors 20*a*, 20*b*, and 20*c* may be configured to be opened and closed in the rotating manner, and the doors 20*a*, 20*b*, and 20*c* may be referred to as French-type doors.

The same panel assemblies 50, 50*a*, 50*b*, 50*c*, and 50*d* may be mounted on the doors 20, 30, 20*a*, and 20*c* of the left refrigerator 1' and the right refrigerator 1. The panel assemblies 50, 50*a*, 50*b*, 50*c*, and 50*d* may define front surfaces of the doors 20, 30, 20*a*, and 20*c*, and thus, outer appearances of the refrigerators 1 and 1' may be defined when viewed from a front side. Of course, one door 20*b* among the doors of the left refrigerator 1' may have a different outer appearance and be configured to have an internal see-through function. All of the remaining doors 20, 30, 20*a*, and 20*c* except for the door 20*b* having a specific function may have the same appearance.

That is, the doors 20, 30, 20*a*, and 20*c* of the refrigerators 1 and 1' have different sizes, but the panel assemblies 50, 50*a*, 50*b*, 50*c*, and 50*d* having the same structure may be mounted. Thus, even if the plurality of refrigerators 1 are disposed, the same outer appearance, an outer appearance such as a color and texture may be provided. Of course, the panel assemblies 50, 50*a*, 50*b*, 50*c*, and 50*d* may have different colors or different textures, as necessary.

Also, since each of the panel assemblies 50, 50*a*, 50*b*, 50*c*, and 50*d* has a detachable structure, the panel assembly 50 having an appropriate outer appearance may be selected according to an environment in which the refrigerators 1 and 1' and thus mounted.

When the refrigerator 1 is mounted on the furniture or wall O, the outer appearance of the refrigerator 1 may be provided to have the same material or materials having the same texture as the furniture or wall O, and thus, the outer appearance of the refrigerator and the adjacent furniture or wall O may have a sense of unity. Of course, even if the outer appearance of the refrigerator 1 and the furniture or wall O do not have a sense of unity, the refrigerator 1 may be made of a material that is capable of harmonized with the furniture or wall O.

Also, the refrigerator 1 may be disposed adjacent to the adjacent refrigerator 1' and the furniture or wall O and also may be disposed close to the adjacent refrigerator 1 and the furniture or wall O in a range that does not interfere when the doors 20 and 30 are opened and closed.

Structures and mounting structures of the panel assemblies 50, 50*a*, 50*b*, 50*c*, and 50*d* according to an embodiment may be the same in both the left refrigerator 1' and the right refrigerator 1. Therefore, hereinafter, a structure of the right refrigerator 1 of the refrigerators 1 and 1' of FIG. 1 will be described in more detail.

The refrigerator 1 may have an outer appearance defined by the cabinet 10 and the doors 20 and 30. Also, the cabinet 10 may define a storage space that is divided vertically. Also, the doors 20 and 30 that open and close the storage space may be continuously disposed in the vertical direction.

An upper door 20 may be provided in an upper storage space, and a lower door 30 may be provided in a lower storage space. The upper door 20 may open and close the upper storage space by rotation thereof. Thus, the upper door 20 may be referred to as a rotation type door. Also, the lower door 30 may be withdrawn in a drawer type to open and close the lower storage space, and the lower door 30 may be referred to as a drawer type door 30.

The lower door 30 may be provided with two upper and lower doors, and the lower storage space opened and closed by the lower door 30 may be provided as one space, or a space in which each of the lower doors 30 is accommodated.

Outer appearances of front surfaces of the upper door 20 and the lower door 30 may be defined by the panel assemblies 50, 50*a*, and 50*b*, respectively. The panel assemblies 50, 50*a*, and 50*b* provided in the upper door 20 and the lower door 30, respectively, may be different in size and have the same appearance.

Hereinafter, for convenience of explanation and understanding, the panel assembly 50 and a mounting structure of the panel assembly 50 will be described with reference to the upper door 20. Also, hereinafter, the upper door 20 may be referred to as a door 20.

Figure 23:
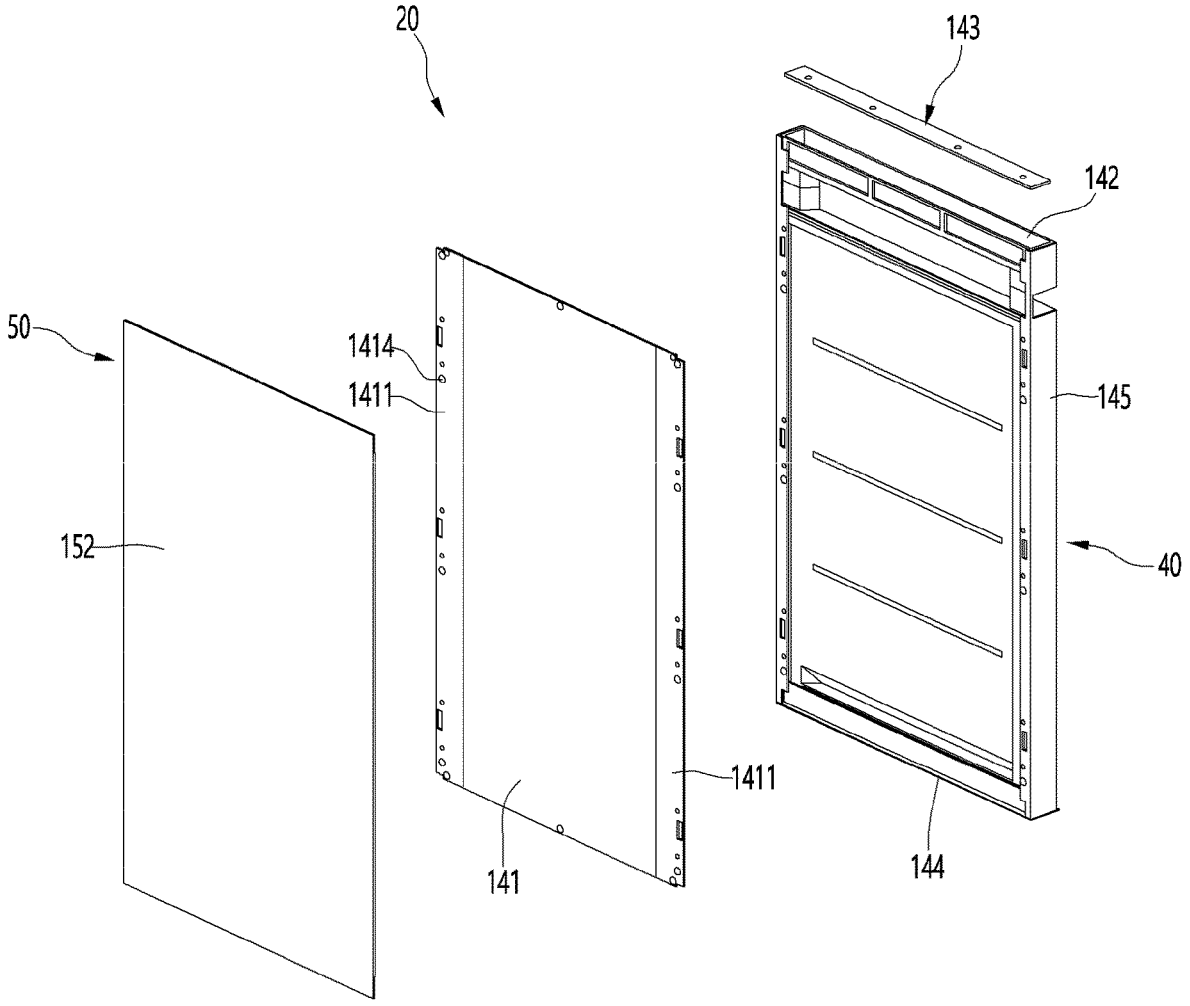
FIG. 23 is an exploded perspective view illustrating a door of the refrigerator.
Figure 24:
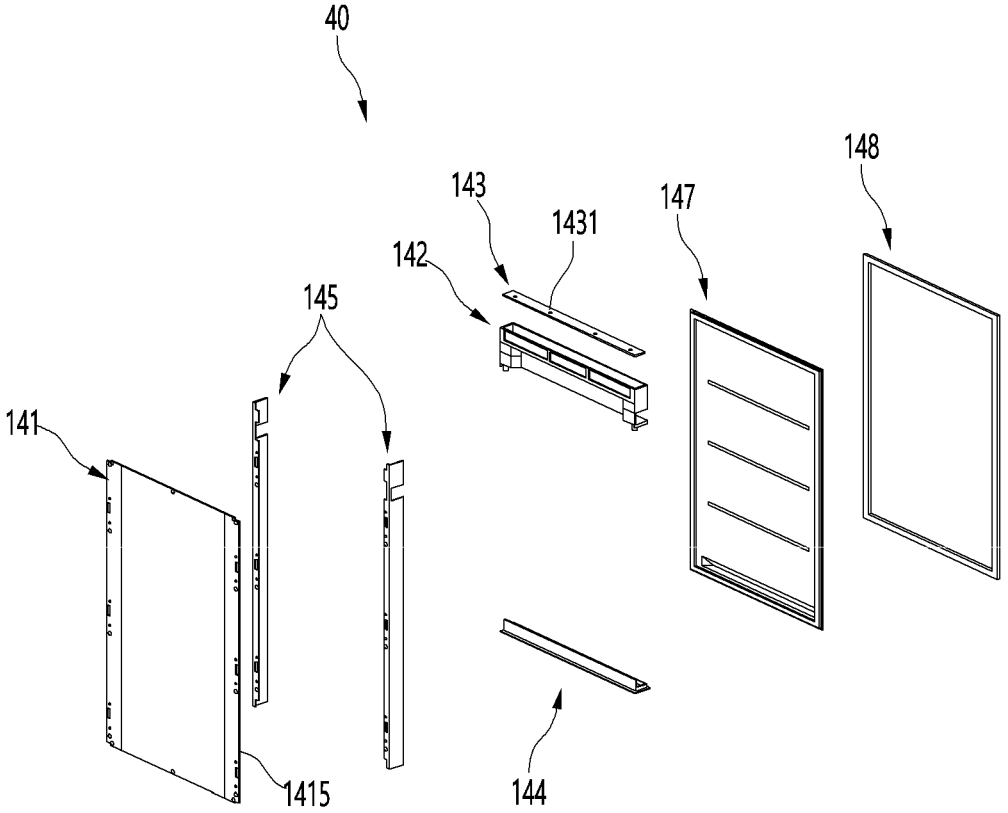
FIG. 24 is an exploded front perspective view illustrating a state in which a door body that is one component of the door is disassembled.
Figure 25:
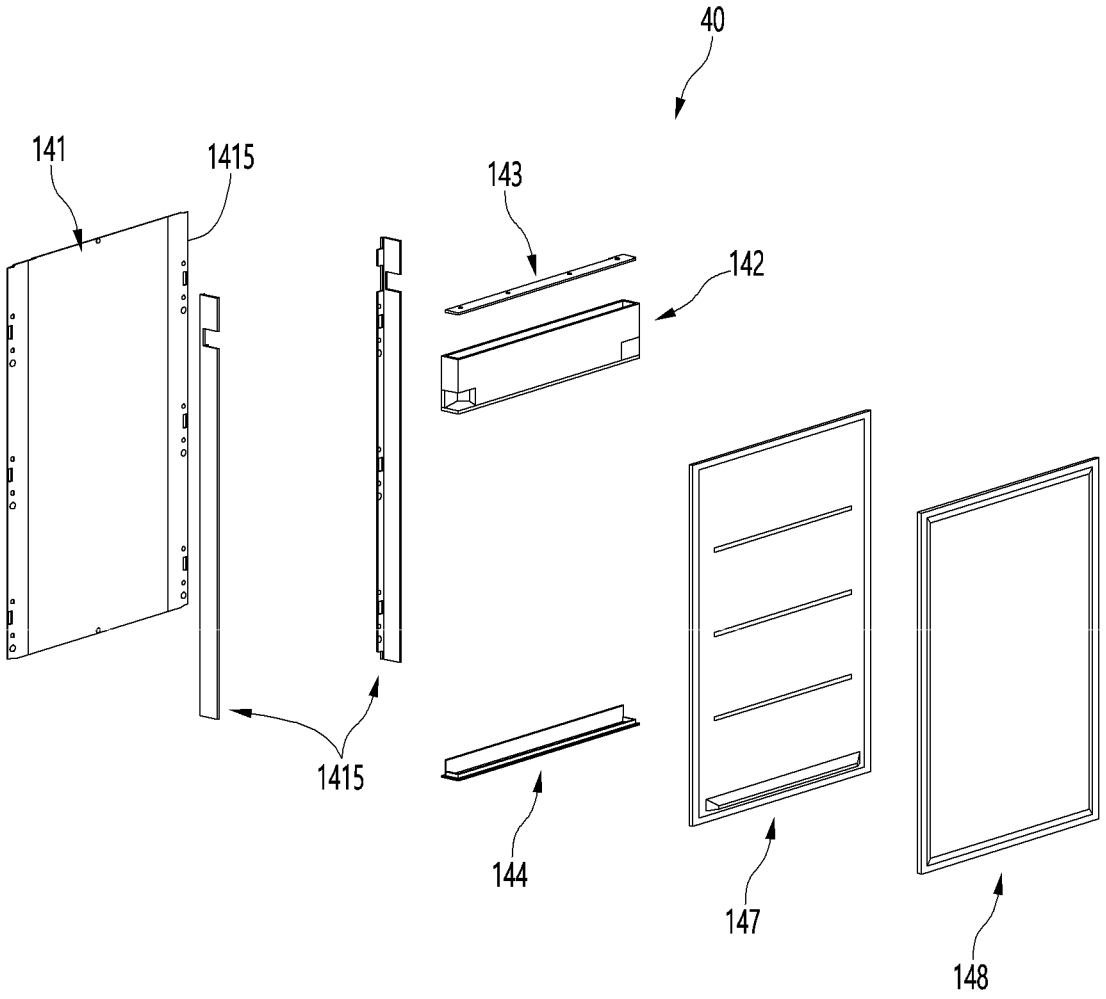
FIG. 25 is an exploded rear perspective view illustrating a state in which the door body is disassembled.

FIG. 23 is an exploded perspective view illustrating the door of the refrigerator. Also, FIG. 24 is an exploded front perspective view illustrating a state in which a door body that is one component of the door is disassembled. Also, FIG. 25 is an exploded rear perspective view illustrating a state in which the door body is disassembled.

As illustrated in the drawings, the door 20 may be filled with an insulator 400 (see FIG. 36) and may include a door body 40 that substantially opens and closes the storage space and a panel assembly 50 mounted on the door body 40.

The door body 40 may have a predetermined thickness, and the insulator 400 may be filled therein to insulate the storage space. Also, the panel assembly 50 may be mounted on a front surface of the door body 40 to define outer appearances of the front surfaces of the door 20 and the refrigerator 1. The panel assembly 50 may be mounted to be easily detachable from the door body 40, and the panel assembly 50 may be easily detachable even when the door 20 is mounted on the cabinet 10.

Thus, the panel assembly 50 may be mounted in consideration of the outer appearance of the furniture or wall O, and the panel assembly 50 may be designed to be desired by the user and be mounted or replaced, as necessary.

Referring to the structure of the door body 40, the door body 40 may include a front plate 141, a side frame 145, an upper cap decor 142, a lower cap decor 144, a door liner 147, and a gasket 148 as a whole. Also, the insulator 400 may be filled inside the door body 40.

In detail, the front plate 141 may define a front surface of the door body 40 and be provided in a plate shape. The front plate 141 may be made of a steel material and define a surface facing a rear surface of the panel assembly 50.

Also, a plurality of screw holes 1414 may be defined along a circumference of the front plate 141. Screws coupled to the upper cap decor 142, the lower cap decor 144, and both the side frames 145 may be coupled to the screw hole 1414.

The upper cap decor 142 and the lower cap decor 144 may be respectively disposed at upper and lower ends of the front plate 141 to define top and bottom surfaces of the door body 40. Also, the side frames 145 may be coupled to both left and right side ends of the front plate 141, respectively, and upper and lower ends of each of the side frames 145 may be connected to the upper cap decor 142 and the lower cap decor 144, respectively.

The door liner 147 may be coupled to rear surfaces of the upper cap decor 142, the lower cap decor 144, and the side frame 145. The door liner 147 may be provided in a plate shape to define the rear surface of the door body 40. The door liner 147 may be made of a plastic material and may be vacuum-molded to define a shape of the rear surface of the door body 40.

A gasket groove 1471 may be defined around the rear surface of the door liner 147, and the gasket 148 may be disposed along the gasket groove 1471. The gasket 148 may be in contact with a circumference of the cabinet 10 while the door 20 is closed to seal the storage space.

Hereinafter, main components constituting the door body 40 will be described in more detail with reference to the drawings.

Figure 26:
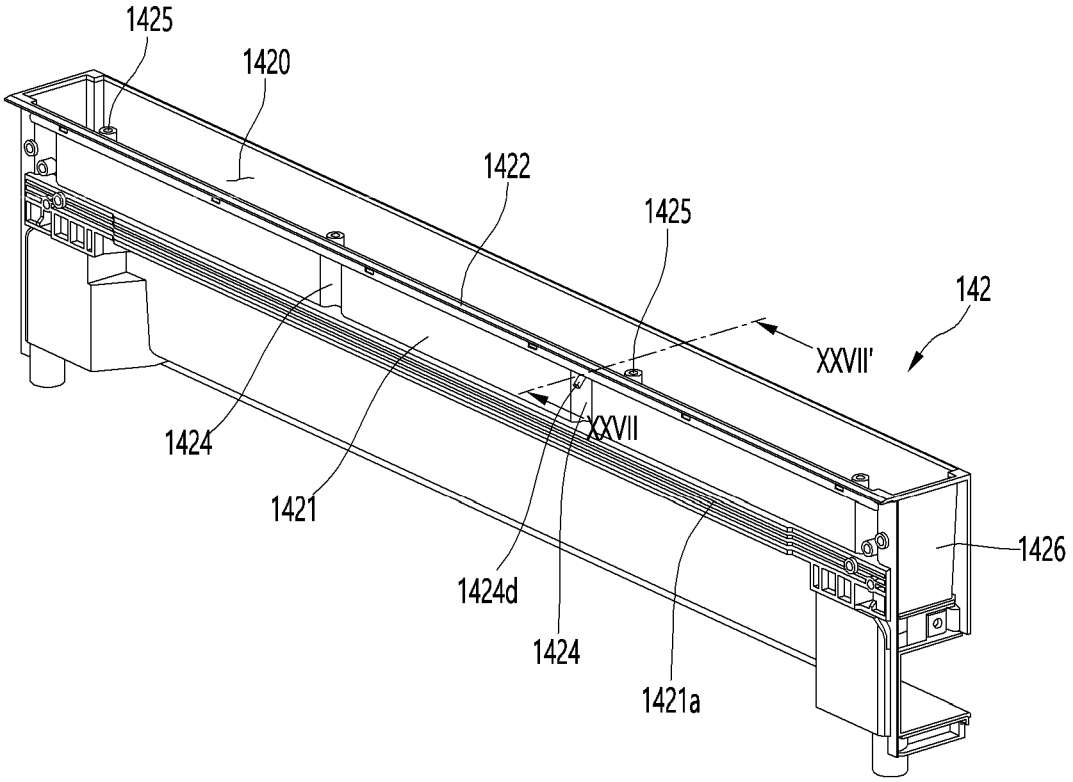
FIG. 26 is a perspective view of an upper cap decor that is one component of the door body.
Figure 27:
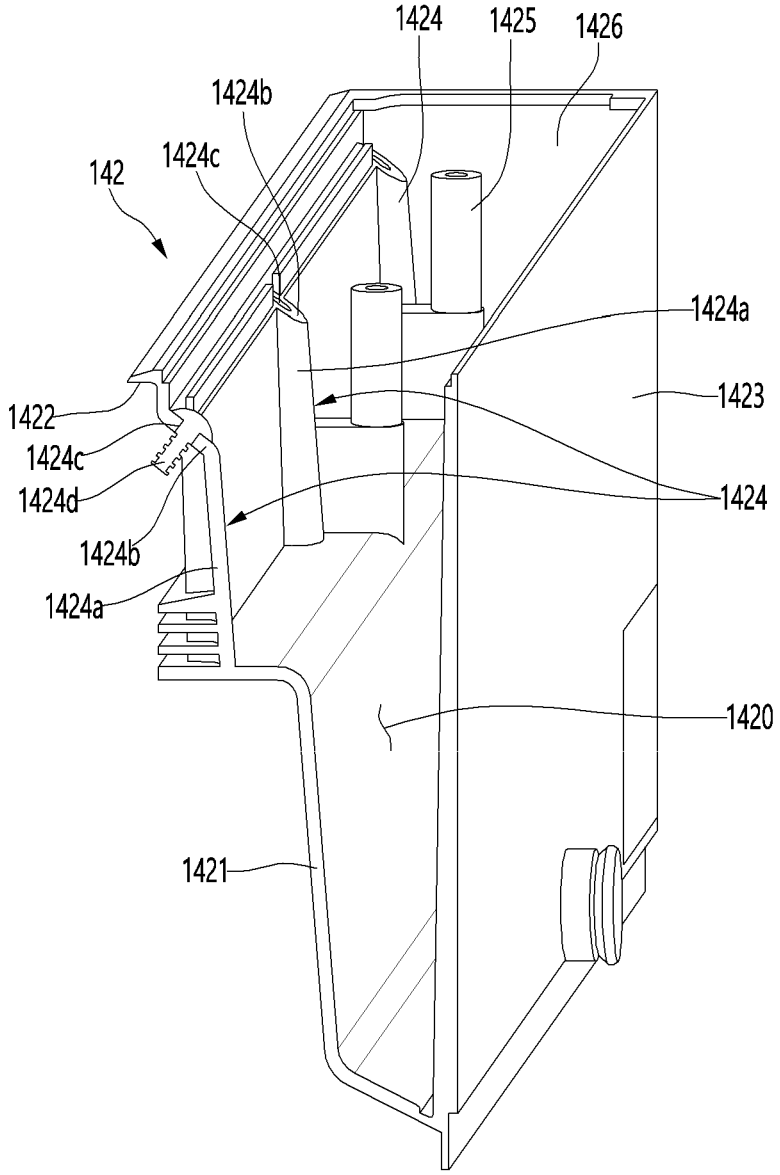
FIG. 27 is a cutaway perspective view taken along line XXVII-XXVII' of FIG. 26.

FIG. 26 is a perspective view of an upper cap decor that is one component of the door body. FIG. 27 is a cutaway perspective view taken along line XXVII-XXVII' of FIG. 26.

As illustrated in the drawings, the upper cap decor 142 may define an upper portion of the door 20 and also may define a top surface of the door 20, which is exposed to the outside in an assembled state. Also, the upper cap decor 142 may be configured to support the front plate 141, the door liner 147, and the upper end of the side frame 145.

In detail, the upper cap decor 142 may be made of a plastic material and may include a front surface 1421, a rear surface 1423, and both side surfaces 1426. The front plate 141 may be coupled to the front surface 1421, the door liner 147 may be coupled to the rear surface 1423, and the side frame 145 may be coupled to each of both left and right side surfaces 1426.

Also, a recessed space 1420 having an open top surface may be defined in the upper cap decor 142, and a screw may be coupled to the upper end of the panel assembly 50 through the recessed space 1420. Also, a PCB for controlling electronic components provided in the door 20 may be accommodated inside the recessed space 1420. Also, the recessed space 1420 may extend up to a lower end of the upper cap decor 142, and during injection molding, the rear surface 1423 may be provided in a planar shape. The opened top surface of the recessed space 1420 may be shielded by the decor cover 143. That is, the decor cover 143 may define most of the outer appearance of the top surface of the door 20.

A plurality of screw holes 1431 may be defined along the decor cover 143. Also, a cover support boss 1425 extending upward may be disposed inside the recessed space 1420 corresponding to the screw hole 1431. The cover support boss 1425 may be disposed at a position corresponding to the screw hole 1431 and may extend to support the decor cover 143 at the lower side when the decor cover 143 is mounted. Also, the screw passing through the screw hole 1431 may be coupled to a top surface of the cover support boss 1425 so that the decor cover 143 is fixed.

Also, an upper coupling portion 1424 to which an upper coupling member **1424*d* coupled to an upper bracket 153 to be described in detail below may be disposed inside the recessed space 1420. The upper coupling portion 1424 may be disposed at a position corresponding to the upper coupling protrusion 1533 protruding from the upper bracket 153. For example, four upper coupling portions 1424 may be disposed at a pair of positions spaced apart from each other at left and right sides with respect to a center of the upper cap decor 142. That is, the upper coupling portion 1424 may be disposed at each of both the side ends of the upper cap decor 142** and may be further disposed at each of inner sides spaced apart from both the side ends.

The upper coupling portion 1424 may include an upper extension portion **1424*a* extending along a front surface of the recessed space 1420, an upper inclined surface 1424*b* disposed at an upper end of the upper extension portion 1424*a*, and an upper screw hole 1424*c* defined in the upper inclined surface 1424*b***.

The upper extension portion **1424*a* may be provided so that a portion of the front surface 1421 is recessed to accommodate the upper coupling protrusion 1533 and may protrude from the inside of the recessed space 1420. Also, the upper extension portion 1424*a* may extend upward, i.e., may extend to a position lower than that of the decor cover 143. For example, the upper extension portion 1424*a* may have a height equal to or slightly lower than a height of the cover support boss 1425. Thus, in a state in which the decor cover 143 is opened, the upper coupling member 1424*d* may be easily coupled to the screw hole 1424*c* defined in a top surface of the upper extension portion 1424*a*. For example, the upper coupling member 1424*d*** may be a screw.

An upper inclined surface **1424*b* may be disposed on the top surface of the upper extension portion 1424*a*. The upper inclined surface 1424*b* may have a downward inclination at which a rear end thereof is lower than a front end thereof. Also, the upper screw hole 1424*c* to which the upper coupling member 1424*d* is coupled may be defined in the upper inclined surface 1424*b*. Thus, when the door 20 is assembled, in a state in which the rear surface of the door 20 faces the bottom, a space for the coupling of the upper coupling member 1424*d* may be easily secured through the recessed space 1420**.

The front surface of the upper cap decor 142 may be provided in a shape in which a lower portion thereof protrudes more backward than an upper portion thereof. Also, an upper plate coupling portion **1421*a* supporting the front plate 141 at the rear side may be disposed on the front surface of the upper cap decor 142. The upper plate coupling portion 1421*a* may extend from a left end to a right end of the upper cap decor 142 and may be disposed so that a plurality of ribs and grooves are continuously disposed vertically at regular intervals. Also, the upper plate coupling portion 1421***a* and the upper cap decor 142 may be coupled by a screw. Also, when a foaming liquid is injected below the upper cap decor 142 to mold the insulator 400, the upper cap decor 142 and a rear surface of the front plate may adhere to each other while being filled in the groove of the upper plate coupling portion 1421*a*. In addition, the upper plate coupling portion 1421*a* may be disposed to pass through a lower end of the upper extension portion 1424*a*.

Also, an upper support end 1422 protruding forward may be disposed on an upper end of a front surface of the upper cap decor 142. The upper support end 1422 may protrude forward and may support an upper end of the panel assembly 50. A protruding length of the upper support end 1422 may be less than a thickness of the panel assembly 50. Thus, in a state in which the panel assembly 50 is mounted, the upper support end 1422 may not protrude forward from the panel assembly 50. Thus, when viewed from a front side, the upper panel assembly 50 may be completely exposed, and the upper support end 1422 may be prevented from being excessively exposed.

Figure 28:
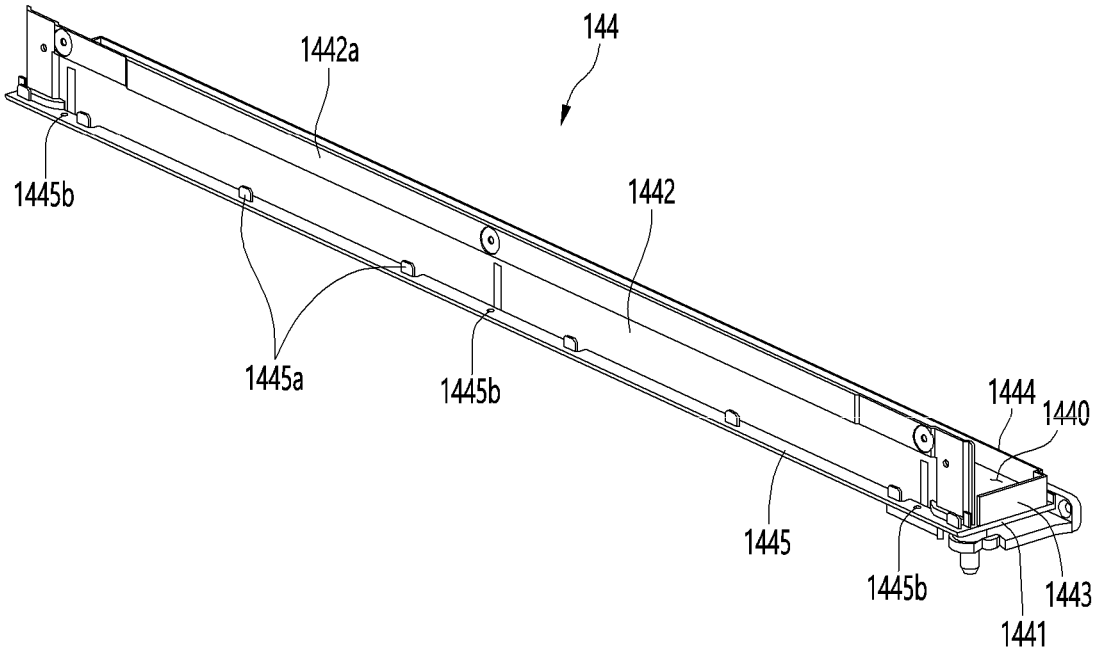
FIG. 28 is a perspective view of the lower cap decor that is one component of the door body.

FIG. 28 is a perspective view of the lower cap decor that is one component of the door body.

As illustrated in the drawings, the lower cap decor 144 may be made of a plastic material may define a lower portion of the door body 40 and also define a bottom surface of the door body 40. The lower cap decor 144 may generally include a bottom surface 1441, a front surface 1442, a rear surface 1444, and both side surfaces 1443. Also, the lower cap decor 144 may define a space having an opened top surface, and the insulator 400 may be filled in the space.

The front surface 1442 may support the lower end of the front plate 141 at the rear side. Also, both the side surfaces 1443 may support the lower end of the side frame 145 at the inside. Also, the rear surface 1444 may support the lower end of the door liner 147 at a front side.

As described above, a closed space 1440 may be defined by the front plate 141, the side frame 145, and the door liner 147, which are coupled to the front surface 1442, both the side surfaces 1443, and the rear surface 1444 of the lower cap decor 144, and the insulator 400 may be filled in the space 1440.

A lower plate coupling portion 1442*a* supporting the front plate 141 at the rear side may be disposed on the front surface of the lower cap decor 144. The lower plate coupling portion 1442*a* may extend from a left end to a right end of the front surface and may protrude slightly forward to support the front plate 141 at the rear side. Also, a plurality of screws passing through the front plate 141 may be coupled.

A lower support end 1445 extending forward may be disposed on a lower end of the front surface 1442 of the lower cap decor 144. The lower support end 1445 may extend so that the bottom surface 1441 of the lower cap decor 144 passes through a lower end of the front surface 1442 of the lower cap decor 144.

The lower support end 1445 may protrude to support the lower end of the panel assembly 50, and a protruding length of the lower support end 1445 may be less than the thickness of the panel assembly 50. Thus, exposure of the lower support end 1445 when viewed from the front side may be minimized so that the entire front surface of the door 20 is defined by the panel assembly 50.

A lower protrusion 1445*a* protruding upward may be disposed on a lower end of the lower support end 1445. The lower protrusion 1445*a* may be inserted into a lower bracket 154 to be described below to restrict the lower end of the panel assembly 50.

A plurality of lower protrusions 1445*a* may be disposed at a regular interval along the lower support end 1445. Also, the lower protrusions 1445*a* may be spaced apart from the front surface of the lower cap decor 144. An opening 1445*c* may be defined in the lower support end 1445 between the lower protrusion 1445*a* and the front surface 1442. When the lower cap decor 144 is injection-molded, the lower protrusion 1445*a* may be molded by the opening 1445*c*.

Also, a plurality of lower coupling holes 1445*b* may be defined in the lower support end 1445. The lower coupling hole 1445*b* may be defined so that a lower coupling member 1545*b* coupled by passing through the lower support end 1445 at the lower side passes therethrough. The lower coupling member 1545*b* may be coupled to the lower bracket 154 through the lower coupling hole 1445*b*, and a lower end of the panel assembly 50, which is seated on the lower support end 1445, may be securely fixed.

Figure 29:
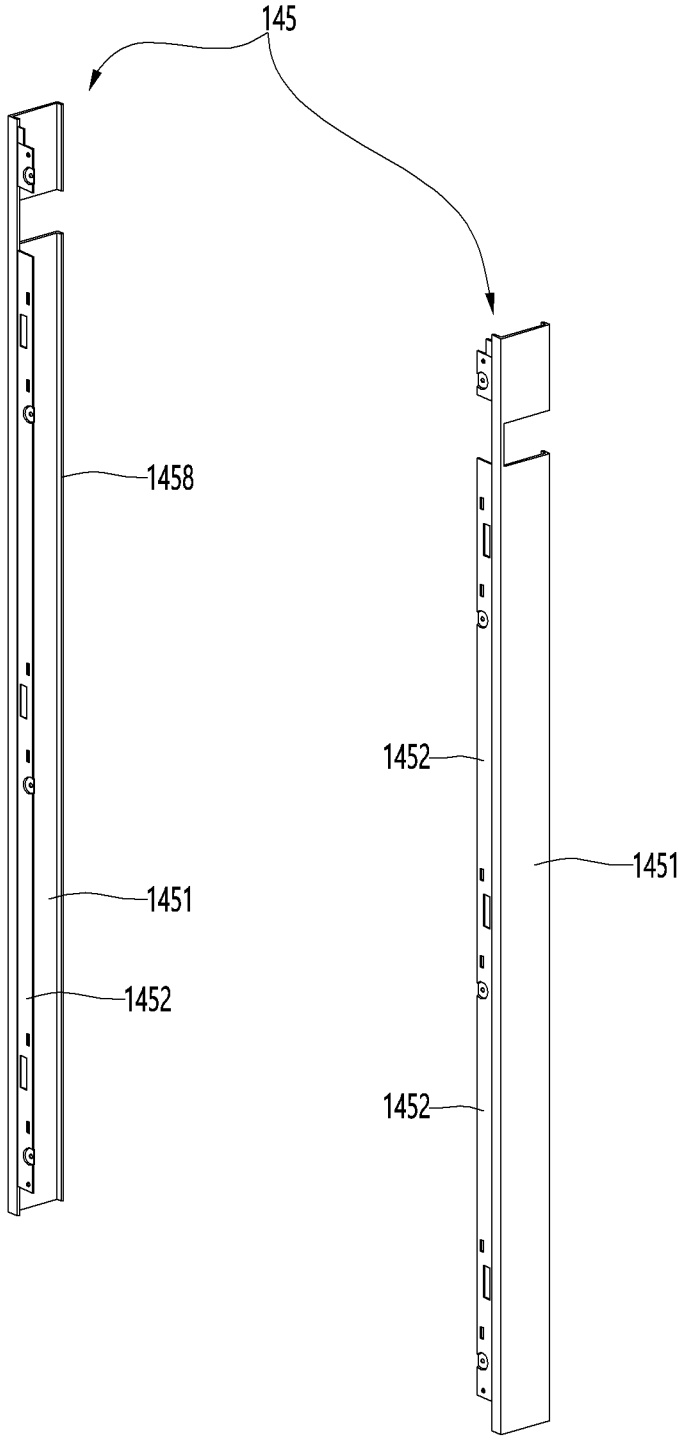
FIG. 29 is a perspective view of a side frame that is one component of the door body.

FIG. 29 is a perspective view of the side frame that is one component of the door body.

As illustrated in the drawing, the side frame 145 may connect the upper cap decor 142 to the lower cap decor 144 and simultaneously may connect the front plate 141 to the door liner 147. Also, the side frame 145 may define both side surfaces of the door body 40.

The side frame 145 may extend lengthily in the vertical direction and may be formed through extrusion of a metal material. For example, the side frame 145 may be made of an aluminum material. Thus, the side frame 145 may allow an outer appearance of a side surface of the door 20 to be more luxurious. Also, the side frame 145 may reinforce strength of the door 20 to prevent the door 20 from being deformed.

The side frames 145 at both left and right sides may have the same shape and may be disposed in a direction facing each other. That is, the side frames 145 disposed on both sides may be disposed to be symmetrical horizontally with respect to the center of the door body 40. Thus, to avoid overlapping descriptions, the side frame 145 on one of both the left and right sides will be described.

Referring to the detailed structure of the side frame 145, the side frame 145 may include a frame side surface 1451, a frame front surface 1452, and a front rear surface 1458.

In detail, the frame side surface 1451 may define a surface exposed to a side of the door body 40 and be provided in a flat shape. An upper end of the frame side surface 1451 may be in contact with the upper cap decor 142, and a lower end of the frame side surface 1451 may be in contact with the lower cap decor 144.

Also, the frame front surface 1452 may extend inward from a front end of the frame side surface 1451. The frame front surface 1452 may support both left and right side ends of the front plate 141. The frame front surface 1452 may extend from an upper end to a lower end of the side frame 145 and be disposed perpendicular to the frame side surface 1451.

Hereinafter, the panel assembly 50 will be described in more detail with reference to the drawings.

Figure 30:
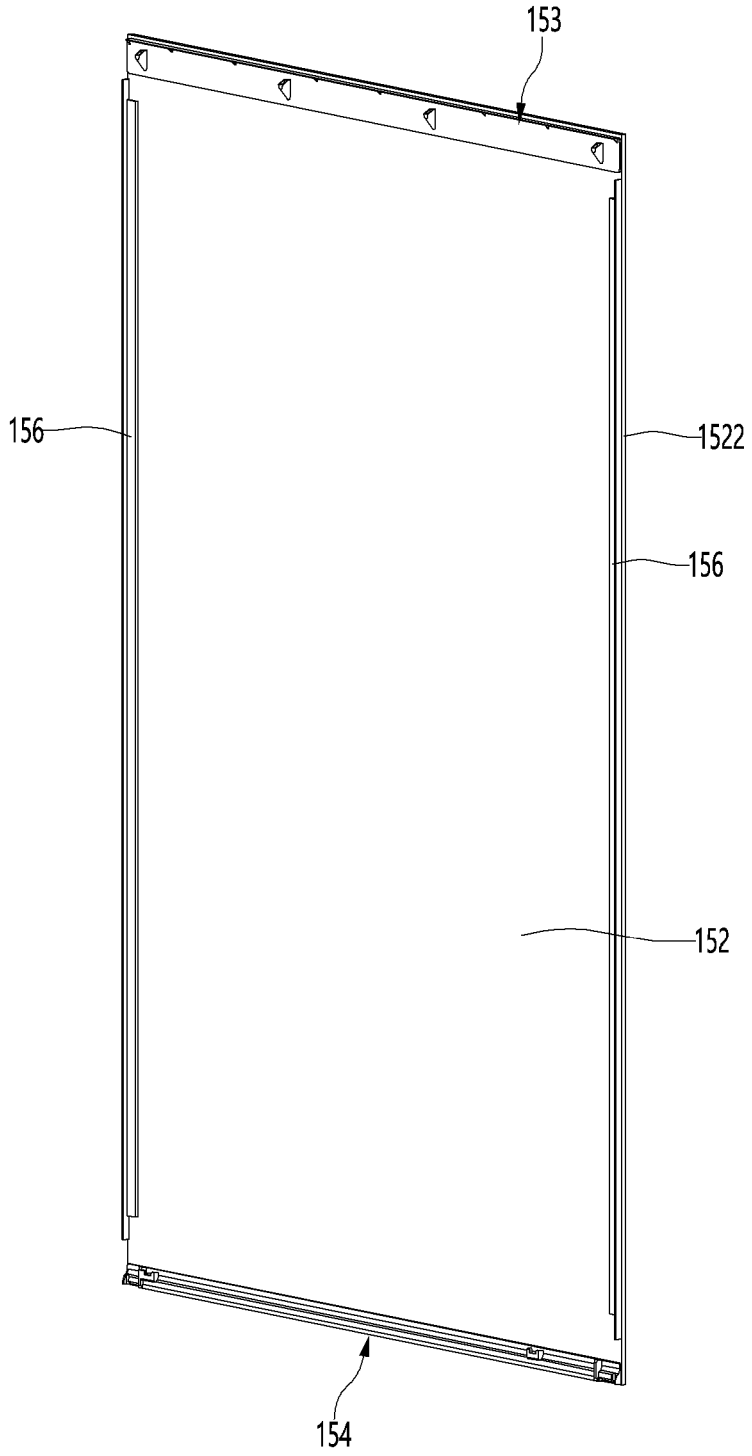
FIG. 30 is a rear perspective view of a panel assembly that is one component of the door.
Figure 31:
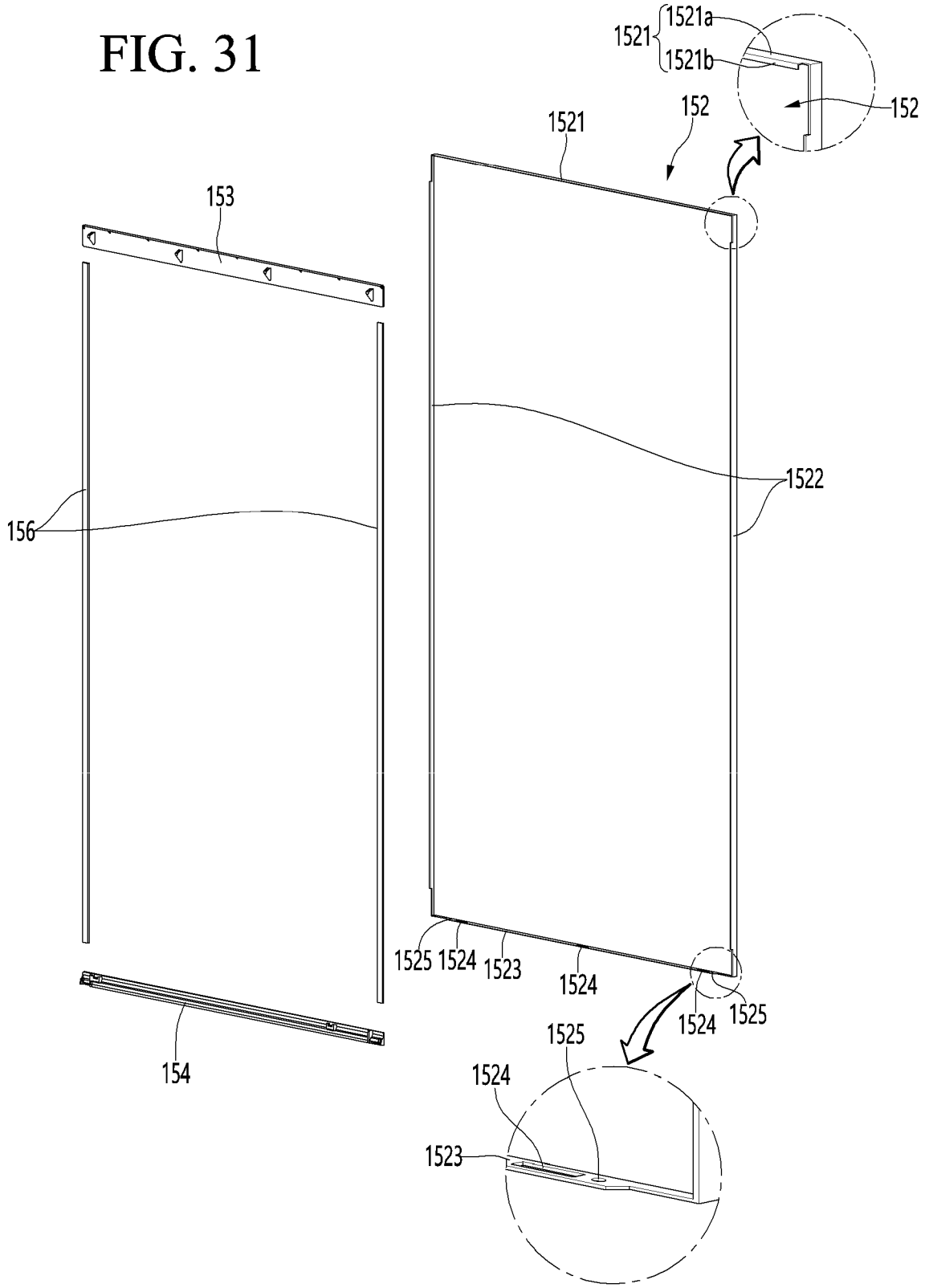
FIG. 31 is an exploded perspective view of the panel assembly.

FIG. 30 is a rear perspective view of the panel assembly that is one component of the door. FIG. 31 is an exploded perspective view of the panel assembly.

As illustrated in the drawing, the panel assembly 50 may have a size corresponding to that of a front surface of the door body 40 and be configured to define an outer appearance of an entire front surface of the door 20 in a state of being mounted on the door body 40.

The panel assembly 50 may include a plate-shaped panel 152 defining an outer appearance and upper and lower brackets 153 and 154 for fixing upper and lower ends of the panel 152. Also, the panel assembly 50 may further include a magnet 156 so that a rear surface of the panel 152' and a front surface of the door body 40 are attached to each other.

In detail, the panel 152 may be made of a rectangular plate-shaped material having a predetermined thickness and may be made of a material that is capable of being harmonized with the furniture or wall O or the home appliance disposed therearound.

For example, the panel 152 may be made of a plate-shaped metal material such as stainless steel. Also, printing, coating treatment, or film attachment may be performed on the front surface of the panel 152 to have a color or pattern, thereby defining the outer appearance of the door 20.

The panel 152 may be maintained in a stable support state when mounted on the door body 40, and bent portions 1521, 1522, and 1523 may be disposed along a circumference so that a cross-section of the panel 152 is not exposed to the outside. Thus, the outer appearance of the circumferential surface of the panel 152 may be defined by the bent portions 1521, 1522, and 1523. Also, when the panel assembly 50 is mounted, the panel assembly 50 may be in contact with or disposed adjacent to an upper support end 1422 of the upper cap decor 142, a lower support end 1445 of the lower cap decor 144, and a side support end 1451*a* of the side frame 145. Also, an extending length of each of the bent portions 1521, 1522, and 1523, i.e., a thickness of the circumferential surface of the panel 152 may be greater than a protruding height of each of the upper support end 1422, the lower support end 1445, and the side support end 1451*a*. Thus, when viewed from a front side, the entire outer appearance of the front surface of the door 20 may be visible by the panel 152, and the upper support end 1422, the lower support end 1445, and the side support end 1451*a* may be prevented from being prominently exposed to the outside.

Each of the bent portions 521, 522, and 523 may include an upper bent portion 1521 disposed on a circumference of an upper end of the panel 152, a side bent portion 1522 disposed on each of both left and right ends of the panel 152, and a lower bent portion 1523 disposed on a circumference of a lower end of the panel 152.

In detail, the upper bent portion 1521 includes a first bent portion 1521*a* that is bent rearward from an upper end of the panel 152 and a second bent 1521*b* downward from the extending end of the first bent portion 1521*a*. Thus, when the panel assembly 50 is mounted, a sharp end of the panel 152 may be prevented from being in direct contact with the upper cap decor 142 by the second bent portion 1521*b* to prevent the upper cap decor 142 from being damaged.

The side bent portion 1522 may be bent backward from each of both left and right side ends of the panel 152 and also may protrude backward by the same height as each of the upper bent portion 1521 and the lower bent portion 1523.

The lower bent portion 1523 may be bent backward from the lower end of the panel 152. Also, the lower bent portion 1523 may have a bent portion opening 1524 into which the lower protrusion 1445*a* is inserted. The bent portion opening 1524 may be defined along the lower bent portion 1523 and may be provided in plurality at positions corresponding to the plurality of lower protrusions 1445*a* protruding from the lower support end 1445. Also, a bent portion screw hole 1525 may be further defined in the lower bent portion 1523. The bent portion screw hole 1525 may be a hole through which the lower coupling member 1545*b* coupled to the lower bracket 154 passes and be provided in plurality at positions corresponding to the lower coupling boss 1545 of the lower bracket 154.

Also, an upper bracket 153 and a lower bracket 154 may be provided on upper and lower ends of the rear surface of the panel 152, respectively. The upper bracket 153 and the lower bracket 154 may be configured so that the upper and lower ends of the panel assembly 50 are fixedly mounted to the door body 40.

The upper bracket 153 and the lower bracket 154 may extend along upper and lower ends of the panel 152, respectively, and each of the upper bracket 153 and the lower bracket 154 may have a length corresponding to a horizontal width of the panel 152. Also, when the panel assembly 50 is mounted, the panel assembly 50 may be coupled to each of the upper cap decor 142 and the lower cap decor 144.

Also, a magnet 156 may be provided at each of both left and right ends of the panel 152. The magnet 156 may be attached to the rear surface of the panel 152 by an adhesive or magnetic force. The magnet 156 may extend from an upper end to a lower end of the panel 152. Also, when the panel assembly 50 is mounted on the door body 40 in a state in which the magnet is attached to the panel 152 the magnet 156 may be attached to the front panel 152 by the magnetic force. That is, the mounting of the panel assembly 50 may be assisted by the magnet 156.

Hereinafter, the structure of the upper bracket 153 will be described in detail with reference to the drawings.

Figure 32:
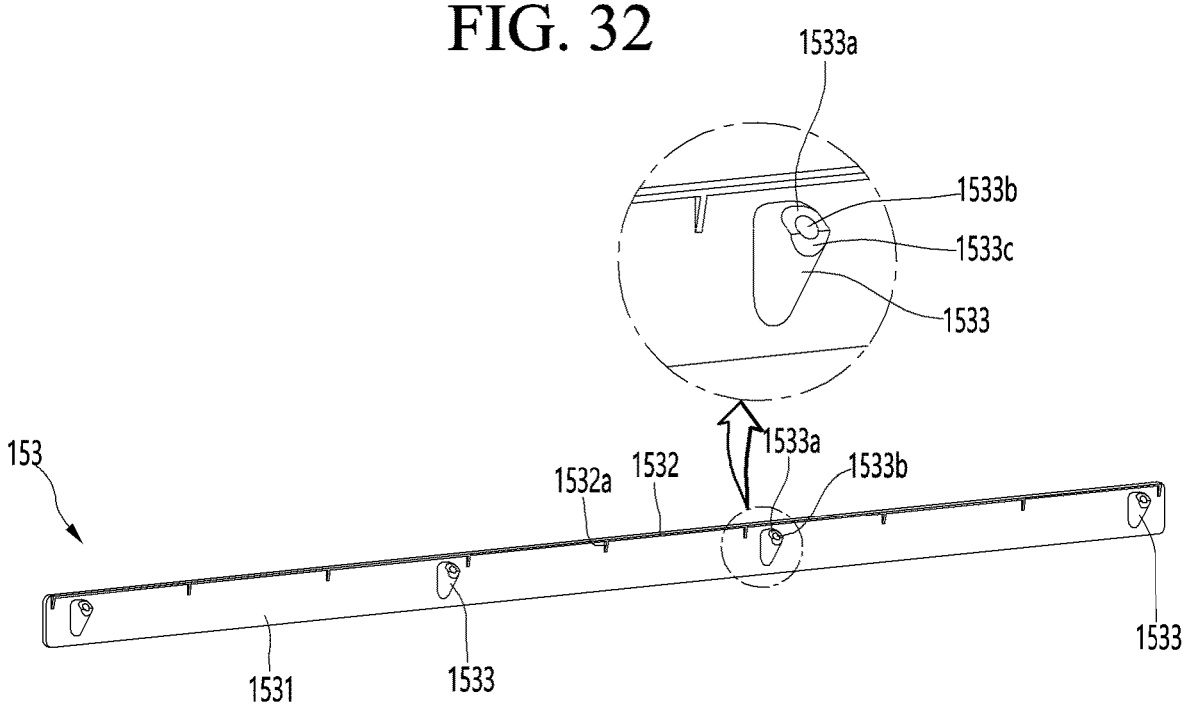
FIG. 32 is a perspective view of an upper bracket that is one component of the panel assembly.
Figure 33:
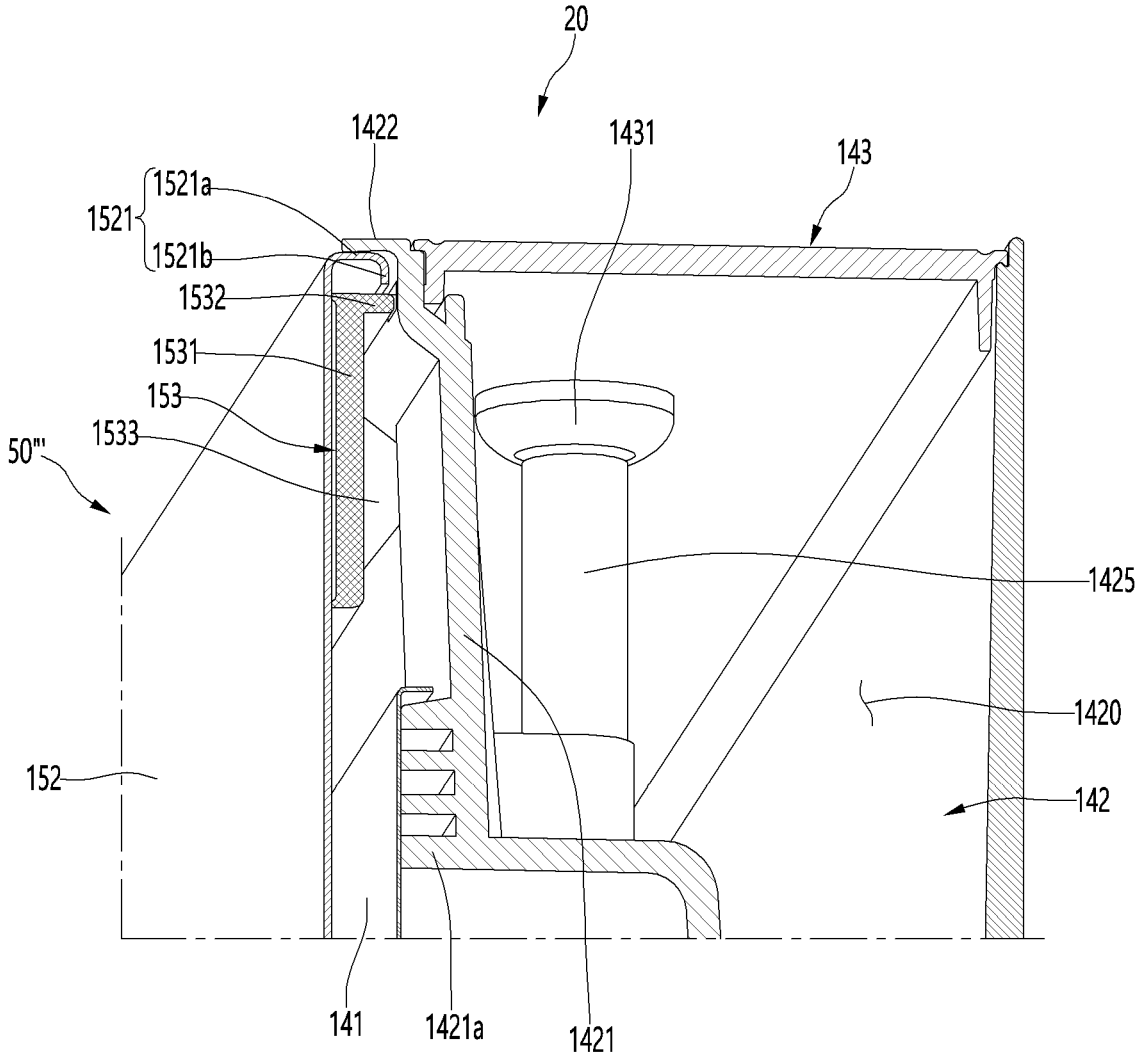
FIG. 33 is a cutaway perspective view taken along line XXXIII-XXXIII' of FIG. 22.
Figure 34:
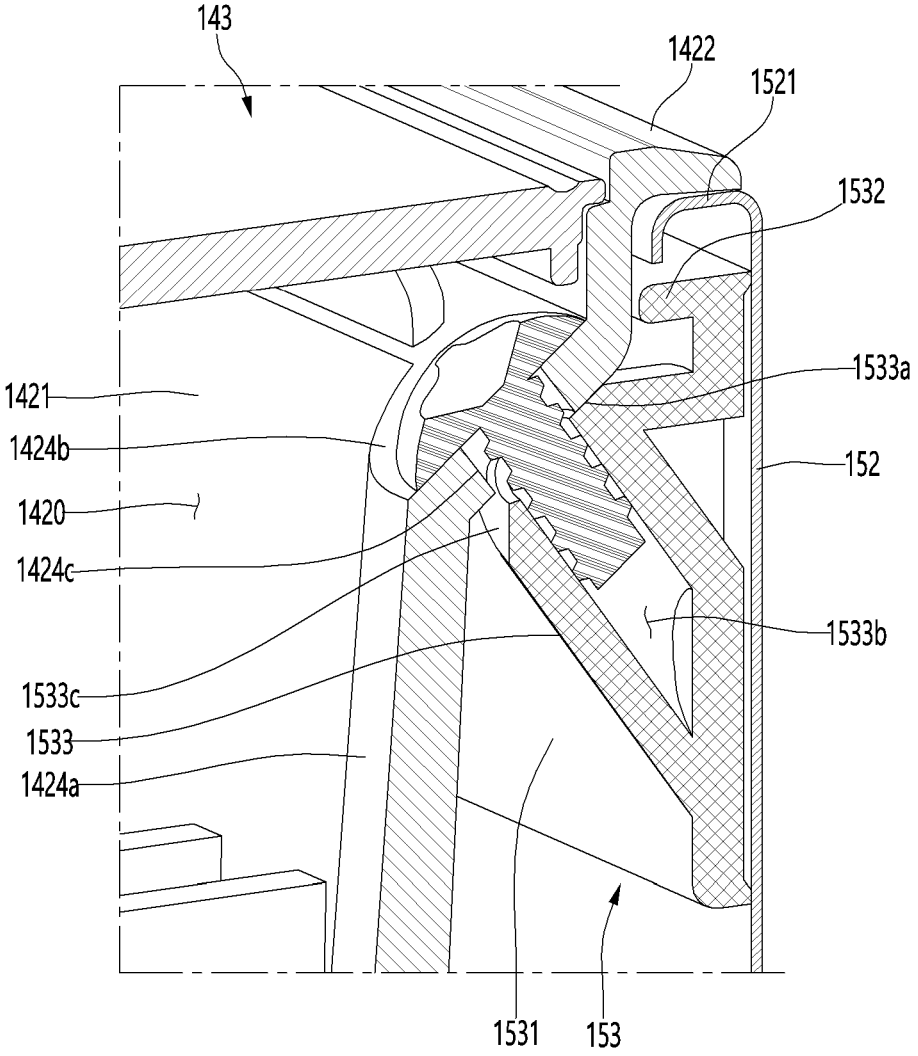
FIG. 34 is a cutaway perspective view taken along line XXXIV-XXXIV' of FIG. 22.

FIG. 32 is a perspective view of the upper bracket that is one component of the panel assembly. Also, FIG. 33 is a cutaway perspective view taken along line XXXIII-XXXIII' of FIG. 22. Also, FIG. 34 is a cutaway perspective view taken along line XXXIV-XXXIV' of FIG. 22.

As illustrated in the drawings, the upper bracket 153 may be mounted on an upper end of the panel 152 and may have a length corresponding to a horizontal width of the panel 152. In addition, the upper bracket 153 may be injection-molded by using a plastic material and may include an upper adhesion portion 1531 having a planar shape, an upper rib 1532 at an upper end of the upper adhesion portion 1531, and an upper coupling protrusion 1533 provided on the upper adhesion portion 1531.

In detail, a front surface of the upper adhesion portion 1531 may be provided in a planar shape and may adhere to the upper end of the rear surface of the panel 152. Here, an adhesive may be applied to the front surface of the upper adhesion portion 1531, and the upper bracket 153 may be firmly fixed to the panel 152 by the adhesive.

The upper bracket 153 may have a predetermined vertical width, the upper rib 1532 may be disposed on the upper end of the upper adhesion portion 1531, and the first bracket 53 may have a width so that the upper coupling protrusion 1533 is disposed below the upper rib 1532. Also, the upper end of the upper bracket 153 may be disposed at a position adjacent to the upper end of the panel 152 and may be disposed at a slightly spaced position so as not to interfere with the upper support end 1422.

The upper rib 1532 may be disposed along an upper end of the upper bracket 153. Also, the upper rib 1532 may protrude backward and be in contact with the front surface of the upper cap decor 142. Thus, the upper end of the panel assembly 50 may be supported by the upper cap decor 142. Also, in the state in which the upper rib 1532 is in contact with the front surface of the upper cap decor 142, the upper coupling protrusion 1533 may be in contact with the upper coupling portion 1424 to facilitate the coupling of the upper coupling member 1424*d*.

A reinforcing portion 1532*a* connecting the upper rib 1532 to the upper adhesion portion 1531 may be disposed on a bottom surface of the upper rib 1532. A plurality of reinforcing portions 1532*a* may be continuously disposed at predetermined intervals along the upper rib 1532.

The upper coupling protrusion 1533 may protrude backward from the rear surface of the upper adhesion portion 1531 and may protrude from a position corresponding to the upper coupling portion 1424 of the upper cap decor 142. The upper coupling protrusion 1533 may protrude further backward than the upper rib 1532 and may be in contact with the upper coupling portion 1424 when the panel assembly 50 is mounted.

In detail, the upper coupling protrusion 1533 may protrude from the upper adhesion portion 1531 so as to be inclined backward and upward. Also, the upper coupling protrusion 1533 may have a cross-section that gradually decreases backward.

Also, the upper coupling protrusion 1533 may be inserted into the upper extension portion 1424*a* disposed on the front surface of the upper cap decor 142 when the panel assembly 50 is coupled. That is, the upper coupling protrusion 1533 may correspond to a recessed shape of the upper extension portion 1424*a*.

A protrusion inclined surface 1533*a* disposed to be inclined may be disposed on a top surface of the upper coupling protrusion 1533. The protrusion inclined surface 1533*a* may have a downward inclination that gradually decreases backward. Also, the protrusion inclined surface 1533*a* may have an inclination corresponding to the upper inclined surface 1424*b*. Thus, in a state in which the panel assembly 50 is accurately mounted on the front surface of the door body 40, the protrusion inclined surface 1533*a* may be in close contact with the upper inclined surface 1424*b*.

Also, the screw hole 1533*b* may be defined in the protrusion inclined surface 1533*a*. An upper coupling member 1424*d* passing through the upper coupling portion 1424 may be coupled to the screw hole 1533*b*. Thus, when the upper coupling member 1424*d* is coupled to pass through the upper coupling portion 1424 in the state in which the upper end of the panel assembly 50 is disposed on the front surface of the door body 40, the upper coupling member 1424*d* may be coupled to the screw hole 1533*b* of the upper coupling protrusion 1533 so that the protrusion inclined surface 1533*a* and the upper inclined surface 1424*b* are in close contact with each other. In this state, the upper end of the panel assembly 50 may be firmly fixed to the door body 40.

Also, an evacuation portion 1533*c* may be further disposed in the top surface of the upper coupling member 1424*d*. The evacuation portion 1533*c* may be shaped to be stepped on the top surface of the upper coupling member 1424*d*. In detail, the evacuation portion 1533*c* may be inclined downward from the rear end of the protrusion inclined surface 1533*a*. Here, the inclination of the evacuation portion 1533*c* may have a greater than that of the protrusion inclined surface 1533*a*, and thus, when the panel assembly 50 is mounted on the door body 40, the upper cap decor 142 may not interfere with the protruding portion of the upper coupling member 1424*d*.

The upper bracket 153 may be disposed at an upper end of the panel 152, and a height from the upper end of the panel 152 to the upper bracket 153 may be greater than a height from the upper end of the panel 152 to the gasket 148.

Thus, the upper bracket 153 may be disposed substantially outside the gasket 148, and thus, the thermal insulation performance of the storage space may not be affected. That is, even if the corresponding front surface of the upper cap decor 142 is inclined and recessed to provide a structure having a relatively thin thickness due to the mounting of the upper bracket 153, the corresponding position may not be affected by cold air within the refrigerator, and thus, dew condensation may not be generated, and also, the thermal insulation performance of the door 20 may not be deteriorated. That is, the upper bracket 153 may be disposed outside the gasket 148 and also be disposed outside a thermal insulation region.

Hereinafter, the structure of the lower bracket 154 will be described in more detail with reference to the drawings.

Figure 35:
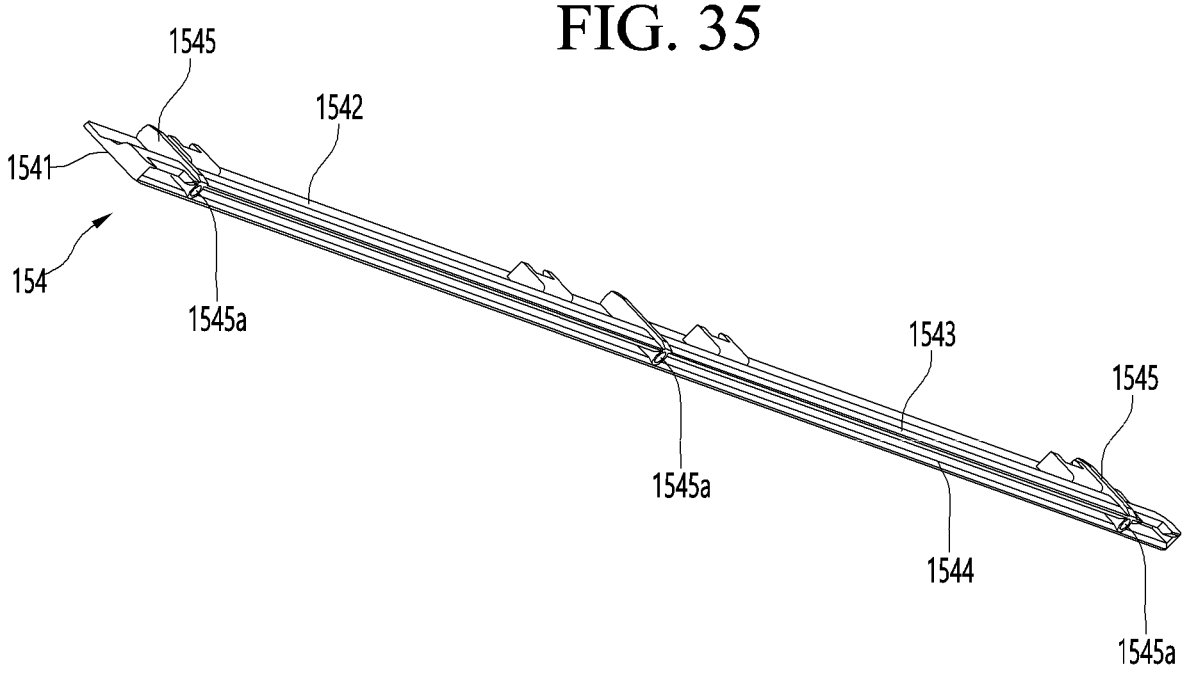
FIG. 35 is a perspective view of a lower bracket that is one component of the panel assembly.
Figure 36:
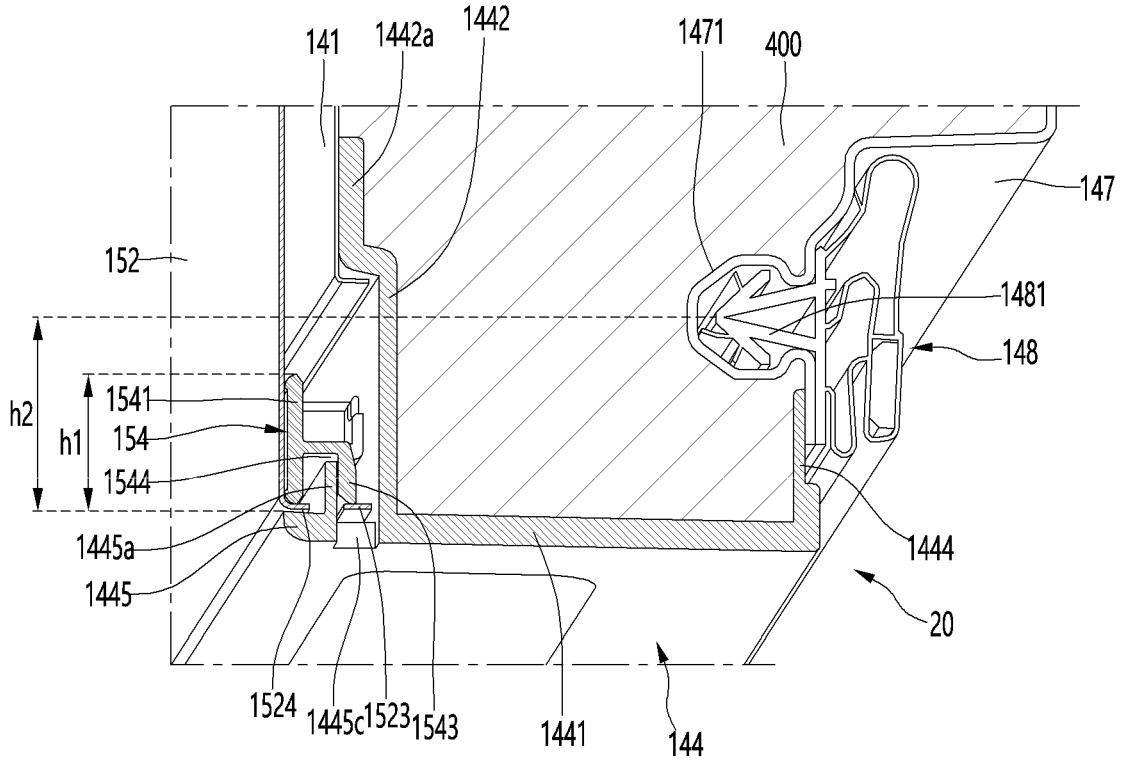
FIG. 36 is a cutaway perspective view taken along line XXXVI-XXXVI' of FIG. 22.
Figure 37:
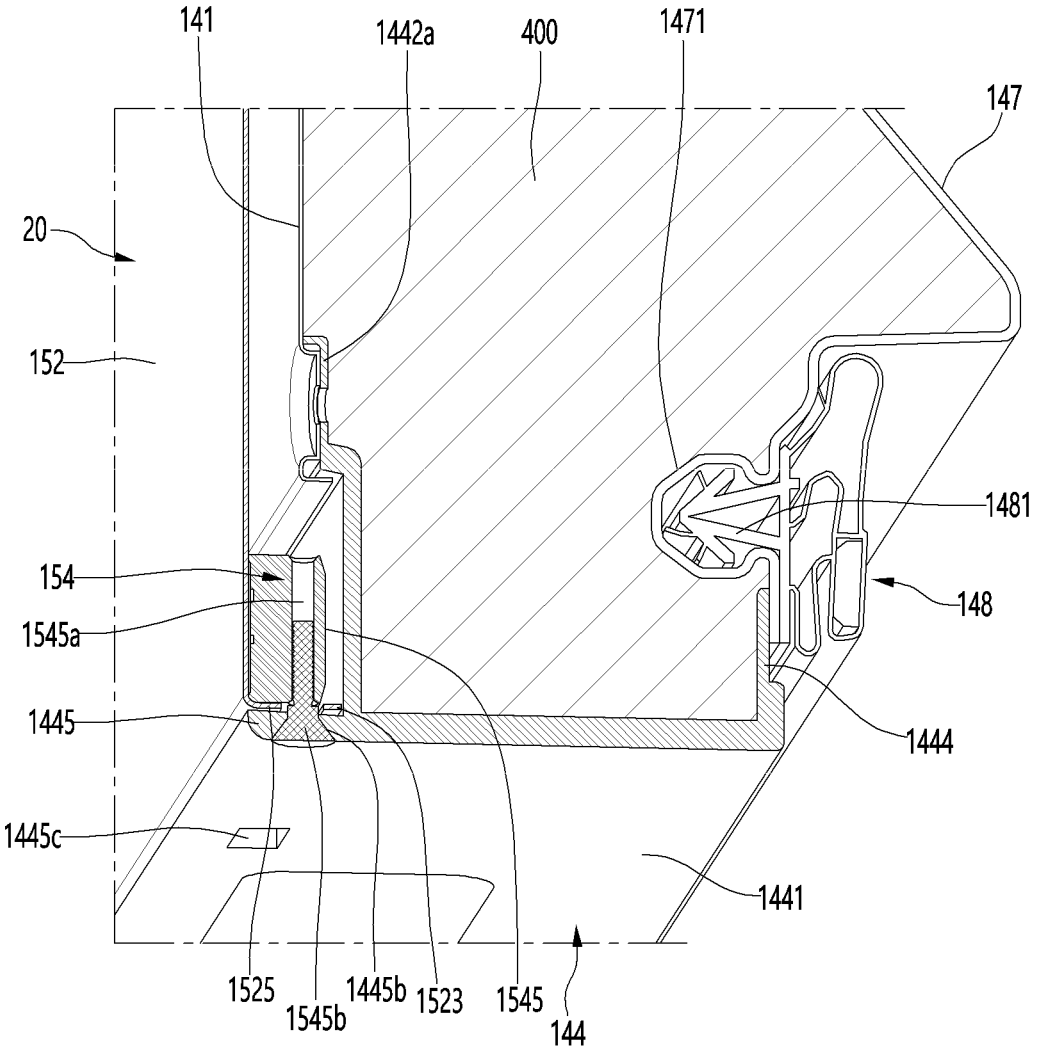
FIG. 37 is a cutaway perspective view taken along line XXXVII-XXXVII' of FIG. 22.

FIG. 35 is a perspective view of the lower bracket that is one component of the panel assembly. Also, FIG. 36 is a cutaway perspective view taken along line XXXVI-XXXVI' of FIG. 22. Also, FIG. 37 is a cutaway perspective view taken along line XXXVII-XXXVII' of FIG. 22.

As illustrated in the drawings, the lower bracket 154 may be injection-molded by using a plastic material and may be provided on the lower end of the panel 152. Also, the lower bracket 154 may extend to a length corresponding to the horizontal width of the panel 152. Also, the lower bracket 154 may to have a vertical width at which at least a lower coupling boss 1545 is disposed.

The lower bracket 154 may be hooked to be restricted by the lower cap decor 144, and a lower coupling member 1545*b* passing through the lower cap decor 144 may be coupled, and thus, the lower end of the panel assembly 50 may be firmly fixed to the door body 40. For example, the lower coupling member 1545*b* may be a screw.

In detail, the lower bracket 154 may be provided with a lower adhesion portion 1541 mounted on the rear surface of the panel 152. The lower adhesion portion 1541 may be provided in a flat shape and may be attached to the rear surface of the panel 152 by an adhesive. The lower bracket 154 may be disposed at a position corresponding to the lower end of the panel 152 in a state in which the lower adhesion portion 1541 is attached to the rear surface of the panel 152.

Also, a lower protrusion 1543 protruding backward from the lower adhesion portion 1541 may be disposed backward from the lower adhesion portion 1541. The lower protrusion 1543 may extend from one side of the lower adhesion portion 1541 to a position corresponding to the lower end of the lower adhesion portion 1541.

A lower insertion portion 1544 having an opened bottom surface may be disposed on a bottom surface of the lower protrusion 1543. That is, the lower insertion portion 1544 may be provided in a shape that is recessed downward from the bottom surface of the lower bracket 154 so that the lower protrusion 1445*a* of the lower cap decor 144 is inserted. The lower insertion portion 1544 may be disposed over the entire bottom surface of the lower bracket 154. Also, the lower insertion portion 1544 may be defined at a position facing the bent portion opening 1524 defined in the lower bent portion 1523 of the panel 152.

Thus, when the panel assembly 50 is mounted at a fixed position of the door body 40, the lower protrusion 1445*a* may be inserted into the lower insertion portion 1544 by passing through the bent portion opening 1524, and the lower end of the panel assembly 50 may be fixed. The state in which the lower protrusion 1445*a* is inserted into the bent portion opening 1524 and the lower insertion portion 1544 may be referred to as a temporarily fixed state because of a re-detachable state when the panel assembly 50 is lifted before the coupling members 424*d* and 545*b* are coupled.

A lower coupling boss 1545 may be disposed on the lower adhesion portion 1541. The lower coupling boss 1545 may protrude from a rear surface of the lower adhesion portion 1541 to extend from the lower end to upper end of the lower bracket 154.

Also, a screw hole 1545*a* may be defined in a bottom surface of the lower coupling boss 1545. The lower coupling boss 1545 may pass through the lower protrusion 1543 to extend downward. Thus, the screw hole 1545*a* defined in the top surface of the lower coupling boss 1545 may be disposed at a position corresponding to the position of the opened bottom surface of the lower insertion portion 1544.

The screw hole 1545*a* may be defined at a position corresponding to the screw hole 1445*b* defined in each of the lower cap decor 144 and the bent portion screw hole 1525 defined in the lower bent portion 1523. Thus, the lower coupling boss 1545 may be disposed at a position corresponding to each of the bent portion screw hole 1525 and the screw hole 1445*b* and may be provided as many as a corresponding number. For example, three lower coupling bosses 1545 may be provided on a center and both left and right sides of the lower bracket 154, respectively.

When the panel assembly 50 is mounted on the door body 40 so that the lower protrusion 1445*a* is inserted into the bent portion opening 1524 and the insertion portion 1544, the screw hole 1445*b* of the lower cap decor 144, the bent portion screw hole 1525, and the screw hole 1545*a* may be aligned with each other. In this state, when the screw 1545*b* is coupled to pass through the screw hole 1445*b* of the lower cap decor 144 and the bent portion screw hole 1525, the screw 1545*b* may be coupled to the screw hole 1545*a* of the lower bracket 154 so that the lower end of the panel assembly 50 is firmly fixed to the lower bracket 154.

The lower bracket 154 may be disposed at the lower end of the panel 152, and a height h1 from the lower end of the panel 152 to the lower bracket 154 may be less than a height h2 of the gasket. Here, the height of the gasket 148 may be a height from the lower end of the panel 152 to a center of the gasket mounting portion 1481.

Thus, the lower bracket 154 may be disposed substantially outside the gasket 148, and thus, the thermal insulation performance of the storage space may not be affected. That is, even if the corresponding front surface of the lower cap decor 144 is recessed to provide a structure having a relatively thin thickness due to the mounting of the lower bracket 154, the corresponding position may not be affected by cold air within the refrigerator, and thus, dew condensation may not be generated, and also, the thermal insulation performance of the door 20 may not be deteriorated. That is, the lower bracket 154 may also be disposed outside the thermal insulation region outside the gasket 148 to prevent the thermal insulation performance of the door 20 from being deteriorated.

Hereinafter an arrangement structure of the magnet 156 will be described in more detail with reference to the drawings.

Figure 38:
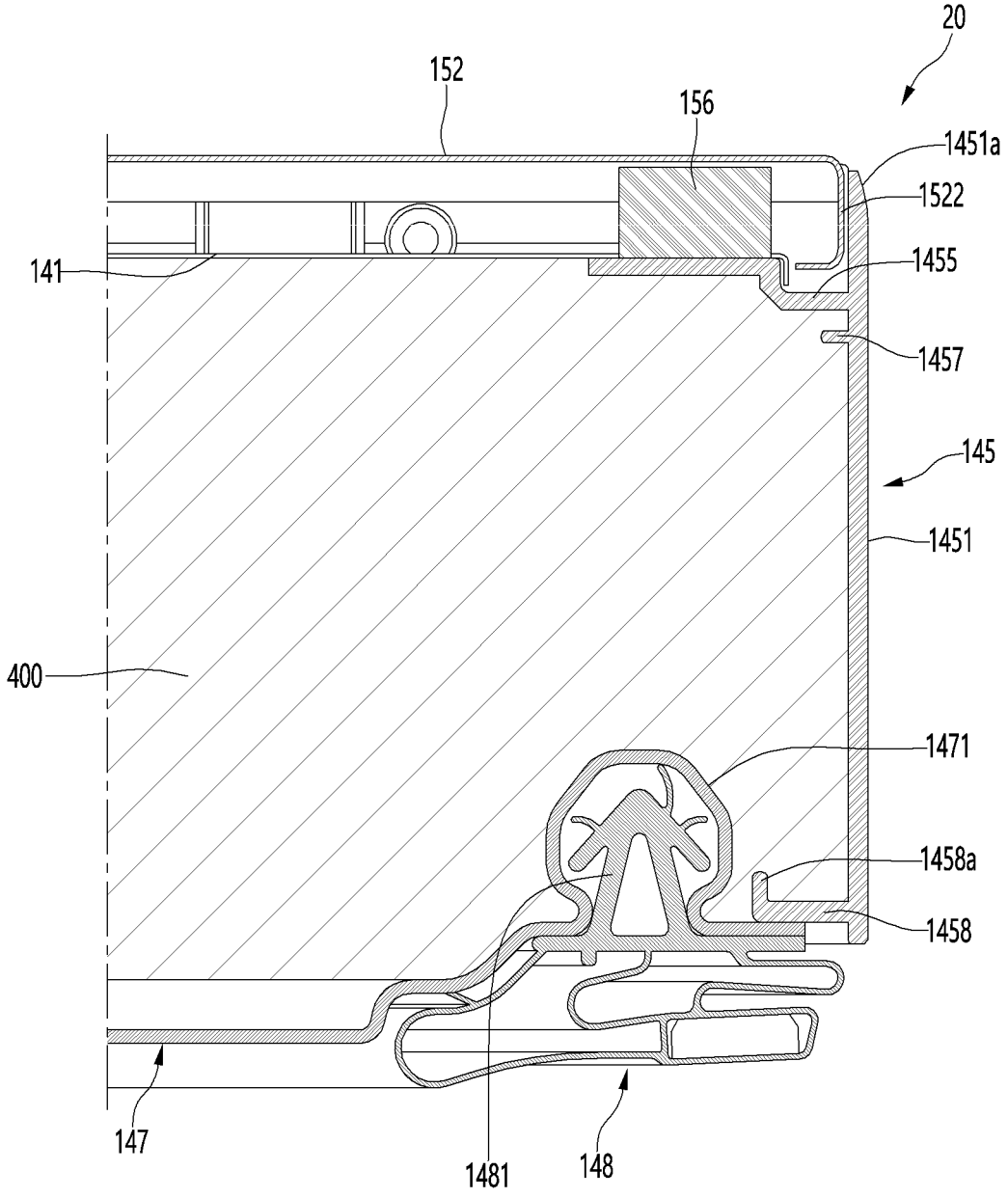
FIG. 38 is a cross-sectional view taken along line XXXVIII-XXXVIII' of FIG. 22.

FIG. 38 is a cross-sectional view taken along line XXXVIII-XXXVIII' of FIG. 22.

As illustrated in the drawing, a magnet 156 for assisting the mounting of the panel assembly 50 may be provided on the rear surface of the panel 152. The magnet 156 may extend lengthily in the vertical direction and may extends in the vertical direction along both left and right side ends of the panel 152.

One surface of the magnet 156 may adhere to the rear surface of the panel 152, and the other surface may be attached to the front plate 141 by magnetic force when the panel assembly 50 is mounted on the door body 40.

The magnet 156 may be disposed on each of the side portions on both sides of the front plate 141. Therefore, a thickness of the magnet 156 may correspond to a distance between the rear surface of the panel 152 and the front panel 152, i.e., front surfaces of the side portions when the panel assembly 50 is mounted.

The magnetic force may be applied to the panel assembly and the front plate 141 in a direction in which the panel assembly 50 and the front plate 141 are attractive with respect to each other. Thus, the panel assembly 50 may be maintained in a state of being further attached to the front surface of the door body 40.

Also, the magnet 156 may be disposed in a space between the panel assembly 50 and the front plate 141. Thus, the thickness of the door body 40 may not be affected, and the thermal insulation performance of the door 20 may not be deteriorated.

Hereinafter, a process in which the panel assembly 50 is mounted on the door 20 of the refrigerator 1 having the above structure will be described in more detail with reference to the drawings.

Figure 39:
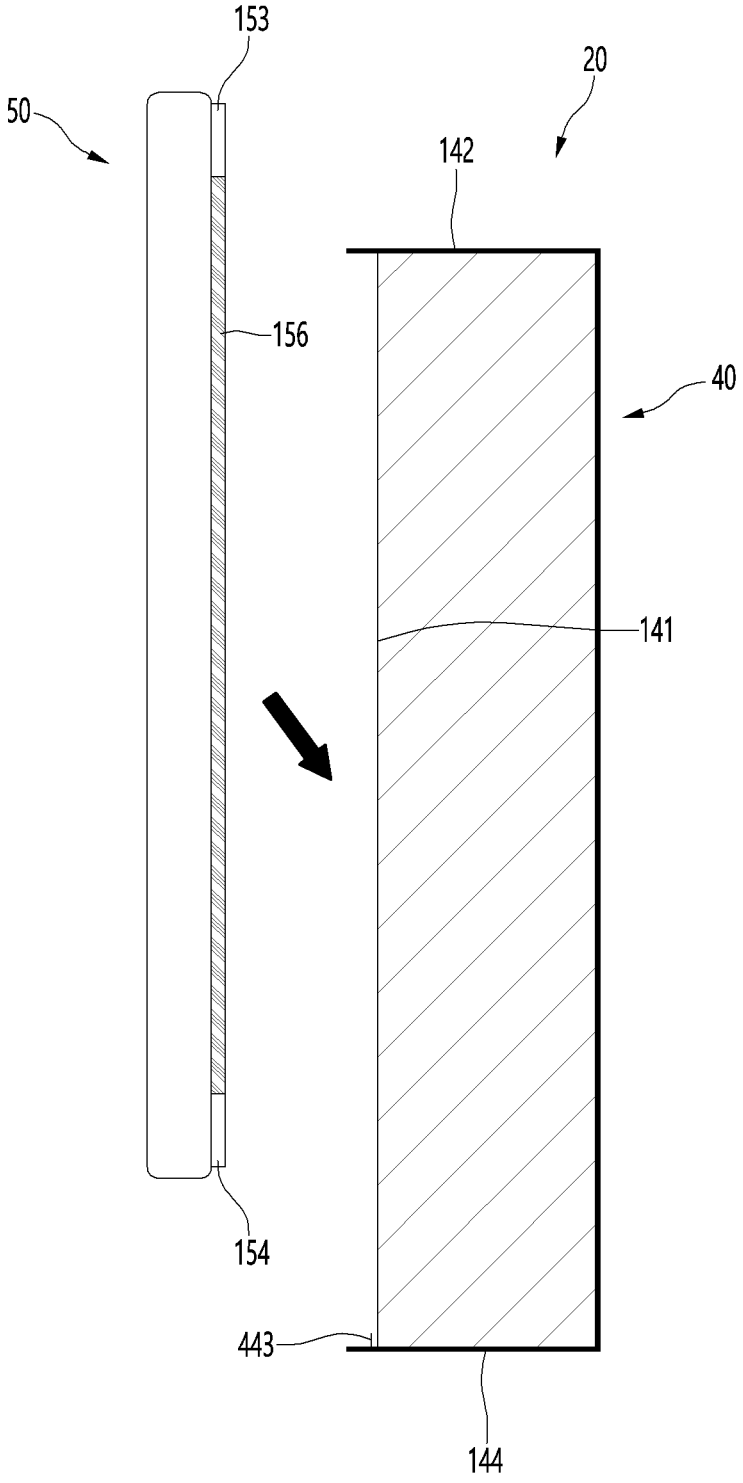
FIG. 39 is a schematic view illustrating a state before the panel assembly is mounted on the door body.

FIG. 39 is a schematic view illustrating a state before the panel assembly is mounted on the door body.

As illustrated in the drawing, the door 20 may be assembled by mounting the panel assembly 50 on the door body 40. For this, the panel assembly 50 may be completed by mounting the upper bracket 153 and the lower bracket 154 on the panel 152. Also, after assembling the front panel 152 and the side frame 145, and the upper cap decor 142, the lower cap decor 144, and the accommodation member 146, an insulator 400 may be molded to complete the door body 40.

Also, the panel assembly 50 may be disposed to be mounted on the front surface of the door body 40 in the assembled state. Here, the rear surface of the panel assembly 50 may be directed to the front surface of the door body 40. In detail, the panel assembly 50 may move backward from a front side to approach the front surface of the door body 40, and simultaneously, the panel assembly 50 may move to approach the front surface of the door body 40 while moving downward from an upper side.

Here, the lower protrusion 1445*a* of the lower support end 1445 may pass through the bent portion opening 1524 and then be inserted into the lower insertion portion 1544 to restrict the lower end of the panel assembly 50. Thus, the panel assembly 50 may be in a state in which the movement in the downward and forward/backward direction is restricted by the lower protrusion 1445*a* and the lower bracket 154.

That is, to mount the panel assembly 50, the panel assembly 50 may move to the front surface of the door body 40. Here, the lower end of the panel assembly 50 may be fixed to the lower support end 1445 of the lower cap decor 144.

As described above, the user may temporarily restrict the lower end of the panel assembly 50 to the door body 40 and then allow the upper end of the panel assembly 50 to be in close contact with the upper cap decor 142.

When the panel assembly 50 is mounted, a state of the upper end of the panel assembly 50 will be described in more detail with reference to the drawings.

Figure 40:
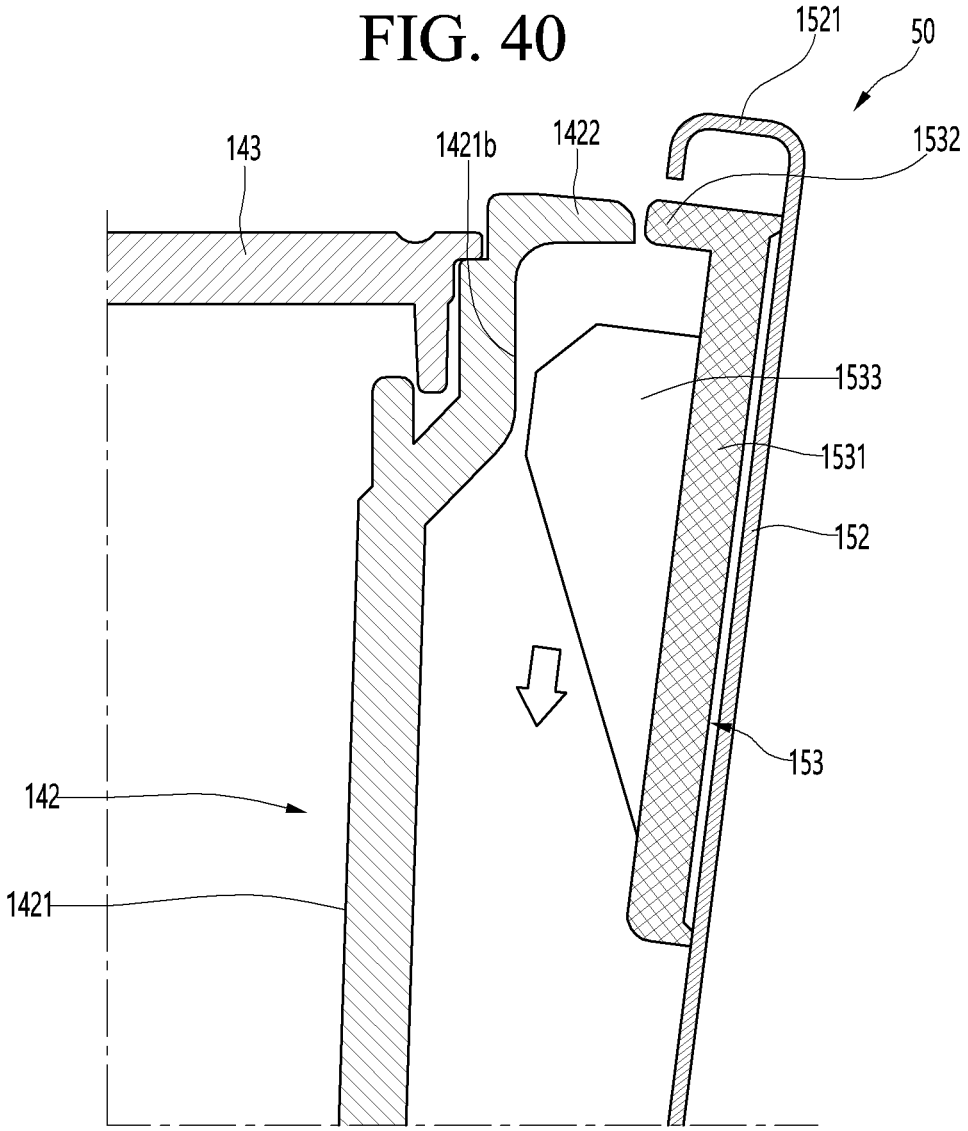
FIGS. 40 to 42 are views sequentially illustrating a change in position of the panel assembly when the panel assembly is mounted.
Figure 41:
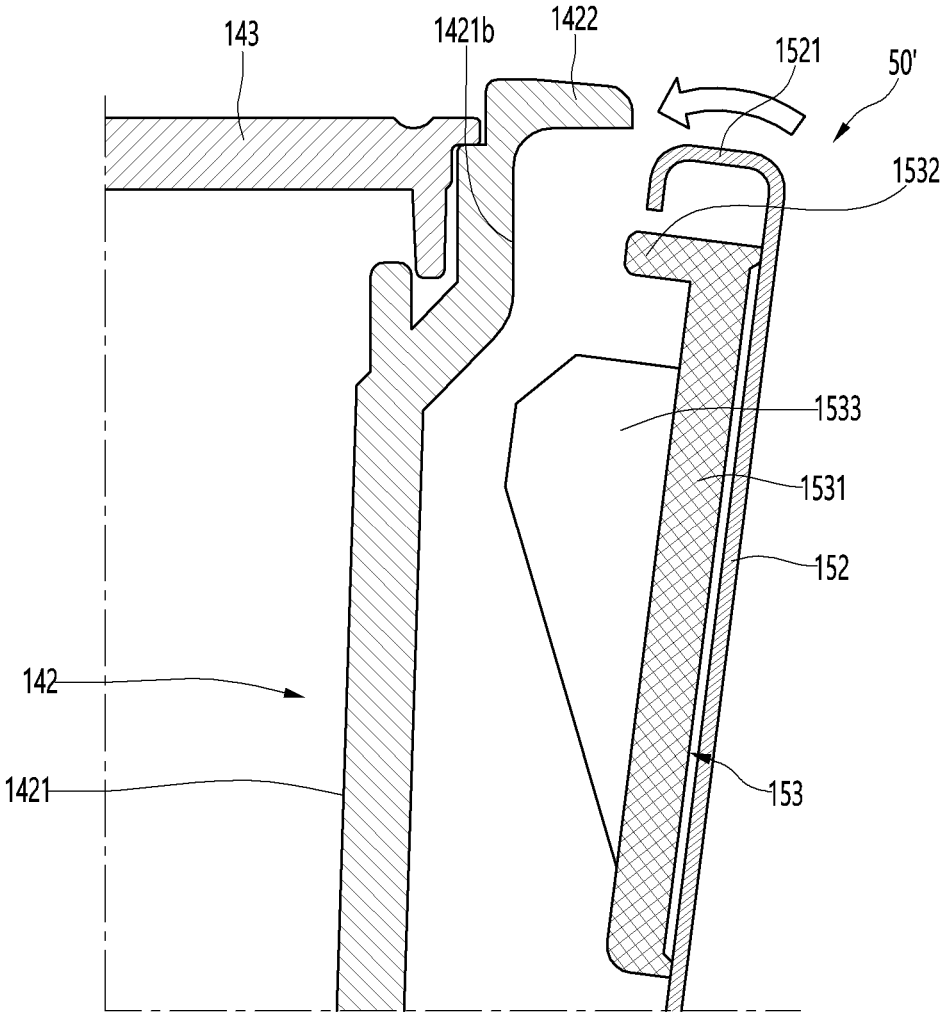
Figure 42:
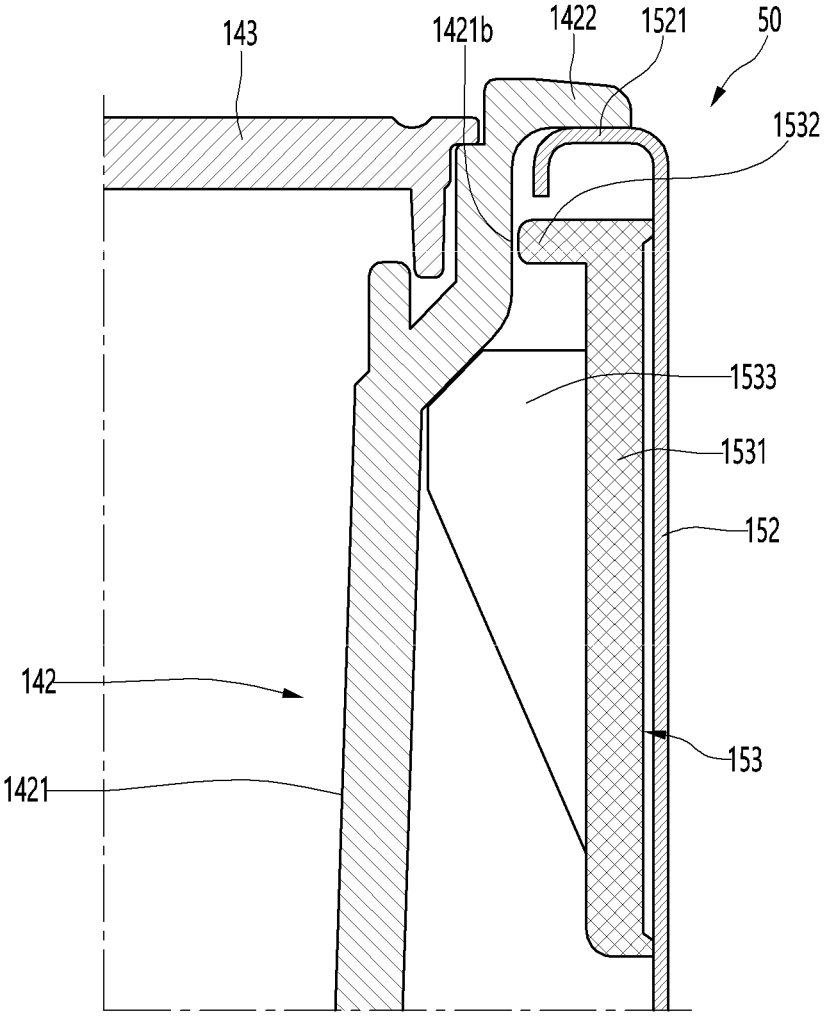

FIGS. 40 to 42 are views sequentially illustrating a change in position of the panel assembly when the panel assembly is mounted.

As illustrated in the drawings, when the panel assembly 50 is mounted, the lower protrusion 1445*a* may move downward to be inserted into the lower insertion portion 1544 of the lower bracket 154. Here, the lower end of the panel assembly 50 may move downward in a state of being inclined closer to the door body 40 than the upper end thereof, and the lower end of the panel assembly 50 may be temporarily fixed by being seated on the lower support end 1445.

Here, the upper end of the panel assembly 50 may move downward to pass through the upper support end 1422 as illustrated in FIG. 40. Also, an upper rib 1532 may protrude from an upper end of the rear surface of the panel assembly 50. The upper rib 1532 may protrude further backward than the upper bent portion 1521. Thus, the upper rib 1532 may be in contact with the upper support end 1422 while the panel assembly 50 moves downward. Thus, a sharp upper end of the panel 152 may be prevented from being in contact with the upper support end 1422 to prevent the upper support end 1422 from being scratched or damaged.

Also, when the lower protrusion 1445*a* is completely inserted into the lower insertion portion 1544, the upper end of the panel assembly 50 may be in a state as illustrated in FIG. 41, and the upper rib 1532 and the upper bent portion 1521 may be in a state of being disposed below the upper support end 1422.

In a state in which the lower end of the panel assembly 50 is supported by the lower support end 1445 and temporarily fixed, the user may allow the upper end of the panel assembly 50 to rotate to be in contact with the front surface of the upper cap decor 142.

When the upper end of the panel assembly 50 completely rotates, as illustrated in FIG. 42, the upper bent portion 1521 may be in contact with the upper support end 1422. Also, the upper bracket 153 may be in close contact with the upper cap decor 142, and the upper coupling protrusion 1533 may be in close contact with the upper coupling portion 1424 so that the upper coupling member 1424*d* is coupled.

Figure 43:
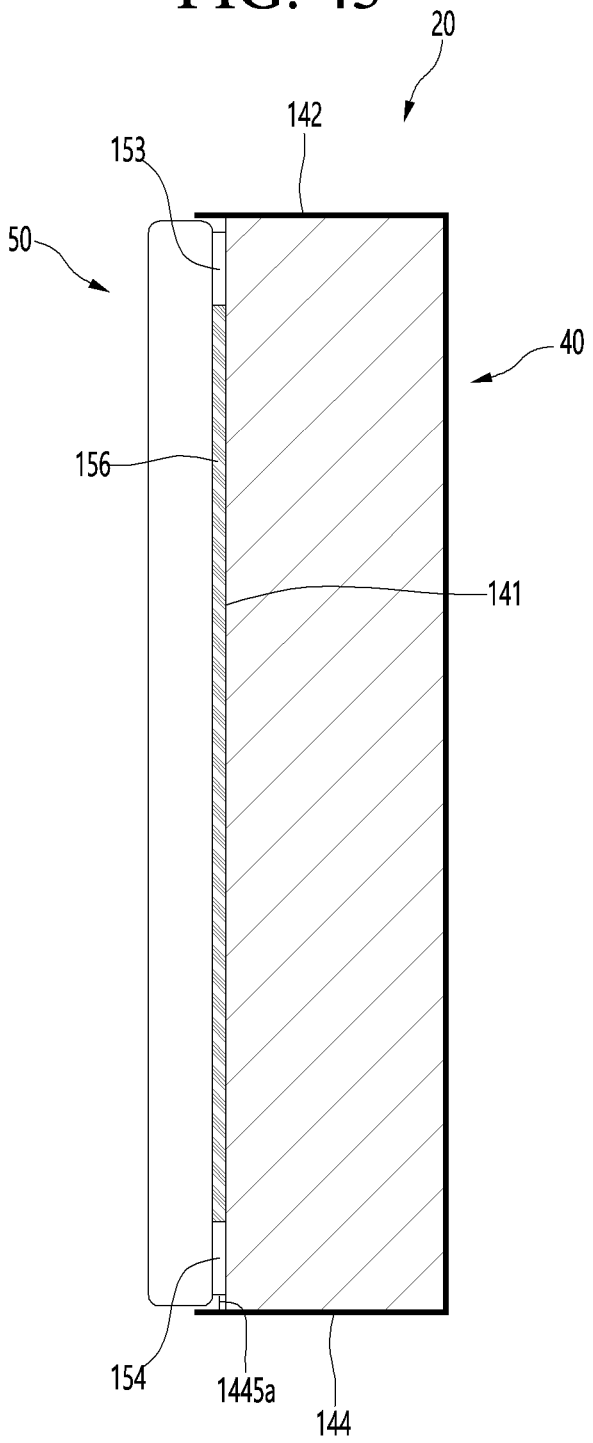
FIG. 43 is a schematic view illustrating a state in which the panel assembly is mounted on the door body.

FIG. 43 is a schematic view illustrating a state in which the panel assembly is mounted on the door body.

As illustrated in the drawing, when the panel assembly 50 is mounted on the front surface of the door body 40, the panel assemblies 50 may be disposed inside a region defined by the upper support end 1422, the lower support end 1445, and the side support end 1451*a*, respectively, and may be disposed in contact with each other.

Also, when the panel assembly 50 is mounted on the front surface of the door body 40, the lower protrusion 1445*a* may pass through the lower bent portion 1523 and be inserted into the lower bracket 154. Thus, the panel assembly 50 may not be easily separated by its own weight in the state in which the lower end of the panel assembly 50 is restricted. Also, the upper end of the panel assembly 50 may be in a state in which the upper coupling protrusion 1533 is in close contact with the upper coupling portion 1424.

Particularly, the panel assembly 50 may be maintained in a state of being attached to the front surface of the door body 40 by the magnet 156 attached to the rear surface of the panel assembly 50. Thus, the panel assembly 50 may be temporarily fixed to the front of the door body 40.

Figure 44:
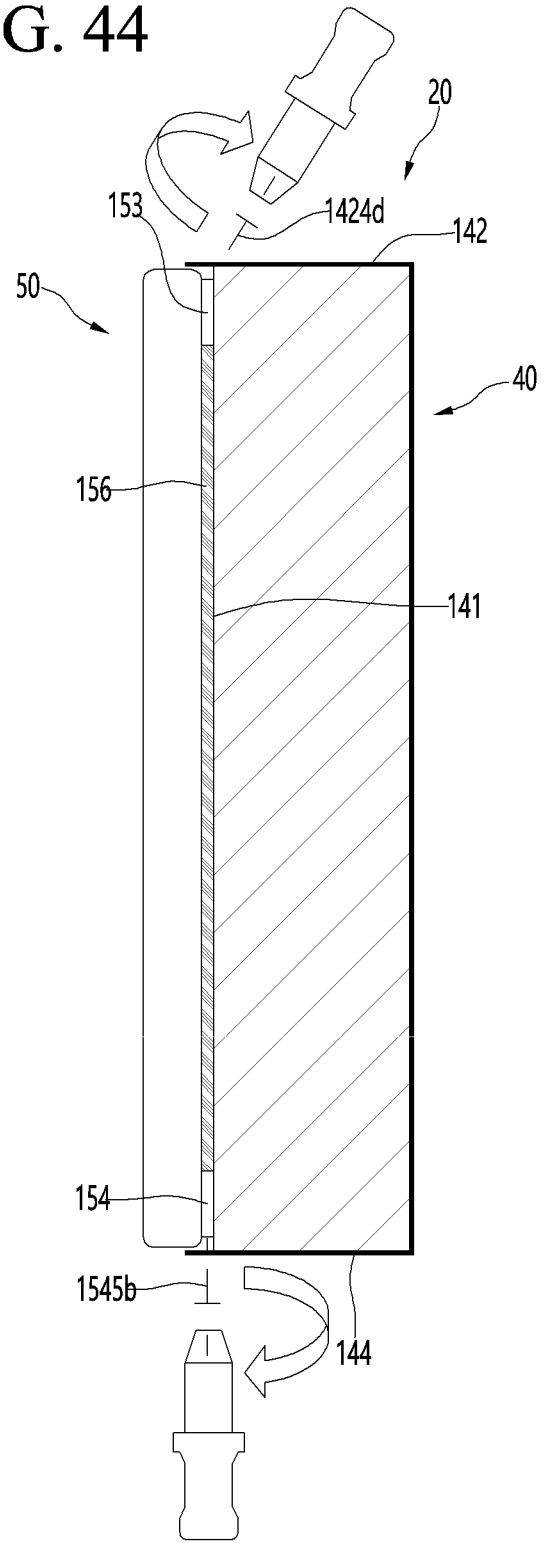
FIG. 44 is a schematic view illustrating a state in which a coupling member is coupled to upper and lower ends of the panel assembly mounted on the door body.
Figure 45:
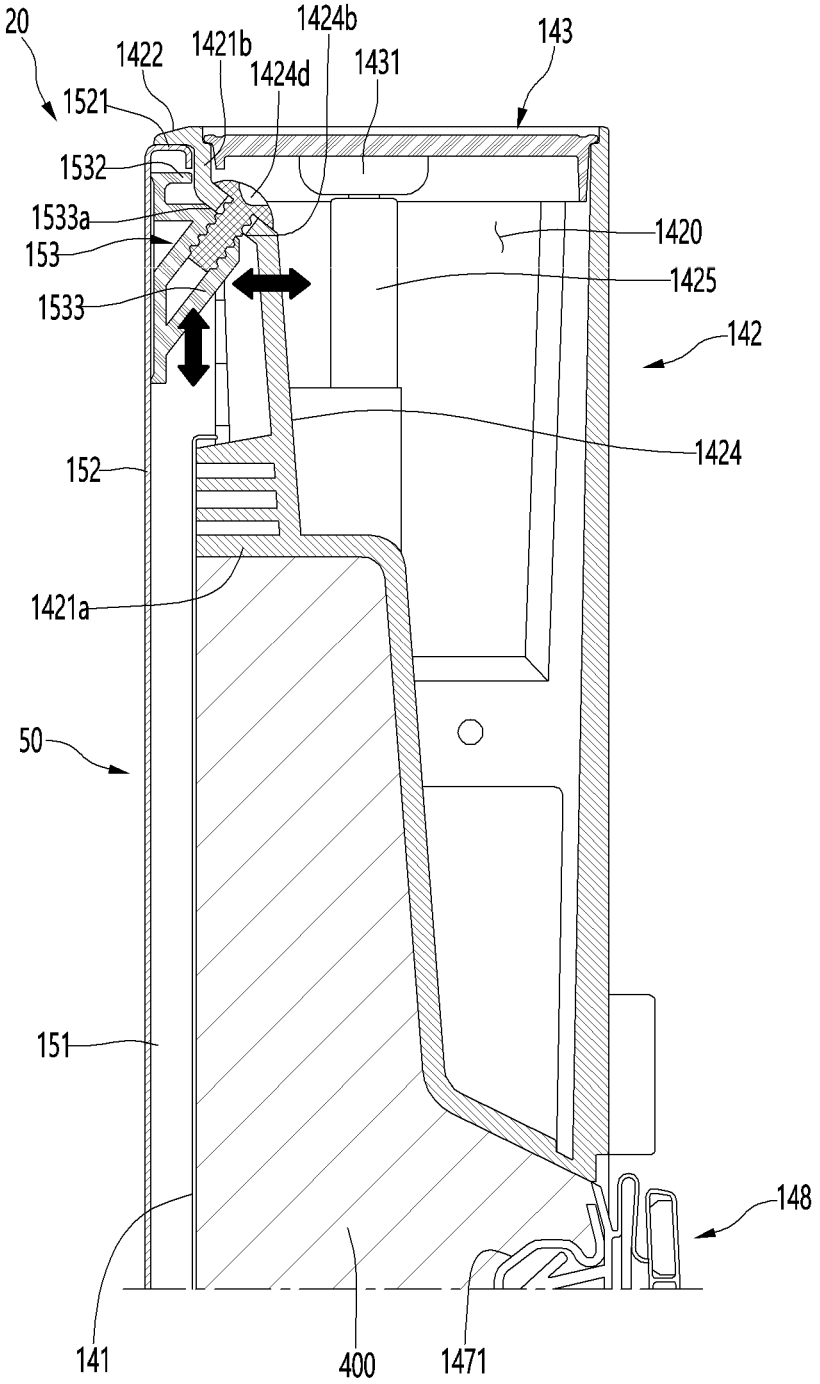
FIG. 45 is a view illustrating a state in which an upper end of a panel mounting portion is fixed.

FIG. 44 is a schematic view illustrating a state in which the coupling member is coupled to the upper and lower ends of the panel assembly mounted on the door body. Also, FIG. 45 is a view illustrating a state in which the upper end of the panel mounting portion is fixed.

As illustrated in the drawings, in a state in which the panel assembly 50 is disposed on the front surface of the door body 40, coupling members 424*d* and 545*b* may be coupled to firmly fix the upper and lower ends of the panel assembly 50.

In detail, when the panel assembly 50 is mounted on the front surface of the door body 40, a screw hole 1445*b* of the lower cap decor 144, a bent portion screw hole 1525 of the panel 152, and a screw holes 1545*a* of the lower bracket 154 may be aligned with each other. Also, in this state, when the screw 1545*b* is coupled to pass through the screw hole 1445*b* and the bent portion screw hole 1525, the screw 1545*b* may be coupled to the screw hole 1545*a* of the lower bracket 154 so that the lower end of the panel assembly 50 is firmly fixed to the lower bracket 154.

Also, when the panel assembly 50 is mounted on the front surface of the door body 40, the upper end of the upper bracket 153 may be in contact with the upper cap decor 142. Particularly, the upper coupling protrusion 1533 of the upper bracket 153 may be in contact with the upper coupling portion 1424 of the upper cap decor 142.

In detail, as illustrated in FIG. 45, when the panel assembly 50 is mounted, the upper coupling protrusion 1533 may be inserted into the upper extension portion 1424*a*. Also, in the state in which the upper coupling protrusion 1533 is inserted into the upper extension portion 1424*a*, the protrusion inclined surface 1533*a* of the upper coupling protrusion 1533 may be in contact with the upper inclined surface 1424*b* of the upper extension portion 1424*a*. Also, the screw hole 1533*b* of the protrusion inclined surface 1533*a* and the screw hole 1424*c* of the upper inclined surface 1424*b* may be aligned with each other.

In this state, the user may couple the upper coupling member 1424*d* through the recessed space 1420 of the upper cap decor 142. The upper coupling member 1424*d* may pass through the screw hole 1424*c* of the upper inclined surface 1424*b* and be coupled to the screw hole 1533*b* of the protrusion inclined surface 1533*a*. The upper coupling member 1424*d* may be coupled in a direction crossing the upper inclined surface 1424*b* and the protruding inclined surface 1533*a*. Thus, the panel assembly 50 may finely move upward and backward according to the coupling of the upper coupling member 1424*d* and thus may be adjusted according to a degree of the coupling of the upper coupling member 1424*d*.

The upper end of the panel assembly 50 may be fixed to the upper cap decor 142 by coupling the upper coupling member 1424*d*. Also, the upper end of the panel assembly 50 may be in contact with the upper support end 1422 or be maintained at a predetermined distance.

Also, when the door body 40 is mounted in a state in which the door body 40 is laid down for assembly of the door 20, the upper coupling member 1424*d* may be disposed to be inclined, and thus, the coupling of the upper coupling member 1424*d* may be more easily performed through the recessed space 1420.

The panel assembly 50 may constitute the front surface of the door 20, and not only the upper door 20 but also other doors 20*a*, 20*b*, 20*c*, and 30 may also have the same structure.

Figure 46:
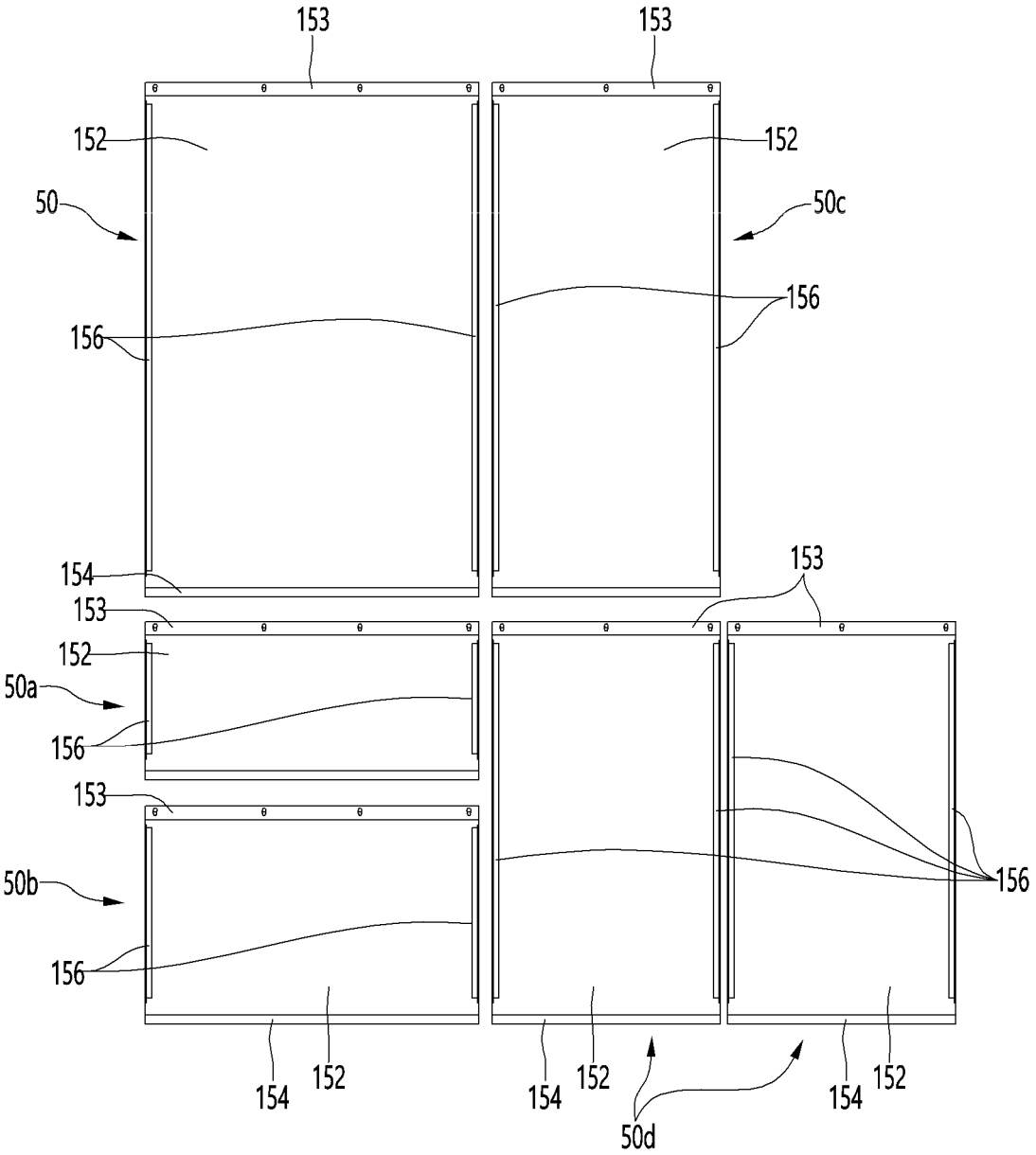
FIG. 46 is a rear cross-sectional view of the panel assembly mounted on each of the refrigerators of FIG. 21.

FIG. 46 is a rear cross-sectional view of the panel assembly mounted on each of the refrigerators of FIG. 21.

As illustrated in the drawing, a plurality of doors 20, 20*a*, 20*b*, 20*c*, and 30 constituting the refrigerators 1 and 1' according to an embodiment may have the same panel assembly structure as the panel assemblies 50*a*, 50*b*, 50*c*, and 50*d*.

The doors 20, 20*a*, 20*b*, 20*c*, and 30 have a difference only in a horizontal width and a vertical length, but the configuration of the panel assemblies 50, 50*a*, 50*b*, 50*c*, and 50*d* may have the same structure. That is, an upper bracket 153 and a lower bracket 154 may be mounted at upper and lower ends of the panel 152, respectively, and the upper bracket 153 and the lower bracket 154 may have the same structure.

Also, a magnet 156 may be mounted at each of both left and right ends between the upper bracket 153 and the lower bracket 154.

Also, door bodies 40 constituting the doors 20, 20*a*, 20*b*, 20*c*, and 30 are not illustrated in detail, but all of the door bodies may have the same structure or may be coupled to the same panel assemblies 50, 50*a*, 50*b*, 50*c*, and 50*d*.

In addition to the foregoing embodiment, a refrigerator according to various embodiments may be exemplified. According to another embodiment, a structure in which only a magnet and an upper bracket are provided in the panel assembly may be provided. Further another embodiment are all the same as the above-described embodiment except for the constituents of the panel assembly, and thus, the same components will be denoted by the same reference numerals, and detailed descriptions thereof will be omitted.

Figure 47:
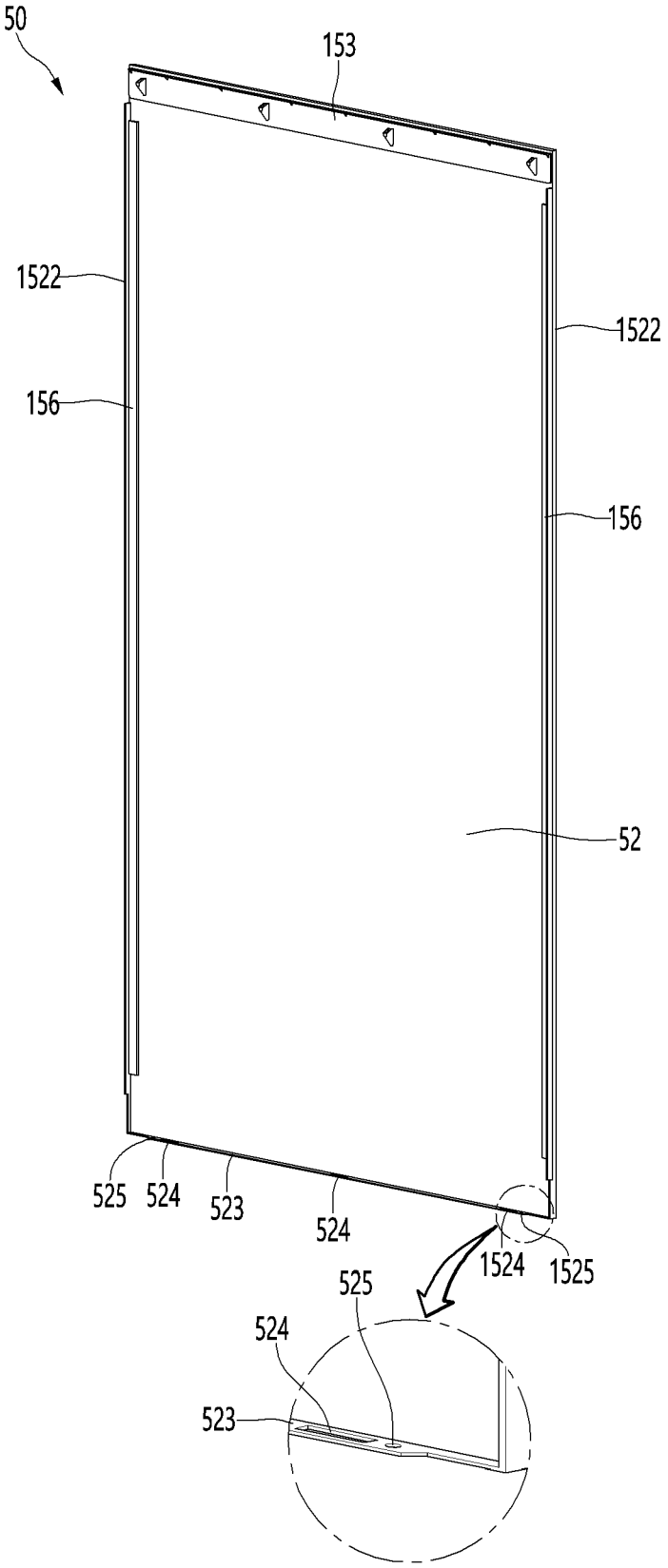
FIG. 47 is a rear perspective view of a panel assembly according to another embodiment.
Figure 48:
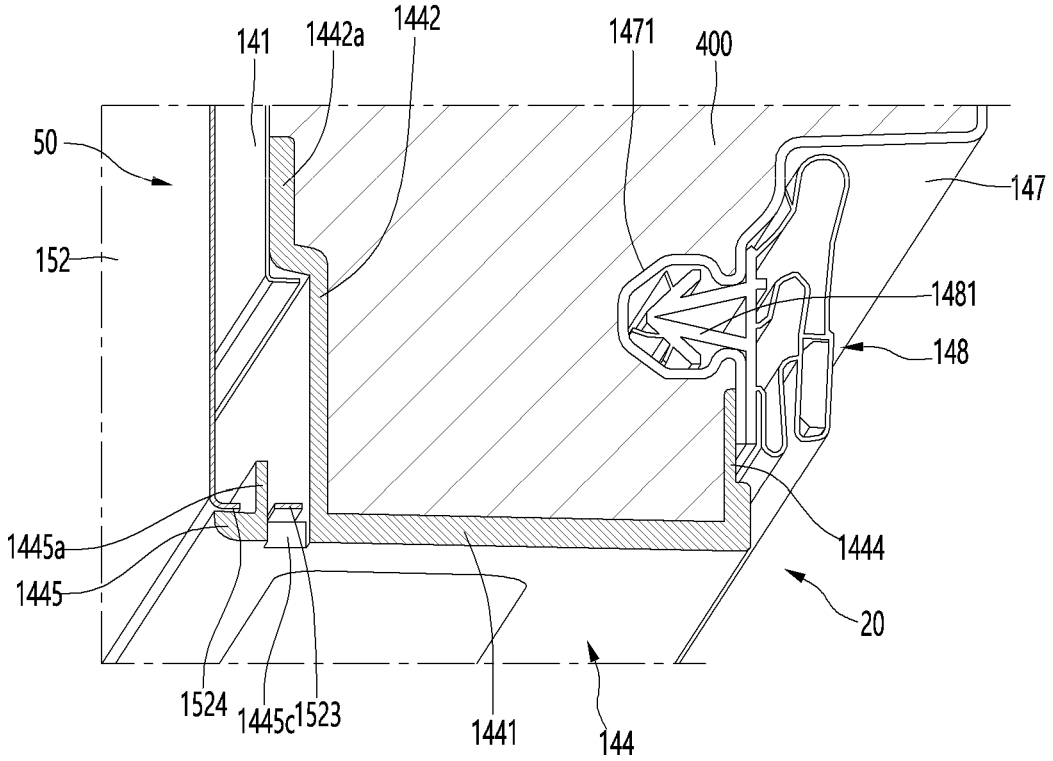
FIG. 48 is a cutaway perspective view illustrating a state in which the panel assembly is mounted.

FIG. 47 is a rear perspective view of a panel assembly according to another embodiment. FIG. 48 is a cutaway perspective view illustrating a state in which the panel assembly is mounted.

As illustrated in the drawing, a refrigerator door 20 according to another embodiment may include a door body 40 and a panel assembly 50 mounted on a front surface of the door body 40.

The panel assembly 50 may have a size corresponding to that of a front surface of the door body 40 and be configured to define an outer appearance of an entire front surface of the door 20 in a state of being mounted on the door body 40.

The panel assembly 50 may include a plate-shaped panel 152 defining an outer appearance and an upper bracket 153 for fixing upper and lower ends of the panel 152. Also, the panel assembly 50 may further include a magnet 156 so that a rear surface of the panel 152' and a front surface of the door body 40 are attached to each other.

In detail, the panel 152 may be made of a rectangular plate-shaped material having a predetermined thickness and may be made of a material that is capable of being harmonized with the furniture or wall O or the home appliance disposed therearound.

For example, the panel 152 may be made of a plate-shaped metal material such as stainless steel. Also, printing, coating treatment, or film attachment may be performed on the front surface of the panel 152 to have a color or pattern, thereby defining the outer appearance of the door 20.

The panel 152' may be maintained in a stable support state when mounted on the door body 40, and bent portions 512, 522, and 523 may be disposed along a circumference so that a cross-section of the panel 152 is not exposed to the outside. Thus, the outer appearance of the circumferential surface of the panel 152 may be defined by the bent portions 512, 522, and 523.

Each of the bent portions 521, 522, and 523 may include an upper bent portion 1521 disposed on a circumference of an upper end of the panel 152, a side bent portion 1522 disposed on each of both left and right ends of the panel 152, and a lower bent portion 1523 disposed on a circumference of a lower end of the panel 152.

Also, the lower bent portion 1523 may be formed to be bent rearward from the lower end of the panel 152. Also, the lower bent portion 1523 may have a bent portion opening 1524 into which the lower protrusion 1445*a* is inserted. The bent portion opening 1524 may be defined along the lower bent portion 1523 and may be provided in plurality at positions corresponding to the plurality of lower protrusions 1445*a* protruding from the lower support end 1445. Also, a bent portion screw hole 1525 may be further defined in the lower bent portion 1523. The bent portion screw hole 1525 may be a hole through which the lower coupling member 1545*b* coupled to the lower bracket 154 passes and be provided in plurality at positions corresponding to the lower coupling boss 1545 of the lower bracket 154.

Also, a magnet 156 may be provided at each of both left and right ends of the panel 152. The magnet 156 may be attached to the rear surface of the panel 152 by an adhesive or magnetic force. The magnet 156 may extend from an upper end to a lower end of the panel 152. Also, when the panel assembly 50 is mounted on the door body 40 in a state in which the magnet is attached to the panel 152 the magnet 156 may be attached to the front panel 152 by the magnetic force. That is, the mounting of the panel assembly 50 may be assisted by the magnet 156.

The upper bracket 153 may extend along an upper end of the panel 152 and have a length corresponding to a horizontal width of the panel 152. Also, when the panel assembly 50 is mounted, the panel assembly 50 may be coupled to the upper cap decor 142, and then, an upper end of the panel assembly 50 may be restricted.

Also, a lower end of the panel assembly 50 may be primarily fixed by inserting the lower protrusion 1445*a* into the bent portion opening 1524. Also, the lower coupling member 1545*b* may pass through the screw hole 1525 of the lower cap decor 144 and be coupled to the lower coupling boss 1545 so that the lower end of the panel assembly 50 is secondarily fixed.

In addition to the foregoing embodiment, a refrigerator according to various embodiments may be exemplified. In further another embodiment, a panel of a panel assembly may be made of a tempered glass material. In further another embodiment, other configurations except for the panel are all the same as those of the above-described embodiment, and the same components are denoted by the same reference numerals, and detailed descriptions thereof will be omitted.

Figure 49:
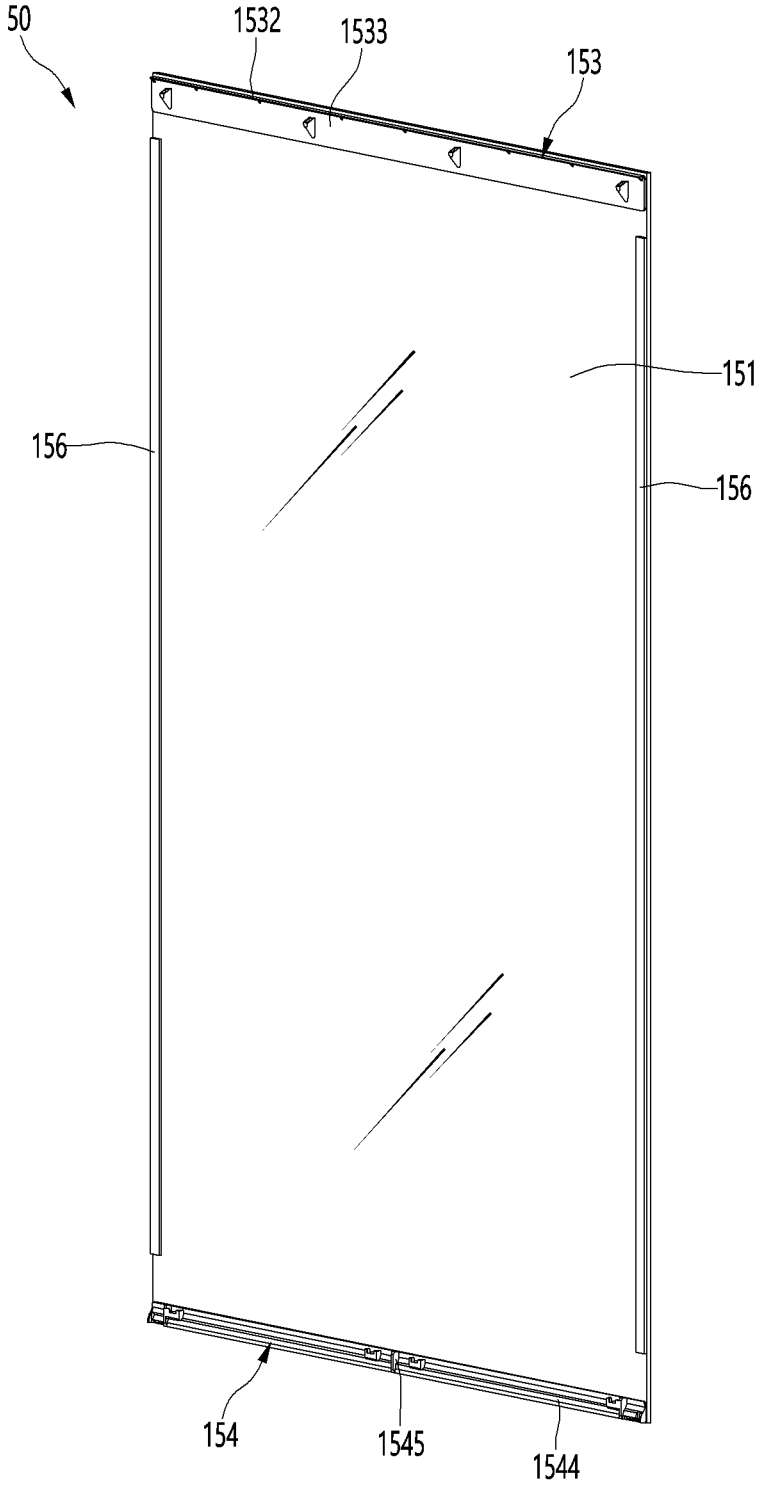
FIG. 49 is a rear perspective view of a panel assembly according to further another embodiment.

FIG. 49 is a rear perspective view of a panel assembly according to further another embodiment.

As illustrated in the drawing, a refrigerator door 20 according to further another embodiment may include a door body 40 and a panel assembly 50 mounted on a front surface of the door body 40.

The door body 40 may include a front plate 141, a door liner 147, an upper cap decor 142, a lower cap decor 144, and a side frame 145 therein, and an accommodation member 146 may be mounted on a rear surface of the front plate 141. A structure of the door body 40 may be exactly the same as the structure of the above-described embodiment.

The panel assembly 50 may be mounted on a front surface of the door body 40 to define an outer appearance of a front surface of the door 20. The panel assembly 50 may include a panel 151, an upper bracket 153, a lower bracket 156, and a magnet 156. Specific structures and shapes of the upper bracket 153, the lower bracket 154, and the magnet 156 excluding the panel 151 may be the same as those of the above-described embodiment.

In detail, the panel 151 may be made of a rectangular plate-shaped material having a predetermined thickness and may be made of a material that is capable of being harmonized with the furniture or wall O or the home appliance disposed therearound. For example, the panel 151 may be made of a glass material. For example, the panel 151 may be made of a tempered glass material, and the outer appearance of the door 20 may be defined by printing or attaching a film so as to have a color or pattern.

The panel 151 may have a size so that, in the state in which the panel 51 is mounted on the door body 40, upper end lower ends of the panel 51 are supported by an upper support end 1422 and a lower support end 1445, respectively, and both side ends of the panel 51 are supported by side support ends 1451*a*, respectively.

Also, an upper bracket 153 and a lower bracket 154 may be provided on upper and lower ends of the rear surface of the panel 151, respectively. The upper bracket 153 and the lower bracket 154 may be configured so that the upper and lower ends of the panel assembly 50 are fixedly mounted to the door body 40.

The upper bracket 153 may be provided on an upper end of the panel 151 and may have a horizontal length that is equal to a horizontal length of the panel 151. Also, an upper rib 1532 may be disposed on a rear upper end of the upper bracket 153, and an upper coupling protrusion 1533 may be disposed below the upper rib 1532 so that the upper cap decor 142 and the upper coupling member 1424*d* are coupled.

The lower bracket 154 may be provided on a lower end of the panel 151 and may have a horizontal length that is equal to a horizontal length of the panel 151. Also, a lower insertion portion 1544 into which a lower protrusion 1445*a* of the lower cap decor 144 is inserted may be defined in a lower end of the lower bracket 154, and a lower coupling boss 1545 to which a screw 1545*b* through which the lower cap decor 144 passes is coupled may be disposed.

A magnet 156 for assisting the mounting of the panel assembly 50 may be provided on the rear surface of the panel 151. The magnet 156 may extend lengthily in the vertical direction and may extends in the vertical direction along a side end of the panel 151. Also, the magnet 156 may be provided with a pair on both left and right sides.

One surface of the magnet 156 may adhere to the rear surface of the panel 151, and the other surface may be attached to the front plate 141 by magnetic force when the panel assembly 50 is mounted on the door body 40.

In another embodiment, a refrigerator includes: a cabinet configured to define a storage space; and a door configured to open and close the storage space, wherein the door includes: a door body in which an insulator is filled and of which outer appearances of top and bottom surfaces are defined by an upper cap decor and a lower cap decor; and a panel assembly provided on a front surface of the door body to define an outer appearance of a front surface of the door, wherein, in a lower end of the panel assembly, a lower protrusion protruding upward from the lower cap decor is inserted to be restricted, and in an upper end of the panel assembly, an upper coupling member coupled by passing through the upper cap decor is coupled to be mounted on the body.

The panel assembly includes: a plate-shaped panel configured to define an outer appearance of a front surface of the door; an upper bracket which is disposed along an upper end of a rear surface of the panel and to which the coupling member is coupled; and a lower bracket disposed along a lower end of the rear surface of the panel. Here, an insertion portion into which the lower protrusion is inserted may be defined in a bottom surface of the lower bracket.

The panel may be made of a tempered glass material.

The panel may be made of a metal material, and a bent portion that extends backward may be disposed around the panel.

A bent portion opening communicating with the insertion portion may be defined in the bent portion disposed along the lower end of the panel among the bent portions, and the lower protrusion may be inserted into the insertion portion by passing through the bent portion opening.

A lower coupling boss to which a lower coupling member sequentially passing through the lower cap decor and the bent portion is coupled may be disposed on a bottom surface of the lower bracket.

The bent portion disposed along the upper end of the panel among the bent portions may include a first bent portion bent backward from the upper end of the front surface of the panel and a second bent portion bent downward from a rear end of the first bent portion.

The upper cap decor and the lower cap decor may include an upper support end and a lower support end, which protrude forward to face the bent portions disposed on the upper and lower ends of the panel, and the lower protrusion may be disposed along the lower support end.

The upper bracket may include: an upper adhesion portion that is in contact with the rear surface of the panel; and an upper coupling protrusion which protrudes backward from the upper adhesion portion and to which an upper coupling member is coupled.

An upper rib further protruding than a rear end of the bent portion may be disposed on an upper end of the upper adhesion portion.

The upper coupling protrusion may extend to be inclined backward and upward, and a screw hole to which the upper coupling member is coupled may be defined in an upper end of the upper coupling protrusion.

A protrusion inclined surface having an inclination that gradually decreases backward may be disposed on a top surface of the upper coupling protrusion, and the screw hole may be defined in the protrusion inclined surface.

An evacuation portion that is further inclined than the protrusion inclined surface to prevent the panel assembly from interfering with the upper cap decor when the panel assembly is mounted may be defined in a rear end of the top surface of the upper coupling protrusion.

An upper coupling portion through which the upper coupling member passes may be disposed on the front surface of the upper cap decor facing the upper coupling protrusion.

The upper cap decor may define a recessed space having an opened top surface, and the upper coupling portion may be exposed to the inside of the recessed space so that the upper coupling member is coupled through the recessed space.

A decor cover configured to open and close the recessed space may be disposed on the upper cap decor.

The upper coupling portion may be recessed backward to accommodate the upper coupling protrusion and protrudes to the inside of the recessed space.

A coupling portion inclined surface having an inclination corresponding to the protrusion inclined surface and being in contact with the protrusion inclined surface may be disposed on the upper coupling portion, and the upper coupling member may be coupled to sequentially pass through the coupling portion inclined surface and the protrusion inclined surface.

When the panel assembly is mounted on the door body so that the lower protrusion is inserted into the insertion portion, the protrusion inclined surface and the coupling portion inclined surface may be in contact with each other.

The door body may be made of a steel material and include a front plate spaced apart from the rear surface of the panel to define the front surface of the door body, and a magnet for attaching the panel assembly to the front plate by using magnetic force may be provided on the rear surface of the panel.

The following effects may be expected in the refrigerator according to the proposed embodiments of the present invention.

In the refrigerator according to the embodiment, the outer appearance of the front surface of the refrigerator may be defined by mounting the panel assembly. In addition, the panel assembly may be replaceable and mounted, as necessary. Therefore, in the case of the built-in installation, the panel assembly may be mounted to match the surrounding furniture or walls. In addition, even when the plurality of refrigerators are disposed in succession, the outer appearance may be harmonized.

In addition, the panel assembly may have the structure in which the upper and lower ends are fixed and restricted by the first cap decor (upper cap decor) and the second cap decor (lower cap decor), and thus, the structure that is coupled to the outside when viewed from the front side may not be exposed to improve the outer appearance.

In addition, the panel assembly may have the structure in which the upper and lower ends are restricted by the first bracket and the second bracket, and both the side ends are attached by the magnet, and thus, the entire circumference of the panel assembly may be firmly fixed.

Particularly, the lower end of the panel assembly may be seated on the second support end by its own weight, and the state in which the restriction portion is inserted inside the lower insertion portion may be maintained to prevent the panel assembly from being unintentionally separated.

In addition, in the upper end of the panel assembly, the insertion protrusion of the first bracket may be inserted by passing through the first cap decor, and the restriction protrusion of the decor cover mounted on the first cap decor may pass through the insertion protrusion to maintain the firmly mounted state.

In addition, the panel assembly may be maintained in the state in which the coupling member is coupled in the state in which the lower end thereof is inserted into the lower protrusion and temporarily fixed by the magnet, and thus, the mounting of the decor cover and the restriction of the upper end of the panel assembly may be more easily performed.

In addition, the lower end of the panel assembly may have the structure in which the lower protrusion is primarily inserted into the insertion groove of the second bracket, and the panel assembly may be mounted through the sample operation in which the upper end of the panel assembly rotates in the state in which the lower end of the panel assembly is primarily fixed, and then, the upper end of the panel assembly is restricted, and also, the panel assembly may be simply separated in the reverse order of the same process.

Due to the simple detachable mounting structure of the panel assembly, the user may directly mount and detach the panel assembly having the desired shape.

Particularly, the lower end of the panel assembly may have the structure that is restricted by its own weight, and the upper end of the panel assembly may have in which the insertion protrusion and the restriction protrusion are coupled to each other by the mounting of the decor cover. Thus, the panel assembly may be simply mounted and separated without using the separate kit or tool, and the separation and mounting of the panel assembly may be easily performed.

In addition, the magnet may be disposed on the rear surface of the panel assembly, and the left and right ends of the panel assembly may be attached to the door body by the magnet. Thus, the entire circumference of the panel assembly may be maintained in the stably coupled state without exposing the configuration for coupling the panel assembly.

In addition, the lower end of the panel assembly may have the structure in which the lower protrusion is primarily inserted into the insertion groove of the lower bracket, and the coupling member may be coupled to the upper end and the lower end of the panel assembly in the state in which the lower end of the panel assembly is primarily fixed, and thus, the panel assembly may be firmly fixed to the upper cap decor and the lower cap decor.

That is, the upper end and the lower end of the panel assembly may be firmly fixed to the upper cap decor and the lower cap decor by the coupling due to the lower protrusion as well as the coupling of the upper coupling member and the lower coupling member to maintain the mounted state of the panel assembly.

In addition, the state in which the panel assembly is more firmly coupled to the door body may be maintained by the adhesion force between the upper and the front surface of the door body due to the magnet.

In addition, the panel assembly may be maintained in the state in which the coupling member is coupled in the state in which the lower end thereof is inserted into the lower protrusion and temporarily fixed by the magnet, and thus, the coupling of the coupling member may be more easily performed.

Particularly, in the state in which the lower end of the panel assembly is fixed, the upper end of the panel assembly may be naturally aligned with the upper coupling protrusion and the upper coupling portion, and thus, the coupling of the upper coupling member may be easy.

In addition, the structure in which the upper coupling member is coupled in the inclined direction to the upper coupling protrusion and the upper coupling portion, which are inclined, may be provided, and thus, the upper coupling member may be coupled in the state in which the panel assembly is laid down. Therefore, the space for the coupling operation may be secured, and thus, the coupling operation may be more easily performed.

In addition, the upper coupling portion may be disposed inside the recessed space of the upper cap decor, and after the upper coupling member is coupled, the decor cover may be mounted to shield the inside of the recessed space. Therefore, the structure for fixing the upper coupling member and the panel assembly may be prevented from being exposed to more improve the outer appearance.

In addition, after the coupling member is separated, the panel assembly may be lifted to separate the lower end of the panel assembly from the lower protrusion, thereby easily performing the separation of the panel assembly.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines a storage space; and a door configured to open and close at least a portion of the storage space, the door comprising:

a door liner that defines a rear surface of the door, a front plate disposed forward relative to the door liner, a first cap decor coupled to the door liner and a first end of the front plate, the first cap decor defining a decor recess that is recessed from an outer surface of the door, a decor cover that is disposed on the first cap decor and covers the decor recess, a second cap decor coupled to the door liner and a second end of the front plate, the second cap decor being spaced apart from and facing the first cap decor, an insulator provided in a space defined by the door liner, the front plate, the first cap decor, and the second cap decor, and a panel assembly detachably disposed at the front plate, the panel assembly comprising:

a panel that defines an outer appearance of a front surface of the door, a first bracket that protrudes from a rear surface of the panel, the first bracket being inserted into and restricted by the first cap decor, and a second bracket disposed at the rear surface of the panel and supported by the second cap decor, wherein the first cap decor comprises a decor coupling portion that is disposed inside the decor recess, that supports a lower side of the decor cover, and that is coupled to a screw passing through the decor cover.

2. The refrigerator according to claim 1, wherein the first bracket comprises:

an adhesion portion that extends along a first end of the panel; and a plurality of insertion protrusions arranged along the adhesion portion and spaced apart from one another by an interval, each of the plurality of insertion protrusions protruding toward a front surface of the first cap decor.

3. The refrigerator according to claim 2, wherein the first cap decor further defines a plurality of insertion holes at the front surface of the first cap decor, each of the plurality of insertion holes receiving one of the plurality of insertion protrusions, and wherein the decor recess is in communication with the plurality of insertion holes.

4. The refrigerator according to claim 3, wherein the decor cover comprises a restriction protrusion that extends to an inside of the decor recess and is configured to restrict at least one of the plurality of insertion protrusions.

5. The refrigerator according to claim 4, wherein an insertion protrusion among the plurality of insertion protrusions defines a through-hole that vertically penetrates through the insertion protrusion, and wherein the restriction protrusion passes through the through-hole.

6. The refrigerator according to claim 5, wherein the restriction protrusion comprises a protrusion inclination surface inclined with respect to an extension direction of the restriction protrusion such that a width of the restriction protrusion decreases in the extension direction, wherein the restriction protrusion is inserted into the through-hole to thereby bring the panel assembly in contact with the front plate, and wherein the protrusion inclination surface is in contact with a surface defining the through-hole.

7. The refrigerator according to claim 4, wherein the insulator is not provided in the decor recess.

8. The refrigerator according to claim 3, wherein the first cap decor comprises a first support end disposed along an end of the first cap decor, the first support end protruding toward the panel and supporting the first end of the panel.

9. The refrigerator according to claim 3, wherein the first cap decor comprises a plate coupling portion disposed at the front surface of the first cap decor and coupled to an upper end of the front plate, and wherein the plurality of insertion holes are defined above the plate coupling portion.

10. The refrigerator according to claim 8, wherein the second cap decor comprises:

a second support end disposed along an end of the second cap decor, the second support end protruding toward the panel and supporting a second end of the panel; and a plurality of restriction portions that protrude from the second support end and are coupled to the second bracket.

11. The refrigerator according to claim 10, wherein the second bracket defines a bracket insertion portion at a lower end thereof, the bracket insertion portion being opened downward and receiving one of the plurality of restriction portions, and wherein the second support end is in contact with a lower end of the panel.

12. The refrigerator according to claim 1, wherein the front plate is made of a steel material and attached to left and right ends of the rear surface of the panel.

13. The refrigerator according to claim 1, wherein the panel is made of a metal material and comprises a bent portion that is disposed along a circumference of the panel and bent toward the front plate.

14. The refrigerator according to claim 1, wherein the panel comprises a panel seating portion that is disposed at a circumference of the panel and mounts the first bracket and the second bracket.

15. The refrigerator according to claim 14, wherein the panel is made of glass or a FENIX material.

16. The refrigerator according to claim 1, wherein the first cap decor defines a top surface of the door, and the second cap decor defines a bottom surface of the door, and wherein the door further comprises:

a lower protrusion that is disposed at a lower end of the panel assembly and protrudes upward from the second cap decor, the lower protrusion being inserted into and restricted by the second bracket; and an upper coupling member that is disposed at an upper end of the panel assembly, the upper coupling member passing through the first cap decor and being coupled to the first bracket.

17. The refrigerator according to claim 16, wherein the first bracket comprises:

an upper adhesion portion that is in contact with the rear surface of the panel; and an upper coupling protrusion that protrudes rearward relative to the upper adhesion portion and is coupled to the upper coupling member.

18. The refrigerator according to claim 17, wherein the first cap decor comprises an upper coupling portion that receives the upper coupling member and that is disposed at a front surface of the first cap decor facing the upper coupling protrusion, wherein the first cap decor defines a recessed space having an opened top surface, and wherein the upper coupling member has a first portion exposed to the recessed space and a second portion coupled to the first bracket through the recessed space.

19. The refrigerator according to claim 18, wherein the upper coupling portion is recessed rearward relative to the front surface of the first cap decor and accommodates the upper coupling protrusion, the upper coupling portion protruding into the recessed space.

20. The refrigerator according to claim 1, wherein the decor cover defines a screw hole that faces the decor coupling portion and receives the screw.

* * * * *